US011274389B2

(12) United States Patent
Uetsuhara et al.

(10) Patent No.: US 11,274,389 B2
(45) Date of Patent: Mar. 15, 2022

(54) WASHING MACHINE

(71) Applicant: Samsung Electronics Co., Ltd, Suwon-si (KR)

(72) Inventors: Masahiro Uetsuhara, Kanagawa (JP); Takehiero Nakanishi, Kanagawa (JP); Minsu Kim, Kanagawa (JP); Shigeki Hayashi, Kanagawa (JP); Shin Kagami, Kanagawa (JP); Tomoyuki Okuno, Kanagawa (JP); Toshihiro Kamii, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 186 days.

(21) Appl. No.: 16/054,792

(22) Filed: Aug. 3, 2018

(65) Prior Publication Data

US 2019/0040567 A1 Feb. 7, 2019

(30) Foreign Application Priority Data

Aug. 4, 2017 (JP) ..... 2017-151173
Aug. 4, 2017 (JP) ..... 2017-151174
(Continued)

(51) Int. Cl.
*D06F 39/00* (2020.01)
*D06F 39/08* (2006.01)
(Continued)

(52) U.S. Cl.
CPC ..... *D06F 33/43* (2020.02); *D06F 23/04* (2013.01); *D06F 33/48* (2020.02); *D06F 37/12* (2013.01);
(Continued)

(58) Field of Classification Search
CPC ..... D06F 39/08; D06F 39/081; D06F 39/083; D06F 39/006; D06F 39/085; D06F 37/00–0203; D06F 37/24
See application file for complete search history.

(56) References Cited

U.S. PATENT DOCUMENTS 4,162,621 A * 7/1979 Stone ..... D06F 37/00 68/23.2
5,046,337 A * 9/1991 Ro ..... D06F 39/083 68/18 F
(Continued)

FOREIGN PATENT DOCUMENTS

EP 3031971 A1 6/2016
GB 2196724 A * 5/1988 ..... D06F 39/086
(Continued)

OTHER PUBLICATIONS

International Search Report dated Nov. 23, 2018 in connection with International Patent Application No. PCT/KR2018/008865, 5 pages.
(Continued)

*Primary Examiner* — Michael E Barr
*Assistant Examiner* — Omair Chaudhri

(57) ABSTRACT

Disclosed herein is a top load washing machine having excellent functions while saving water. The washing machine may include a housing having a drain path installed at the bottom, a water collecting tub supported on the housing in the inside of the housing, and a rotating tub rotating on a shaft extending vertically in the inside of the water collecting tub. The rotating tub may include an outlet opening to the lower portion of a body member that can store water independently from the water collecting tub. The water collecting tub may include a first drain hole opening to the inside space of the water collecting tub, and a second drain hole communicating with the outlet. The drain path
(Continued)

may include a first path connected to the first drain hole, and a second path connected to the second drain hole.

16 Claims, 71 Drawing Sheets

(30) Foreign Application Priority Data

| | | |
|---|---|---|
| Aug. 4, 2017 | (JP) | 2017-151175 |
| Aug. 4, 2017 | (JP) | 2017-151177 |
| Aug. 4, 2017 | (JP) | 2017-151178 |
| Aug. 4, 2017 | (JP) | 2017-151179 |
| Dec. 11, 2017 | (JP) | 2017-236719 |
| May 9, 2018 | (KR) | 10-2018-0053162 |

(51) Int. Cl.

| | |
|---|---|
| ***D06F 23/04*** | (2006.01) |
| ***D06F 33/43*** | (2020.01) |
| *D06F 37/12* | (2006.01) |
| *D06F 37/24* | (2006.01) |
| *D06F 37/26* | (2006.01) |
| *D06F 103/16* | (2020.01) |
| *D06F 103/18* | (2020.01) |
| *D06F 103/24* | (2020.01) |
| *D06F 103/26* | (2020.01) |
| *D06F 103/32* | (2020.01) |
| *D06F 105/48* | (2020.01) |
| *D06F 105/58* | (2020.01) |
| *D06F 105/60* | (2020.01) |
| *D06F 101/12* | (2020.01) |
| *D06F 33/48* | (2020.01) |

(52) U.S. Cl.

CPC ..... *D06F 37/245* (2013.01); *D06F 37/267* (2013.01); *D06F 39/006* (2013.01); *D06F 39/083* (2013.01); *D06F 2101/12* (2020.02); *D06F 2103/16* (2020.02); *D06F 2103/18* (2020.02); *D06F 2103/24* (2020.02); *D06F 2103/26* (2020.02); *D06F 2103/32* (2020.02); *D06F 2105/48* (2020.02); *D06F 2105/58* (2020.02); *D06F 2105/60* (2020.02)

(56) References Cited

U.S. PATENT DOCUMENTS

| | | | | |
|---|---|---|---|---|
| 2004/0163422 | A1* | 8/2004 | Kim | D06F 37/42 68/12.05 |
| 2005/0015892 | A1* | 1/2005 | Park | D06F 37/04 8/159 |
| 2006/0254626 | A1* | 11/2006 | Botts | D06F 39/006 134/110 |
| 2009/0158784 | A1* | 6/2009 | Kim | D06F 31/00 68/27 |
| 2010/0275386 | A1* | 11/2010 | Ko | D06F 33/00 8/158 |
| 2010/0300154 | A1* | 12/2010 | Nakamura | D06F 39/083 68/13 R |
| 2010/0326141 | A1* | 12/2010 | Chung | D06F 37/12 68/23.2 |
| 2012/0096652 | A1* | 4/2012 | Choi | D06F 21/08 8/137 |
| 2013/0036776 | A1* | 2/2013 | Seo | D06F 37/206 68/18 F |
| 2013/0269396 | A1* | 10/2013 | Na | D06F 37/24 68/131 |
| 2014/0033772 | A1* | 2/2014 | Jung | D06F 37/26 68/131 |
| 2015/0240404 | A1* | 8/2015 | Kim | D06F 37/304 68/12.05 |
| 2017/0342637 | A1* | 11/2017 | Miao | D06F 25/00 |
| 2018/0127912 | A1* | 5/2018 | Leibman | D06F 39/02 |
| 2019/0249348 | A1* | 8/2019 | Kim | F16F 15/131 |

FOREIGN PATENT DOCUMENTS

| | | | | |
|---|---|---|---|---|
| JP | 05253392 | A | | 10/1993 |
| JP | H06296793 | A | | 10/1994 |
| JP | H09285686 | A | | 11/1997 |
| JP | H1142396 | A | | 2/1999 |
| JP | 2002-282586 | A | | 10/2002 |
| JP | 2002282586 | A | * | 10/2002 |
| JP | 2002292193 | A | | 10/2002 |
| JP | 2012055546 | A | | 3/2012 |
| JP | 2012223359 | A | | 11/2012 |
| KR | 20-2000-0018236 | U | | 10/2000 |
| KR | 20-0336362 | Y1 | | 12/2003 |
| WO | 2014129363 | A1 | | 8/2014 |

OTHER PUBLICATIONS

Supplementary European Search Report in connection with European Application No. 18840710.0 dated Apr. 23, 2020, 8 pages.

* cited by examiner

WASHING MACHINE

CROSS-REFERENCE TO RELATED APPLICATIONS AND CLAIM OF PRIORITY

This application is based on and claims priority under 35 U.S.C. § 119 to Japanese Patent Applications Nos. 2017-151173 filed on Aug. 4, 2017, 2017-151174 filed on Aug. 4, 2017, 2017-151175 filed on Aug. 4, 2017, 2017-151177 filed on Aug. 4, 2017, 2017-151178 filed on Aug. 4, 2017, 2017-151179 filed on Aug. 4, 2017 and 2017-236719 filed on Dec. 11, 2017 in the Japanese Intellectual Property Office and Korean Patent Application No. 10-2018-0053162 filed on May 9, 2018 in the Korean Intellectual Property Office, the disclosures of which are incorporated by reference herein in their entireties.

BACKGROUND

1. Field

The present disclosure relates to a top load washing machine, and more particularly, to a washing machine including a holeless rotating tub (a washing and dehydrating tub) capable of storing water independently.

2. Description of the Related Art

Fully automated type washing machines that automatically perform a series of washing operations of washing, rinsing, dehydrating, drying (if necessary), etc. are widely used. Lately, a drum type washing machine is increasingly used in which a drum into which laundry is put rotates on a shaft extending in a horizontal direction or in an inclined direction, since it can save water. However, a top load washing machine in which a washing and dehydrating tub into which laundry is put rotates on a shaft extending in a vertical direction is still popular.

In the top load washing machine, a washing and dehydrating tub formed in the shape of a cylindrical container is accommodated in a storage tank installed in a housing, and in the wall of the washing and dehydrating tub, a plurality of dehydrating holes are formed over a wide range to easily drain water and dehydrate laundry. In this kind of washing machine, water used in each operation of washing or rinsing is collected in the space between the washing and dehydrating tub and the storage tank, as well as in the washing and dehydrating tub.

However, there is a washing machine including a holeless washing and dehydrating tub (corresponding to a rotating tub) without any dehydrating holes.

For example, there has been disclosed a washing machine including a holeless washing and dehydrating tub which is installed in the inside of a water collecting tub and in which dehydrating holes are formed only at the top. In the washing machine, by raising the RPM of the holeless washing and dehydrating tub to cause water to overflow through the dehydrating holes, water is drained to the water collecting tub to thereby dehydrate laundry. Water collected on the bottom of the water collecting tub is drained to the outside of the washing machine when an electromagnetic valve opens, and also, when a circulation pump is driven, the water returns to the holeless washing and dehydrating tub.

Also, there has been disclosed a washing machine including a washing and dehydrating tub having an opening at the top, wherein the washing and dehydrating tub rotates at high speed to cause water to overflow through the opening. In the washing machine, a drain hole is formed in the center of the bottom of the washing and dehydrating tub, and when a drain valve opens, water collected in the washing and dehydrating tub is drained through the drain hole.

In this washing machine, water used in each operation of washing or rinsing is collected only in the washing and dehydrating tub. Therefore, it is possible to decrease water consumption by about 20% to 30% according to washing machine specifications or water storage amounts.

More specifically, on a drain path, a circulation path diverging at an upstream side from a drain valve and extending upward along the side surface of the tank accommodating the washing and dehydrating tub is installed. On the circulation path, a storage tank for temporarily storing water to be drained, a circulation pump for circulating washing water, etc. are installed. In the storage tank, a heater for heating water is installed. A discharge pipe of the circulation path that returns washing water to the washing and dehydrating tub is disposed in the main body (housing) of the washing machine.

During washing, washing water is heated to predetermined temperature in the storage tank, and circulated. Thereby, an effect of saving water and enhancing detergency can be obtained since the washing machine can heat water in a short time while using a small amount of washing water and suppressing power consumption.

Also, there has been disclosed a washing machine in which a water path formed in the shape of a circular ring is installed around the upper edge of a washing and dehydrating tub, although the washing and dehydrating tub is not holeless and there is no path for circulating water. In the water path, a plurality of feeding holes are formed throughout the entire circumference.

In the washing machine, when rinsing is performed while dehydrating, water is supplied to the water path to be sprinkled in the form of a shower on laundry collected on the inner circumferential surface of the washing and dehydrating tub through the feeding holes. Therefore, water sinks equally in the laundry although the amount is a little.

Also, as an embodiment, there has been disclosed a method of forming a water path in the upper part of a balancer installed at the upper edge of the washing and dehydrating tub and forming feeding holes penetrating the balancer vertically.

Also, there has been disclosed a washing machine including a holeless washing tub (rotating tub) and rotation blades (pulsator) having rear blades. The washing machine generates ascending flows in water stored in the washing tub by the centrifugal force of the rear blades, generates swirl flows by the centrifugal force of the blades, and combines the ascending flows with the swirl flows to thereby generate spiral flows in the washing tub.

Therefore, a surrounding wall may be formed around the outer circumference of the pulsator in such a way to be inclined upward, and a plurality of waterstream holes may be arranged in a lattice shape in the surrounding wall in such a way to penetrate the surrounding wall in a horizontal direction so that water is smoothly discharged through the surrounding wall by a centrifugal force. Also, a plurality of holes may be formed around the center of the rotation blades in order to cause water to enter toward the other sides of the rotation blades.

Also, there has been disclosed a washing machine in which a supply pipe for sprinkling water in the form of a shower is installed above an inner washing tub and an outer washing tub in order to remove dirt, mold, etc. stuck between the inner washing tub and the outer washing tub, and brushes are installed between layers. During cleaning, washing water is sprinkled through the supply pipe, and the inner washing tub rotates slowly to brush the washing tubs. Thereby, dirt, mold, etc. are washed off with the washing water, and removed by the brushes.

Also, there has been disclosed a washing machine which includes an inner tub having a plurality of dehydrating holes and in which a user can select immersion cleaning through the inner tub and an outer tub, as an operation course, although if there is no outer tub, it cannot store water.

SUMMARY

The typical washing machines including the holeless rotating tubs, as described above, need to be improved in view of functions, such as a structure of a drain path, a structure of circulating water, etc., although they can save water.

(First Problem)

In a typical washing machine (prior art 1), since water overflows through dehydrating holes formed at the top of a holeless washing and dehydrating tub so that water cannot be drained to the outside, it is necessary to rotate the washing and dehydrating tub, which makes drainage difficult. Also, since stored water overflows, a water collecting tub shakes heavily, which may make a trouble. In regard of this, another typical washing machine (prior art 2) that can drain water through a drain hole does not have such a problem.

However, the other typical washing machine (prior art 2) has a complicated drain structure, and accordingly, it often causes a drainage problem. At the junction where a first drain connected to a drain hole meets a second drain connected to the bottom of a water tub (corresponding to a water collecting tub), drain switch means for closing any one of the drains is installed. However, since lint, etc. mixed in water to be drained are collected in the drain switch means for changing a water flow, the drain switch means is easy to operate wrongly. Also, in the typical washing machines (prior art 1 and prior art 2), when a large amount of water is stored in the water collecting tub, water may leak out of the water collecting tub, which may lead to troubles such as failure in the electrical system.

(Second Problem)

There is a washing machine (a washing machine including a drain pump) that forcedly drains water using a drain pump, instead of natural drainage in which water flows downward. The washing machine including the drain pump is widely used in America and Europe.

In the washing machine, a head of a drain path located downstream from the drain pump is higher than the upper limit of storage of the washing machine in order to drain water to the sink, etc. Accordingly, in the washing machine including the drain pump, water can be stored due to a difference in water level although drainage does not stop. Therefore, generally, in the washing machine including the drain pump, no stop valve is installed on the drain path.

When a drain pump is installed in the washing machine including a rotating tub that can store water, the drain pump is installed instead of an electromagnetic valve or a drain valve. It can be considered that a drain valve is installed downstream from an electromagnetic valve or a drain valve to be connected in series to the electromagnetic valve or the drain valve. However, in this case, the function of the electromagnetic valve or the drain valve gets out of use. Furthermore, when the drain pump operates in the state in which the electromagnetic valve or the drain valve is closed, the drain pump may break down.

(Third Problem)

In the typical washing machine (prior art 2), a storage tank of a large capacity is installed on a circulation path diverging from the drain path, and water collected in the storage tank is heated by a heater. Therefore, the amount of washing water increases by the volume of the storage tank, which becomes a problem in view of water saving. Also, time for heating is required.

Also, since the storage tank is disposed below the main body of the washing machine, space for the storage tank is needed, and accordingly, it is necessary to decrease the capacity of the washing and dehydrating tub or to enlarge the size of the main body of the washing machine, which becomes a problem in view of size reduction.

Also, there is a case in which foreign materials such as buttons are mixed in washing water. In the typical washing machine (prior art 2), the drain path or the circulation path including a switch member has a complicated structure, and washing water including foreign materials is drained or circulated. Therefore, the switching member or the circulation pump often breaks down, and the flow path is easily clogged. As a result, poor drainage is caused or errors occur in detecting temperature, which may overheat the storage tank unnecessarily.

Also, the discharge pipe of the circulation path is disposed in the main body of the washing machine. Also, since the tank including the washing and dehydrating tub is shakably supported on the main body of the washing machine, a location at which washing water is discharged from the discharge pipe may deviate from the opening of the washing and dehydrating tub so that washing water enters the tank without returning to the washing and dehydrating tub.

(Fourth Problem)

When water stored in the rotating tub circulates during a washing course, etc., the circulating water generally returns to the rotating tub through the upper opening of the rotating tub. Since the rotating tub or the water collecting tub accommodating the rotating tub shakes during dehydrating, the water supply hole is spaced from the opening of the rotating tub. Therefore, by sprinkling water toward the center of the rotating tub from the water supply hole using the ejecting power of the circulation pump, or installing a barrel-shaped member below the water supply hole to drop water into the opening of the rotating tub, water is supplied to the inside of the rotating tub.

However, there is a case in which a part of water discharged from the water supply hole overflows to the outside of the rotating tub due to ejecting power fluctuations caused by on/off operations of the circulation pump, head differences, etc., or shaking of the opening of the rotating tub caused by a rotation of the rotating tub.

In the case of a holeless rotating tub, water overflowing to the outside of the rotating tub does not return to the inside of the rotating tub, unless it returns to the circulation pump. Therefore, when the amount of water overflowing to the outside of the rotating tub increases, the amount of water to be used for washing decreases accordingly. Due to the insufficient amount of water, washing performance deteriorates, and a load is applied to driving to increase consumption power.

In another typical washing machine (prior art 3), water is supplied to the washing and dehydrating tub through a water path, and accordingly, water is supplied slowly. Also, a method of enlarging the water feeding hole or deepening the water tank is not realistic. Also, since circulating water contains lint, there is the possibility that the water feeding hole will be clogged. Therefore, this cannot be adopted for water circulation such as a washing operation requiring efficiently circulating a large amount of water. Since an outlet corresponding to a water supply hole is fixed at the frame of the washing machine, water may leak out of the outer tub when the washing and dehydrating tub and the outer tub shake.

(Fifth Problem)

When the rotating tub is holeless, the amount of water with respect to laundry is small. Accordingly, the portion of fine lint generated from the laundry and mixed in water is relatively high. Therefore, the link is easily attached again on the laundry to make fluff on the laundry.

If a lint filter is installed on the circulation path to collect lint during circulation, such reattachment is prevented. However, stable and strong circulation capability is required to efficiently collect lint through a lint filter while circulating water smoothly.

In another typical washing machine (prior art 4), water is discharged to the circulation path through the rear blades of the rotating pulsator to obtain water power. However, it is difficult to obtain enough power to collect lint.

That is, when a pulsator of a large diameter is installed on the bottom of the holeless rotating tub, the space below the pulsator is in a closed state. Therefore, although the rear blades are installed in the other side of the pulsator to move water outward in the diameter direction when the pulsator rotates, the amount of water entering the other side of the pulsator is insufficient due to negative pressure, so that water is not sufficiently discharged.

In another typical washing machine (prior art 4), a plurality of water-passage holes are formed around the center of the rotating blades, and water enters below the pulsator by negative pressure. However, it was proven from examination results by the inventors of the present disclosure that there is a need for improvement.

That is, it was found that when water is discharged by the rear blades of the pulsator in the holeless rotating tub, stable and strong circulation capability cannot be obtained if the total opening area of the water-passage holes is excessively small or large.

(Sixth Problem)

When the rotating tub is holeless, water is little collected in the space (between the rotating tub and the water collecting tub) outside the rotating tub since overflowing water is drained as it is. Therefore, dirt may be accumulated or mold may be formed in the space so that the space becomes an unsanitary condition.

A method of putting a large amount of water into the rotating tub and the water collecting tub and performing immersion cleaning can be considered. However, this method requires a large amount of water, and has a disadvantage in view of water saving. Also, a method of putting water outside the rotating tub and then performing immersion cleaning can be considered. However, this method requires complicated operations in which a user stops supplying water to prevent water from being drained, puts a cleaning agent or the like into the gap between the rotating tub and the water collecting tub, inserts a hose or the like into the gap, and then supplies water. Therefore, this method is also not realistic.

Removing mold, etc. with an agent requires sufficient rinsing for washing off the remaining agent, and accordingly, a large amount of water needs to be used. Also, since an agent needs to be added whenever cleaning is carried out, maintenance cost is high. Compared to this, sterilization through hot water has a good sterilization effect depending on temperature, requires no rinsing, and also has an advantage in view of water saving. Hot water can also effectively remove dirt.

However, heating a large amount of water using a heating device such as a heater is not realistic. For example, when a general washing machine heats water (20° C.) of 100 L to 70° C. capable of removing mold, etc. within one hour, power of about 5800 W for heating water, power of about 200 W for heating the rotating tub, and power of about 1000 W consumed by heat dissipation are needed so that a total of consumption power becomes about 7000 W.

The upper limit of home power supply is 1500 W in consideration of a breaker. Although 1200 W is used for heating, about 6 hours will be consumed for heating. Therefore, heating a large amount of water for sterilization is not realistic.

Also, a method of heating water at room temperature when supplying it to supply hot water can be considered. However, it is impossible to heat a large amount of water required for washing with insufficient power of 1200 W.

Therefore, the technical object of the present disclosure is to overcome the above-described problems, and to provide a top load washing machine having excellent functions while saving water.

Additional aspects of the disclosure will be set forth in part in the description which follows and, in part, will be obvious from the description, or may be learned by practice of the disclosure.

The present disclosure relates to a top load washing machine including a holeless rotating tub. Hereinafter, the present disclosure will be described in detail in regard of the first to sixth problems described above.

(First Technique for First Problem)

A washing machine according to a first technique may include a housing having a drain path installed in the lower space, a water collecting tub supported on the housing in the inside of the housing, and a rotating tub into which laundry is put and which rotates on a shaft extending vertically in the inside of the water collecting tub. The rotating tub may include a body member that can store water independently from the water collecting tub, and an outlet opening at the bottom of the body member.

The water collecting tub may include a first drain hole formed at the bottom and opening to the inside, and a second drain hole formed at the bottom and communicating with the outlet through a partitioned water guide path.

The drain path may include a first path connected to the first drain hole, and a second path connected to the second drain hole.

According to the washing machine, since the rotating tub or the water collecting tub has an independent drain path, it may be possible to efficiently perform water storage or drainage of the rotating tub and the water collecting tub.

The water collecting tub may further include a third drain hole formed at the upper side, and the drain path may further include a third path connected to the third drain hole.

Thereby, since water is drained through the third path from the third drain hole formed at the upper side of the water collecting tub, water may be prevented from overflowing to the inside of the housing from the water collecting tub even when a water supplying error or the like occurs. Accordingly, it may be possible to prevent a trouble such as failure in the electrical system.

More specifically, the drain path may further include a fourth path to which the first path, the second path, and the third path are connected to drain water to the outside of the housing. A stop valve for stopping water with a float for changing a flow of water may be installed on the first path, and on the fourth path, a drain valve may be installed downstream from the junction of the first path and the second path.

Thereby, it may be possible to efficiently perform water storage or drainage of the rotating tub and the water collecting tub with a simple structure. Also, it may be possible to simplify an electrical control, thereby reducing member cost or running cost.

The stop valve may include two upper and lower restricting members for restricting the movement of the float, and at least any one of the float and the restricting members may be formed of a soft member having elasticity.

Therefore, since the float elastically contacts the upper and lower restricting members although the water collecting tub shakes, it may be possible to prevent noise from being generated due to the stop valve.

The upper restricting member may be formed in the shape of a flange protruding toward the inside of the flow path, and when the float floats, the float may closely contact the upper restricting member to close the flow path. The lower restricting member may have a convex structure protruding toward the inside of the flow path, and when the float drops down, the lower restricting member may support the float while opening the flow path.

Thereby, it may be possible to realize a functional stop valve with a simple configuration.

A part of the first path may be configured with a flexible hose, and the hose may be integrated into the upper restricting member.

Accordingly, the float may more closely contact the upper restricting member to stably stop water. Also, since the hose can be removably connected, the hose may be easily replaced with a new one when any problem occurs. Also, when the hose is clogged with foreign materials, a user can clean the hose by pressing it hard.

The drain path may further include a fourth path to which the first path, the second path, and the third path are connected to drain water to the outside of the housing, wherein opening and shutting valves may be respectively installed on the first path and the second path.

In this case, by preventing any trouble, function drainage is possible.

(Second Technique for Second Problem)

A washing machine according to a second technique may include a housing having a drain path installed in the lower space, a water collecting tub supported on the housing in the inside of the housing, and a rotating tub into which laundry is put and which rotates on a shaft extending vertically in the inside of the water collecting tub. The rotating tub may include a body member that can store water independently from the water collecting tub, and an outlet opening at the bottom of the body member.

The water collecting tub may include a first drain hole formed at the bottom and opening to the inside, and a second drain hole formed at the bottom and communicating with the outlet through a partitioned water guide path.

The drain path may include a first path connected to the first drain hole, a second path connected to the second drain hole, and a third path connected to the first path and the second path to drain water to the outside of the housing. Also, on the third path, a drain pump may be installed downstream from the junction of the first path and the second path.

That is, according to the washing machine, since the rotating tub or the water collecting tub has the first path and the second path independently, it may be possible to efficiently perform water storage or drainage of the rotating tub and the water collecting tub. Also, since the third path having the drain pump is connected downstream from the junction of the paths, it may be possible to forcedly drain water to the outside of the housing through the third path. Accordingly, since the drain pump and the drain paths are not in series, functional drainage may be possible although an opening and shutting valve is installed on the paths. Also, there is no probability that an excessive load is applied to the drain pump unless both the paths are closed. Therefore, it may be possible to appropriately maintain the function of the drain pump.

Particularly, a stop valve for stopping water with a float for changing a flow of water may be installed on the first path.

Thereby, it may be possible to efficiently perform water storage or drainage of the rotating tub and the water collecting tub with a simple structure. Also, it may be possible to simplify an electrical control, thereby reducing member cost or running cost.

The stop valve may include two upper and lower restricting members for restricting the movement of the float, and at least any one of the float and the restricting members may be formed of a soft member having elasticity.

Therefore, since the float elastically contacts the upper and lower restricting members although the water collecting tub shakes, it may be possible to prevent noise from being generated due to the stop valve.

The lower restricting member may have a convex structure protruding toward the inside of the flow path, and when the float drops down, the lower restricting member may support the float while opening the flow path.

Thereby, it may be possible to realize a functional stop valve with a simple configuration.

A part of the first path may be configured with a flexible hose, and the hose may be integrated into the restricting member.

Accordingly, the float may more closely contact the upper restricting member to stably stop water. Also, since the hose can be removably connected, the hose may be easily replaced with a new one when any problem occurs. Also, when the hose is clogged with foreign materials, a user can clean the hose by pressing it hard.

Also, the first path and the second path may be connected to the third path through a switch valve, and the switch valve may be switched to a first switching position at which the first path communicates with the third path, a second switching position at which the second path communicates with the third path, and a third switching position at which the first path communicates with the second path.

Furthermore, a first opening and shutting valve may be installed on the first path, a second opening and shutting valve may be installed on the second path, and the first opening and shutting valve and the second opening and shutting valve may be opened and closed by interworking with the drain pump.

In this case, it may be possible to prevent the generation of a trouble in the drain pump, while performing functional water storage or drainage.

(Third Technique for Third Problem)

A washing machine according to a third technique may include a housing having a drain path installed in the lower space, a water collecting tub supported on the housing in the inside of the housing, a rotating tub into which laundry is put and which rotates on a shaft extending vertically in the inside of the water collecting tub by driving of a driver, a circulation path for circulating water collected in the rotating tub, a heater for heating water collected in the rotating tub, and a controller for controlling rotations of the rotating tub and heating of the heater.

The rotating tub may include a body member whose upper portion opens and which can store water independently from the water collecting tub, and an outlet opening at the bottom of the body member. The water collecting tub may include a water guide path partitioned in the bottom of the water collecting tub and communicating with the outlet, while communicating with both the drain path and the circulation path. Also, the cross-section of the water guide path may spread along the bottom of the water collecting tub, and the heater may spread in the inside of the water guide path.

Since the washing machine includes a holeless rotating tub, the washing machine may save water consumption efficiently. Also, since the washing machine includes the circulation path for heating water collected in the rotating tub and circulating it to heat washing water or rinsing water, the washing machine may have excellent washing performance and rinsing performance. Also, at the bottom of the water collecting tub, the water guide path may be formed to communicate with both the drain path and the circulation path, and the cross-section of the water guide path may spread thinly along the bottom of the water collecting tub. By forming the water guide path using the wide bottom of the water collecting tub 20, a wide, thin cross-section of a flow can be obtained. Since there is no space waste, it may be possible to increase the capacity of the water collecting tub or the rotating tub with respect to the housing, and to achieve a compact size.

Also, since the heater spreads widely in the inside of the water guide path, circulating water may be efficiently heated in the small space. That is, it may be possible to heat a small amount of water to high temperature in a short time.

More specifically, the water guide path may be partitioned on the bottom of the water collecting tub by a wide-width concave portion formed concavely in the bottom of the water collecting tub and a partition plate covering the wide-width concave portion from above.

Thereby, the water guide path from which no water leaks out may be formed with a simple structure.

On the inner bottom of the body member, a water guide surface may be inclined downward toward the center from the circumference. At the lowest location of the water guide surface, the outlet may open with an opening area that is greater than or equal to the cross-section area of the water guide path.

Thereby, water collected in the rotating tub may be guided by the water guide surface to be discharged through the outlet. Accordingly, it may be possible to secure excellent drainage without remaining water.

Particularly, an insulation plate may be disposed on any one of the upper and lower surfaces of the heater.

The insulation plate may prevent, although the cross-section of the flow path is thin, the partition plate partitioning the water guide path from being heated excessively, thereby preventing the partition plate which may be made of a synthetic resin from being deformed.

Also, the circulation path may include an outlet for returning water to the inside of the body member through the opening of the body member, and the outlet may be disposed above the water collecting tub.

Thereby, the positional relation between the outlet and the opening of the body member may not change although the water collecting tub shakes. Accordingly, it may be possible to stably return circulating water to the inside of the body member.

Also, the water guide path may have a drain hole for circulation in the lower surface, and an end of the circulation path may be connected to the drain hole for circulation through a connecting member. The connecting member may seal a gap between the drain hole for circulation and the end of the circulation path, in the state in which the top end of the connecting member protrudes from the lower surface of the water guide path.

Therefore, it may be possible to seal up the connecting portion with a single connecting member, while preventing foreign materials such as buttons from entering the drain hole for circulation, thereby reducing the number of components and preventing troubles.

Driving of the driver and heating of the heater may be controlled simultaneously or alternately by the controller.

When driving of the driver and heating of the heater are controlled simultaneously, circulating water may be heated to increase heating efficiency, while raising the temperature of water uniformly. When power supply is insufficient, heating of the heater and driving of the driver may be controlled alternately for stable driving.

The washing machine may further include a water level sensor for detecting a level of water collected in the rotating tub, and outputting the detected level of water to the controller. When a level of water collected in the rotating tub is higher than or equal to a predetermined lower limit value, the controller may heat the heater.

Thereby, it may be possible to prevent empty heating of the heater.

A circulation pump may be installed on the circulation path, and the circulation pump may be controlled by the controller. The controller may include an interworking control circuit for controlling driving of the circulation pump and heating of the heater, and the interworking control circuit may be configured to interwork heating of the heater with driving of the circulation pump.

Therefore, it may be possible to prevent empty heating of the heater without depending on the control, thereby further improving safety.

In this case, a pump operation check mechanism may be further installed to detect an operation state of the circulation pump and output the detected operation state to the controller.

Therefore, it may be possible to prevent empty heating of the heater caused by a failure of the circulation pump, thereby further more improving safety.

Also, a water temperature sensor for measuring the temperature of water collected in the rotating tub and outputting the measured temperature to the controller may be installed, and when the temperature of water reaches a predetermined setting value or more, the controller may drive the circulation pump.

In this case, since the circulation pump is driven intermittently, power consumption may be suppressed. Also, excessive heating may be suppressed.

(Fourth Technique for Fourth Problem)

A washing machine according to a fourth technique may include a housing, a water collecting tub elastically supported on the housing in the inside of the housing, a rotating tub into which laundry is put and which rotates on a shaft extending vertically in the inside of the water collecting tub, and a circulation path for sprinkling water collected in the rotating tub from an outlet to return the water to the inside of the rotating tub.

The rotating tub may include a body member whose upper portion opens and which can store water independently from the water collecting tub, a balancer formed in the shape of a ring along the inner surface of the body member around the opening of the body member, and an overflow path communicating with the upper outside of the body member from the lower space of the balancer. Also, a stop rib formed in the shape of a cylinder may protrude upward on the balancer, and the outlet may be disposed above the water collecting tub, and protrude inward in the diameter direction rather than the stop rib to open toward the inside of the rotating tub.

That is, since the washing machine includes a holeless rotating tub, the washing machine may reduce water consumption efficiently. Also, since the washing machine includes the circulation path for sprinkling water collected in the rotating tub through the outlet to circulate the water, the washing machine may circulate a large amount of washing water or rinsing water. Therefore, the washing machine may have excellent washing performance and rinsing performance.

Since the overflow path for communicating the lower space of the balancer with the upper outside of the rotating tub is formed in the balancer installed along the inner surface of the rotation tub around the opening of the rotating tub, water rising along the inner surface of the rotating tub during dehydrating may overflow without remaining, resulting in excellent dehydrating performance.

Also, since the outlet is installed above the water collecting tub, the positional relation between the outlet and the opening of the body member may not change although the water collecting tub elastically supported on the housing shakes. Accordingly, the outlet may not deviate from its position so as to stably return water to the inside of the rotating tub. Also, since the stop rib is installed on the balancer and the outlet protrudes inward in the diameter direction rather than the stop rib to open to the inside of the rotating tub, water sprinkled from the outlet may be prevented from entering the water collecting tub even when the strength of the water is weakened to cause a liquid sag, thereby preventing a reduction of the amount of water used for washing.

Therefore, according to the washing machine, it may be possible to stably circulate water, while maintaining an appropriate amount of water, although the rotating tub is a holeless type.

The water collecting tub may have a tub cover thereon, and the tub cover may have a flange portion formed in the shape of a flange and protruding inward in the diameter direction to cover a gap between the water collecting tub and the opening of the body member. The outlet may be integrated into the flange portion.

Thereby, it may be possible to realize a functional washing machine having a smaller gap with a relatively simple conventional structure.

In this case, a cover rib formed in the shape of a cylinder and protruding upward at the inside in diameter direction from the stop rib on the balancer to cover the gap between the balancer and the flange portion may be further installed, and in the balancer, a flow path may be formed to return water entered an annular groove formed between the stop rib and the cover rib to the inside of the body member.

Thereby, laundry may be prevented from being caught by the cover rib, and water entered to the other side of the cover rib may also return to the rotating tub through the flow path.

In this case, the balancer may include an installing portion installed in the body member, and a balance adjusting portion integrated into the inner side of the installing portion, and the flow path may be formed between the installing portion and the balance adjusting portion.

Thereby, the balancer may be easily assembled with the body member, and the flow path may be easily formed without degrading the function of the balancer.

Also, when the balancer includes an annular fluid chamber accommodating a fluid therein and a plurality of flow suppressing portions protruding in the diameter direction in the fluid chamber, the flow path may be formed to penetrate the flow suppressing portions vertically.

In this case, the flow path may be formed without degrading the function of the balancer.

(Fifth Technique for Fifth Problem)

A washing machine according to a fifth technique may include a water collecting tub supported on the housing in the inside of the housing, and a rotating tub into which laundry is put and which rotates on a shaft extending vertically in the inside of the water collecting tub.

The rotating tub may include a body member that can store water independently from the water collecting tub, a pulsator which is installed in the bottom of the body member and which rotates around the shaft, and a circulation path extending along the side of the body member, communicating with an upper washing space and a lower pump space partitioned by the pulsator, and circulating water through the pulsator.

The pulsator may include a base formed in the shape of a disc, a plurality of water-passage holes penetrating the base and communicating the washing space with the pump space, and a plurality of rear blades formed in the rear surface of the base and configured to send water in the diameter direction in the pump space.

The water-passage holes may be concentrated in the center area of the base, and when the surface of the base is seen from above, a ratio of a total opening area of the water-passage holes to a total area of the base may be set within a range of 1.5% to 4.0%.

That is, since the washing machine includes a holeless rotating tub, the washing machine may reduce water consumption efficiently. Also, the inside of the rotating tub may be partitioned into the washing space and the pump space by the pulsator, and the washing space may communicate with the pump space through the circulation path. Also, since the pulsator includes the plurality of water-passage holes communicating the washing space with the pump space, and the rear blades sending water in the diameter direction in the pump space, water stored in the pump space may be pressed in the circulation path by the rear blades when the pulsator rotates in the state in which water is stored in the rotating tub, and simultaneously, water stored in the washing space may be introduced to the pump space through the water-passage holes so that water stored in the rotating tub may be circulated.

At this time, as there is a smaller gap with the rear blades in the pump space, water may be discharged more strongly. However, in this case, it may be difficult to introduce a sufficient amount of water that can be discharged strongly into the pump space. Therefore, although sufficient negative pressure is obtained, water may be insufficiently discharged due to insufficient water in the pump space.

In regard of this, by concentrating the water-passage holes in the center area of the base and setting a ratio of the total opening area of the water-passage holes to the total area (projection area) of the base within the range of 1.5% to 4.0%, water may be discharged strongly and circulate strongly and smoothly, which will be described later.

More specifically, it may be preferable that the water-passage holes of 92% or more of the total opening area are arranged in a circular area which is concentric with the base and which has a size of 80% of the diameter of the base.

In this case, it may be possible to effectively achieve a pump function in the pump space, and to realize smooth and strong circulation of water.

Specifically, the rotating tub may further include a lint filter installed on the side of the body member and facing the washing space, and the circulation path may communicate with the washing space through the lint filter.

As described above, when the rotating tub is a holeless type, there is a problem that the portion of lint mixed in water is high since an amount of water with respect to laundry is small. However, since the washing machine can obtain strong circulation capability using a small amount of water, the washing machine can collect lint efficiently.

More specifically, on the surface of the base, a boss portion located at the center, a plurality of stirring blades extending radially from the boss portion, and a planer portion which spreads between the neighboring stirring blades and whose circumferential side is nearly flat may be provided, wherein the water-passage holes may be disposed intensively in the planar portion.

Therefore, the plurality of water-passage holes may be formed uniformly to introduce water to the pump space with small resistance. Also, the water-passage holes may be easily molded. Although laundry exists, the stirring blades can receive the laundry so that the water-passage holes are prevented from being clogged. Therefore, water may be stably introduced to the pump space without any change in amount.

The circumference of the pulsator may be adjacent to the lower portion of the body member with a gap.

Therefore, water may be prevented from moving freely from around the pump space, resulting in stable and strong discharge performance.

(Sixth Technique for Sixth Problem)

A washing machine according to a sixth technique may include a water collecting tub supported on a housing in the inside of the housing, a rotating tub into which laundry is put, which rotates on a shaft extending vertically in the inside of the water collecting tub, and which can store water independently from the water collecting tub, a driver for rotating the rotating tub, a rotation sensor for detecting the RPM of the rotating tub, a water level sensor for detecting a level of water collected in the rotating tub, and a controller for controlling the driver based on signals received from the rotation sensor and the water level sensor.

Also, the controller may include a washing executing portion for washing laundry put into the rotating tub, and a tub cleaning executing portion for causing washing water filled to a predetermined water level in the rotating tub to overflow by rotating the rotating tub while controlling the RPM, thereby cleaning a space (also, referred to as an outer space) between the rotating tub and the water collecting tub.

That is, the sixth technique may be applied to a top load washing machine including a so-called holeless rotating tub which is advantageous in view of water saving. The controller may include the washing executing portion for executing a washing process, such as washing or dehydrating, and the tub cleaning executing portion for cleaning the outer space. The tub cleaning executing portion may store washing water to a predetermined water level for cleaning in the rotating tub, wherein the predetermined water level for cleaning may be set to a low level, and accordingly, a relatively small amount of washing water may be used. Then, the tub cleaning executing portion may cause the washing water to overflow by rotating the rotating tub while controlling the RPM. The tub cleaning executing portion may spray the small amount of washing water uniformly, in the form of a shower, toward the outside of the rotating tub from above the rotating tub using a centrifugal force generated by the rotation of the rotating tub (shower cleaning). Accordingly, the outside of the rotating tub, that is, the entire outer space having difficulties in being cleaned may be cleaned efficiently with a small amount of washing water.

When the water collecting tub is shakably supported on the housing, there may be further provided a vibration sensor for detecting vibrations of the water collecting tub, and the tub cleaning executing portion may increase the RPM of the rotating tub in stages or continuously, while adjusting the rotation acceleration of the rotating tub, based on a signal received from the vibration sensor, to cause washing water to overflow.

When the water collecting tub in which washing water is collected shakes heavily according to the rotation of the rotating tub, noise or vibrations, more seriously, abnormal vibrations which may pull down the washing machine may be generated. Therefore, the tub cleaning executing portion may increase the RPM of the rotating tub in stages or continuously, while adjusting the RPM of the rotating tub, based on a signal of vibrations received from the vibration sensor, to cause washing water to overflow, thereby preventing the generation of such a trouble during tub cleaning.

Also, there may be provided a heater for heating washing water collected in the rotating tub, and a sensor for detecting temperature of the washing water collected in the rotating tub and temperature around the water collecting tub. Predetermined sterilization temperature that is used as reference temperature for sterilization may have been set in advance by the controller, and the tub cleaning executing portion may compensate the sterilization temperature to higher temperature based on a signal received from the sensor, and heat the washing water to the compensated temperature.

In this way, by heating and sterilizing the outer space to destroy mold or bacteria, the outer space may be cleaned to a microbiologically clean state. In the case of shower cleaning, the temperature of washing water may be easily lowered. However, the tub cleaning executing portion may compensate sterilization temperature to higher temperature, and heat washing water to perform proper sterilization, thereby obtaining a stable sterilization effect regardless of external factors such as surrounding temperature.

The sixth technique relates to a tub cleaning method. The tub cleaning method may be a tub cleaning method of a top load washing machine in which a rotating tub into which laundry is put can store water in the inside of a water collecting tub independently from the water collecting tub and can rotate on a shaft extending vertically. The tub cleaning method may include a preparing step of collecting washing water to a predetermined cleaning water level in the rotating tub, and a cleaning step of causing the washing water to overflow while increasing the RPM of the rotating tub to thereby clean the inside of the water collecting tub.

According to the tub cleaning method, the same effect as in the washing machine described above may be obtained.

More specifically, the cleaning step may include a first cleaning step of raising the RPM of the rotating tub to first RPM in stages or continuously to cause washing water to overflow, an intermediate standby step of maintaining the RPM of the rotating tub at the first RPM for a predetermined time period, and a second cleaning step of raising the RPM of the rotating tub in stages or continuously from the first RPM to second RPM to cause washing water to overflow.

The first cleaning step may be shower cleaning for raising the RPM of the rotating tub to the first RPM from zero to cause washing water to overflow. Since the RPM of the rotating tub is low, most of the overflowing washing water may be sprayed toward the lower part of the outer space. That is, the first cleaning step may effectively clean the lower part of the outer space. In the intermediate standby step, the RPM of the rotating tub may be maintained so that the overflow state, the rotation state of the rotating tub, or the shaking state of the water collecting tub may be stable.

Also, in the second cleaning step, shower cleaning of raising the RPM of the rotating tub to the second RPM that is higher than the first RPM to cause washing water to overflow may be performed, and most of the overflowing washing water may be sprayed toward the upper part of the outer space. That is, the second cleaning step may effectively clean the upper part of the outer space. Accordingly, the entire upper and lower parts of the outer space may be effectively cleaned.

Particularly, when the amplitude of the water collecting tub exceeds a predetermined allowable value during the cleaning step, an acceleration control process of stopping accelerating the rotation of the rotating tub may be performed until the amplitude of the water collecting tub becomes smaller than or equal to the allowable value.

Therefore, shaking of the water collecting tub may be suppressed before the water collecting tub shakes heavily, and accordingly, noise or vibrations, more seriously, abnormal vibrations which may pull down the washing machine may be prevented from occurring.

Also, in the preparing step, a heating process of heating the washing water to predetermined temperature may be performed.

In this way, by heating and sterilizing the outer space, the outer space may be cleaned to a microbiologically clean state.

In this case, during the heating process, a process of compensating the temperature to higher temperature based on the temperature of outside air around the water collecting tub may be performed.

In the case of shower cleaning, the temperature of washing water may be easily lowered. However, by compensating sterilization temperature to higher temperature based on the temperature of outside air around the water collecting tub, sterilization may be performed properly, thereby obtaining a stable sterilization effect.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
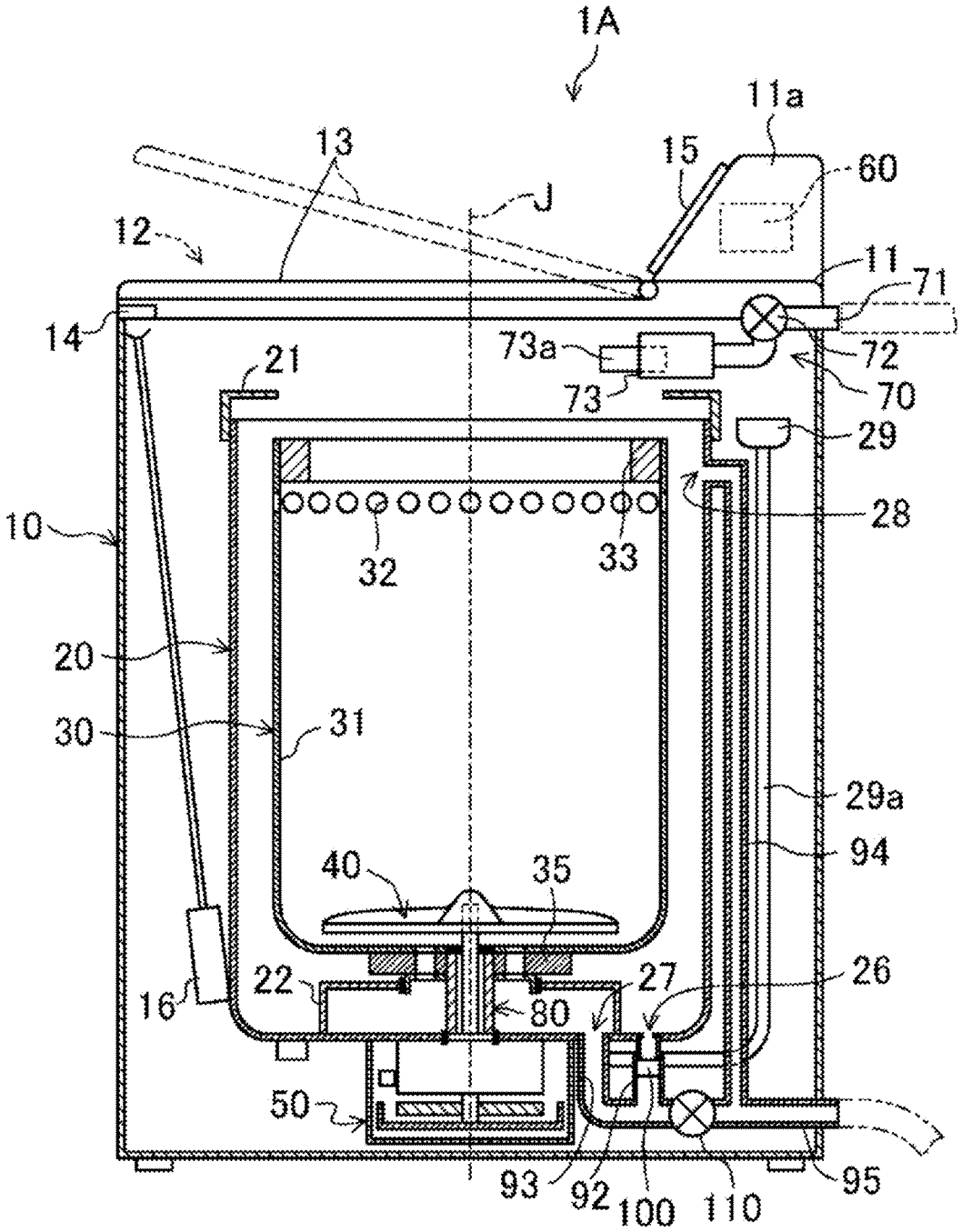
FIG. 1 schematically shows a washing machine according to a first embodiment, wherein main components inside a housing are shown.
Figure 66:
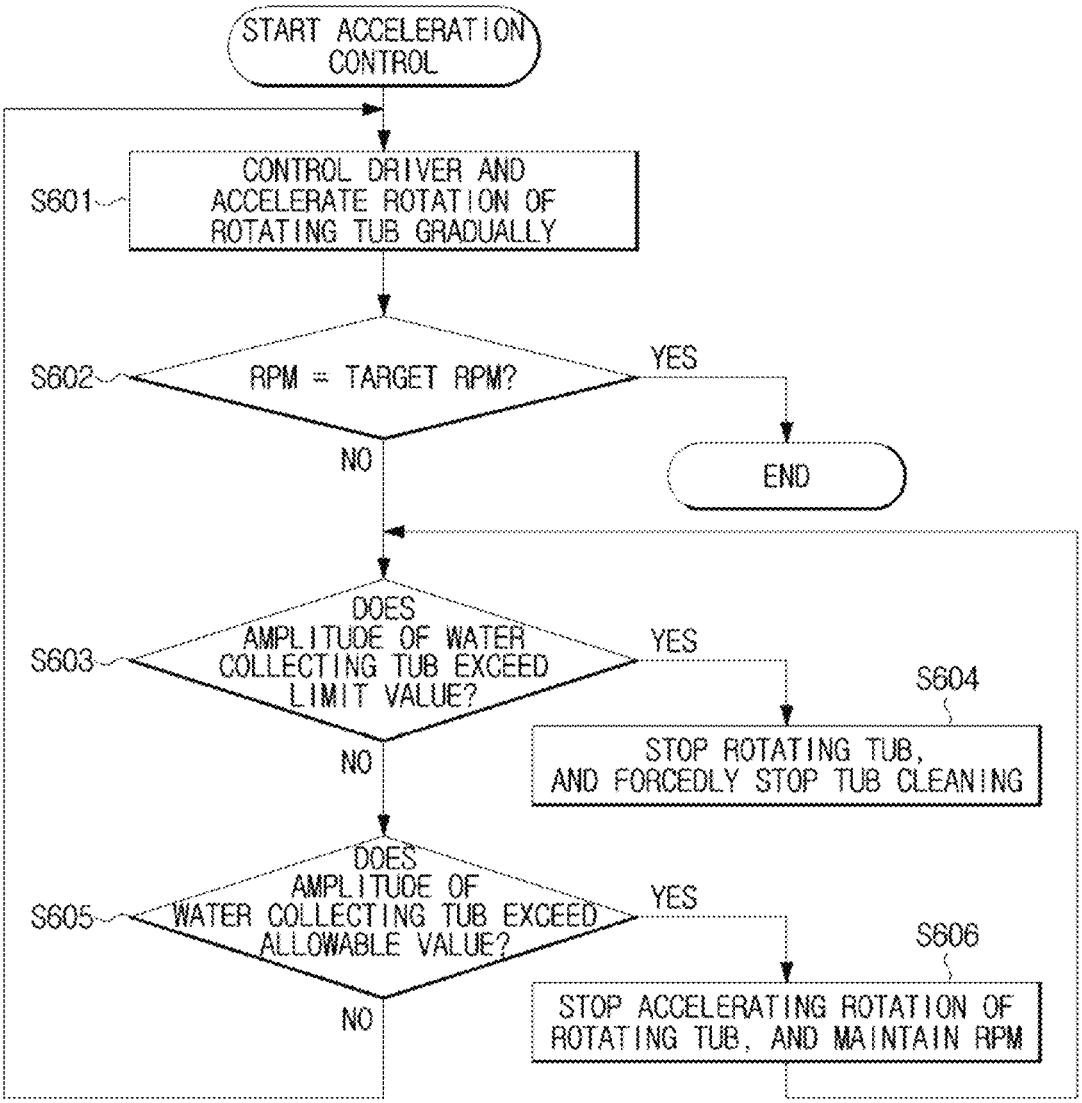
FIG. 66 is a flowchart illustrating an acceleration control process.

FIGS. 1 through 66, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, the first to sixth techniques (the first to sixth embodiments) of the present disclosure will be described in detail with reference to the accompanying drawings. However, the following descriptions are only examples, and do not limit the present disclosure, the applications of the present disclosure, or the use purposes of the present disclosure. The techniques disclosed in the first to sixth embodiments are not independent from each other. That is, the technique of a certain embodiment may be combined with the technique of another embodiment, or a part of the technique of a certain embodiment may be omitted.

<First Embodiment>

In FIG. 1, a washing machine 1A to which the first technique is applied is shown. The washing machine 1A may be a type having no drain pump, in which water is drained by natural drainage in which water flows downward. The washing machine 1A may include a housing 10, a water collecting tub 20, a rotating tub 30, a pulsator 40, and a driver 50.

The housing 10 may be in the shape of a rectangular box standing vertically, and manufactured by combining panels and resin members. A top cover 11 may be attached to a top of the housing 10, and an inlet 12 may be formed in a front portion of the top cover 11 to allow a user to put/take laundry into/out of the inside of the washing machine 1A. A cover 13 may be rotatably connected to a rear edge of the inlet 12 of the top cover 11 to open and close the inlet 12. In a front edge of the inlet 12 on the top cover 11, a lock member 14 may be installed to lock the cover 12 closing the inlet 12 when the washing machine 1A operates.

On the top cover 11, a protrusion portion 11*a* protruding upward may be formed behind the inlet 12. In a front surface of the protrusion portion 11*a,* a control panel 15 on which a switch, a touch panel, a monitor, etc. to be manipulated by a user are arranged may be mounted, and in the inside of the protrusion portion 11*a,* a controller 60 may be installed to control operations of components of the washing machine 1A according to the user's instruction input through the control panel 15.

Figure 2:
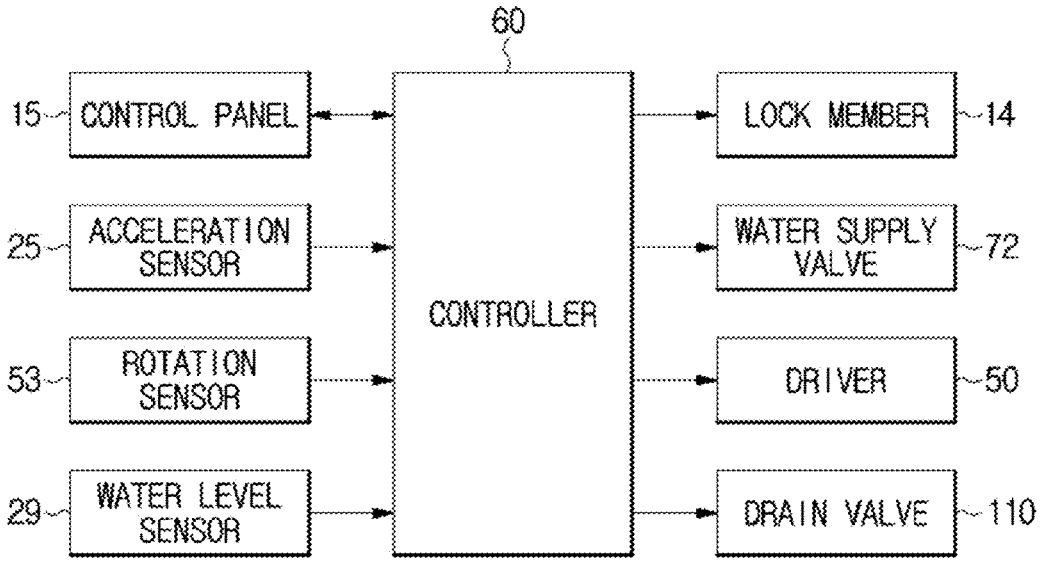
FIG. 2 is a block diagram of a controller and main input/output devices.

The controller 60 may be composed of hardware, such as a processor, memory, an input/output device, etc., and software such as control programs, etc. installed in the hardware. The controller 60 may control operations of the components installed in the washing machine 1A, based on input signals from various sensors installed in the washing machine 1A. In FIG. 2, a relationship between the controller 60, main input devices, and main output devices is shown.

In the controller 60, a plurality of washing courses including a washing operation, a rinsing operation, and a dehydrating operation may be set. The user may control the control panel 15 to select a washing operation, and perform a desired washing process. Specifically, in the washing machine 1A, a tub cleaning course for cleaning the inner side of the water collecting tub 20 and the outer side of the rotating tub 30 may be set.

In a rear, upper portion of the inner surface of the housing 10, a water supply 70 may be installed. The water supply 70 may include a water supply connecting pipe 71, a water supply valve 72, and a water feeding case 73. An upstream end of the water supply connecting pipe 71 may protrude to the outside of the housing 10, and may be connected to a faucet which is a water supply source through a hose, etc. In the water supply connecting pipe 71, the water supply valve 72 may be installed which is opened or closed by the controller 60. A downstream end of the water supply connecting pipe 71 may be connected to the water feeding case 73. A detergent supply case 73*a* having a tray shape may be removably accommodated in the water feeding case 73.

The water collecting tub 20 may be a large container formed in the shape of a cylinder having a bottom and storing water. On the inner upper surface of the housing 10, a plurality of suspensions 16 that can be elastically deformed may be arranged at a plurality of different locations. The water collecting tub 20 may be suspended by the suspensions 16 to be shakably supported on the inner wall of the housing 10. On a top of the water collecting tub 20, a tub cover 21 formed in the shape of a flange and protruding inward may be disposed. The water feeding case 73 may cross the tub cover 21 above the tub cover 21 to protrude toward the opening of the rotating tub 30, and be disposed above the opening, in order to supply water to the inside of the rotating tub 30.

The rotating tub 30 may be accommodated in the inside of the water collecting tub 20. The rotating tub 30 may be concentric with the water collecting tub 20, and may be rotatable on a vertical axis J extending vertically. That is, the washing machine 1A may be a top load washing machine.

The rotating tub 30 may include a body member 31 which is formed in the shape of a cylinder having a bottom and which can store water independently from the water collecting tub 20. That is, in order for water to be collected only in the rotating tub 30, no hole may be formed at the lower and middle parts of the side wall of the body member 31, and a plurality of dehydrating holes 3 may be formed at the upper end part of the body member 31 throughout the entire circumference (holeless). However, the plurality of dehydrating holes 32 may be not necessary since water has only to flow over the body member 31. The body member 31 may be made of stainless steel, etc.

Laundry may be put into the rotating tub 30 through the inlet 12, and a washing process consisting of a series of operations of washing, rinsing, and dehydrating may be carried out after the laundry is accommodated in the rotating tub 30. A balancer 33 formed in the shape of a ring may be disposed along the upper edge of the body member 31.

Figure 3:
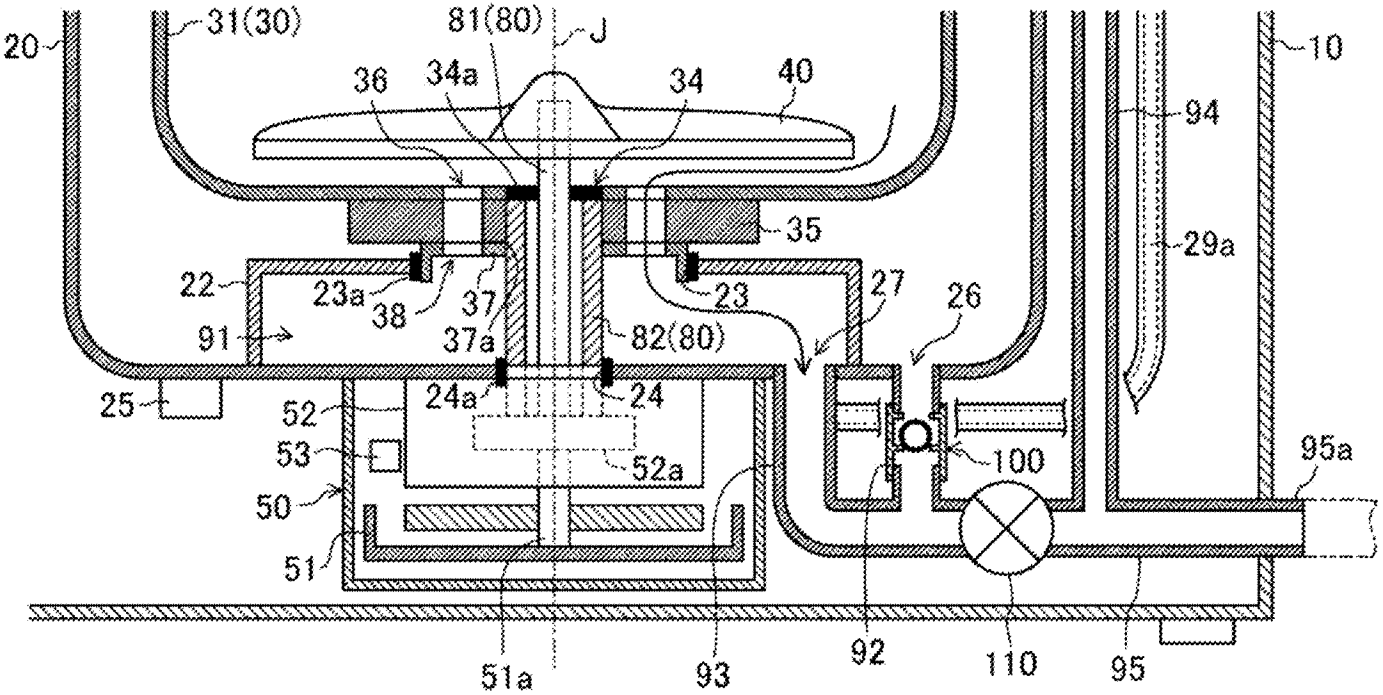
FIG. 3 schematically shows a lower structure of a washing machine, specifically, a drain path.

As shown in FIG. 3, a shaft hole 34 may be formed in the center of the bottom of the body member 31. A first shaft 81 extending along the vertical axis J may protrude to the inside of the body member 31 through the shaft hole 34. A space between the shaft hole 34 and the first shaft 81 may be sealed up by a sealing structure 34*a* (oil seal). The pulsator 40 may be fixed at a protruding end of the first shaft 81. The pulsator 40 may be a disc-shaped member having a stirring function, and on the upper surface of the pulsator 40, a plurality of blades may protrude in a radial shape in such a way to extend toward the circumference from the center.

The bottom of the body member 31 may be fixed at a protruding end of a second shaft 82 that is concentric with the first shaft 81. The first shaft 81 and the second shaft 82 may be integrated into a shaft unit 80, and be rotatable independently.

On the other surface (outer surface) of the bottom of the body member 31, a flange shaft 35 may be disposed. The flange shaft 35 may reinforce the strength of the bottom of the rotating tub 30. The flange shaft 35 may include an outlet 36 that opens around the shaft hole 34 of the bottom of the body member 31.

Below the flange shaft 35, a sealing ring 37 may be disposed, and a shaft hole 37*a* may be formed to penetrate the flange shaft 35 and the sealing ring 37. The shaft unit 80 may extend vertically through the shaft hole 37*a,* and the flange shaft 35 and the sealing ring 37 may be fixed at the body member 31 to pass the second shaft 82 through. In the flange shaft 35 and the sealing ring 37, a through hole 38 may be formed around the shaft hole 37*a*.

On the surface (inner surface) of the bottom of the water collecting tub 20, a sealing holder 22 may be installed to cover the inner surface. By the sealing holder 22, the inside space of the bottom of the water collecting tub 20 may be partitioned, and a water guide path 91 may be formed in the inside space of the bottom. The water guide path 91 may communicate with the through hole 38. In the upper center portion of the sealing holder 22, a sealing opening 23 may be formed to receive the sealing ring 37 in a state of being rotatable. An oil seal 23*a* may be disposed between the sealing ring 37 and the sealing opening 23 to seal up a space between the sealing ring 37 and the sealing opening 23.

In the center of the bottom of the water collecting tub 20, a shaft hole 24 may be formed to penetrate the bottom of the water collecting tub 20. The shaft unit 80 may rotatably protrude to the outside of the water collecting tub 20 through the water guide path 91 and the shaft hole 24. An oil seal 24*a* may be disposed between the shaft hole 24 and the shaft unit 80 to seal up a space between the shaft hole 24 and the shaft unit 80.

On the other surface of the bottom of the water collecting tub 20, the driver 50 may be installed. Also, on the other surface of the bottom of the water collecting tub 20, an acceleration sensor 25 may be installed to detect an amount of shaking of the water collecting tub 20 and output the detected amount of shaking to the controller 60. The driver 50 may include a motor 51 and a switch 52, and be controlled by the controller 60. In the driver 50, a rotation sensor 53 (generally, the rotation sensor 53 may be installed in the motor 51) may be installed to detect the RPM of the motor 51 and output the detected RPM to the controller 60.

The shaft unit 80 protruding from the bottom of the water collecting tub 20 may be connected to an output shaft 51*a* of the motor 51 through the switch 52. The switch 52 may include a clutch 52*a*, and the controller 60 may control the clutch 52*a* to perform switching between a first connection state in which both the first shaft 81 and the second shaft 82 are connected to the output shaft 51*a* and a second connection state in which only the first shaft 81 is connected to the output shaft 51*a*.

Accordingly, during the dehydrating operation among the washing operations, the first connection state may be set to rotate the rotating tub 30 and the pulsator 40 together. Also, during the washing operation or the rinsing operation, the second connection state may be set to rotate the pulsator 40 forward and backward without rotating the rotating tub 30.

(Drain Path)

In the bottom of the water collecting tub 20, a first drain hole 26 and a second drain hole 27 may be formed, wherein the first drain hole 26 opens to the inside space of the water collecting tub 20, and the second drain hole 2 opens to the water guide path 91. Also, in the upper side portion of the water collecting tub 20, a third drain hole 28 may be formed. The second drain hole 27 may communicate with the outlet 36 via the water guide path 91 and the through hole 38.

Also, the first drain hole 26 may be connected to an upper end of a pipe (a first path 92) extending downward from the bottom of the water collecting tub 20. The second drain hole 27 may be connected to an upper end of a pipe (a second path 93) disposed in parallel to the first path 92 and extending downward from the bottom of the water collecting tub 20. On the second path 93, a water level sensor 29 may be installed through a vent pipe 29*a*.

The vent pipe 29*a* may be connected to the water guide path 91, instead of the second path 93. The water level sensor 29 may detect a level of water collected in the rotating tub 30, based on a change in atmospheric pressure in the vent pipe 29*a*, and output the result of the detection to the controller 60. In the current embodiment, an example in which water is introduced into the lower portion of the vent pipe 29*a* is shown, however, an air trap may be installed in the lower portion of the vent pipe 29*a* to prevent water from entering the vent pipe 29*a*. The third drain hole 28 may be connected to an upper end of a pipe (a third path 94) extending downward along the side of the water collecting tub 20.

In the lower portion of the housing 10, a pipe (a fourth path 95) extending along the bottom of the housing 10 inside the housing 10 may be installed, wherein an end (a hose connecting port) of the fourth path 95 may protrude to the outside from the rear surface of the housing 10. A drain hose may be connected to a hose connecting port 95*a*, and water may be drained through the drain hose (drainage in which water flows downward). Also, an upstream side of the fourth path 95 may be connected to the lower ends of the first to third paths 92, 93, and 94. More specifically, the second path 93, the first path 92, and the third path 94 may be connected in this order from upstream to the fourth path 95.

Accordingly, water collected in the rotating tub 30 may be drained from the outlet 36 through the water guide path 91, the second path 93, and the fourth path 95. Also, water collected in the water collecting tub 20 may be drained from the first drain hole 26 through the first path 92 and the fourth path 95. Water exceeding the upper limit of storage of the water collecting tub 20 may be drained from the third drain hole 28 through the third path 94 and the fourth path 95.

Accordingly, water collected in the rotating tub 30 or the water collecting tub 20 may be stably drained without overflowing from the water collecting tub 20.

(Stop Structure)

The washing machine 1A may include a stop structure composed of a stop valve 100 and a drain valve 110 on the drain path in order to stably collect water in the rotating tub 30 with a simple structure. The stop valve 100 may be installed on the first path 92, and the drain valve 110 may be installed downstream from the junction of the first path 92 and the second path 93 on the fourth path 95. The stop valve 100 may be a float type opening and shutting valve that operates nonelectrically according to a drain state, and the drain valve 110 may be a bellows type opening and shutting valve that is controlled by the controller 60 and operates electrically.

Figure 4A:
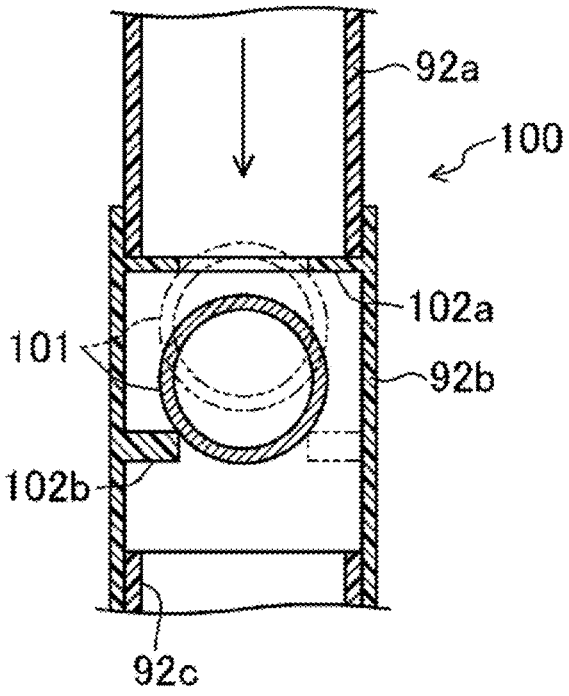
FIG. 4A is a schematic cross-sectional view showing a structure of a stop valve.
Figure 4B:
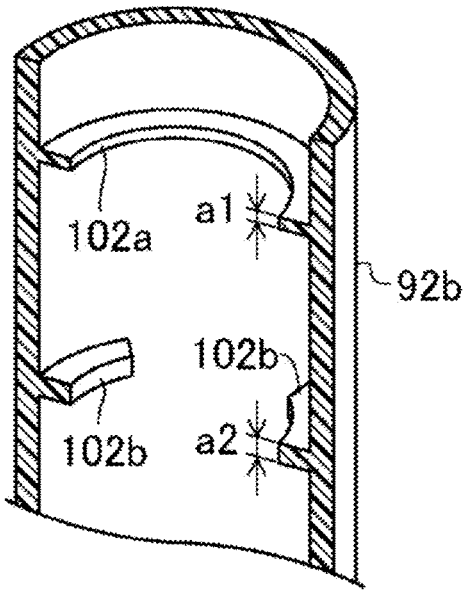
FIG. 4B is a schematic perspective view showing restricting members of a stop valve.

In FIGS. 4A and 4B, the stop valve 100 is shown. The first path 92 may include a hard upper joint 92*a*, a flexible stop hose 92*b* (for example, made of a soft material), and a hard lower joint 92*c*.

The upper joint 92*a* may be integrated into the bottom of the water collecting tub 20 and may be in the shape of a cylinder. The lower joint 92*c* may be integrated into the fourth path 95 and may be in the shape of a cylinder. The upper joint 92*a* may be vertically opposite to the lower joint 92*c*. By inserting the upper joint 92*a* and the lower joint 92*c* into the upper and lower openings of the stop hose 92*c*, the stop hose 92*b* may extend vertically to be connected to the upper joint 92*a* and the lower joint 92*c*.

The stop hose 92*b* may constitute the stop valve 100, and include a float 101 and a pair of upper and lower restricting members 102*a* and 102*b* therein. The float 101 may be a plastic member formed in the shape of a hollow sphere, and may be configured to obtain sufficient buoyance. However, the float 101 may be made of any other material or structure as long as it can obtain sufficient buoyance. The float 101 may have an external diameter that is smaller than an internal diameter of the stop hose 92*b* so as to move freely in an inside flow path of the stop hose 92*b*. Also, the stop hose 92*b* may be bent appropriately according to specifications as long as a space in which the float 101 can move vertically can be secured.

The upper and lower restricting members 102*a* and 102*b* may restrict the movement of the float 101. As shown in FIG. 4B, the upper restricting member 102*a* may be formed in the shape of an annular flange protruding toward the inside of the flow path, whereas the lower restricting member 102*b* may have a convex structure protruding toward the inside of the flow path and be formed at a part in the circumferential direction (a single lower restricting member 102*b* may be formed). The internal diameters of the upper and lower restricting members 102 and 102*b* may be smaller than the external diameter of the float 101. The upper and lower restricting members 102*a* and 102*b* may be integrated into the stop hose 92*b*.

The upper restricting member 102*a* may have a smaller thickness than the lower restricting member 102*b* to be easily elastically deformed (a1<a2). Accordingly, when the float 101 floats, the upper restricting member 102*a* may be elastically deformed to be in close contact with the float 101, thereby closing the flow path. When the float 101 drops down, the lower restricting member 102*b* may stably contact the float 101 to support the float 101 while opening the flow path between the float 101 and the lower restricting member 102*b*. The lower restricting member 102*b* may be shaped to prevent the float 101 from escaping from the stop hose 92*b* by an external force or water pressure.

The upper and lower restricting members 102*a* and 102*b* may perform a function of restricting an amount of insertion of the upper and lower joints 92*a* and 92*c* and preventing the upper and lower joints 92*a* and 92*c* from being released. Also, the flexible stop hose 92*b* may be interposed between the shaking water collecting tub 20 and the fixed fourth path 95 to thereby suppress the generation of vibrations or noise. Also, for the same reason, the second path 93 or the third path 94 may be connected through a flexible hose, which will be not described in detail. The float 101 may elastically contact the upper and lower restricting members 102*a* and 102*b* to thereby prevent the generation of noise due to the stop valve 100.

Figure 5:
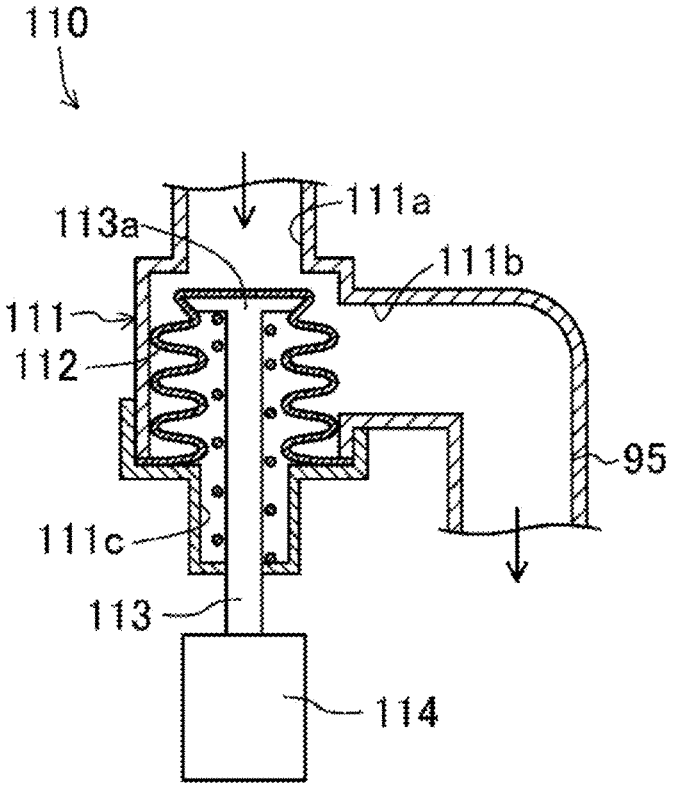
FIG. 5 is a schematic cross-sectional view showing a structure of a drain valve.

In FIG. 5, the drain valve 110 is shown. The drain valve 110 may include a valve chest 111, a bellows 112, a valve body 113, and a driving motor 114. The valve chest 111 may be interposed on the fourth path 95 to constitute a part of the flow path. The valve chest 111 may include an inlet 111*a* opening upstream from the flow path, and an outlet 111*b* opening downstream from the flow path. In the valve chest 111, a valve hole 111*a* may be formed to be opposite to the inlet 111*a*.

Through the valve hole 111*c*, the valve body 113 having a valve 113*a* at the top end may slide toward the inlet 111*a*. The bellows 112 may be installed in the valve chest 111 to close the valve hole 111*c*. The valve body 113 may slide together with the bellows 112 when the driving motor 114 operates to move between a closing position for closing the inlet 111*a* and an opening position for opening the inlet 111*a*. The operation of the driving motor 114 may be controlled by the controller 60.

(Driving and Drainage of Washing)

Before starting washing, a user may put laundry into the rotating tub 30, and put a detergent in the detergent supply case 73*a*. When the cover 13 is closed, the cover 13 may be locked. Then, when the user manipulates the control panel 15 and selects a washing course, the controller 60 may control the water supply valve 72, the driver 50, etc. to perform a series of processes corresponding to the selected washing course. A washing operation, a rinsing operation, and a dehydrating operation constituting each washing course and drainage performed during the operations will be described in detail below.

Figure 6:
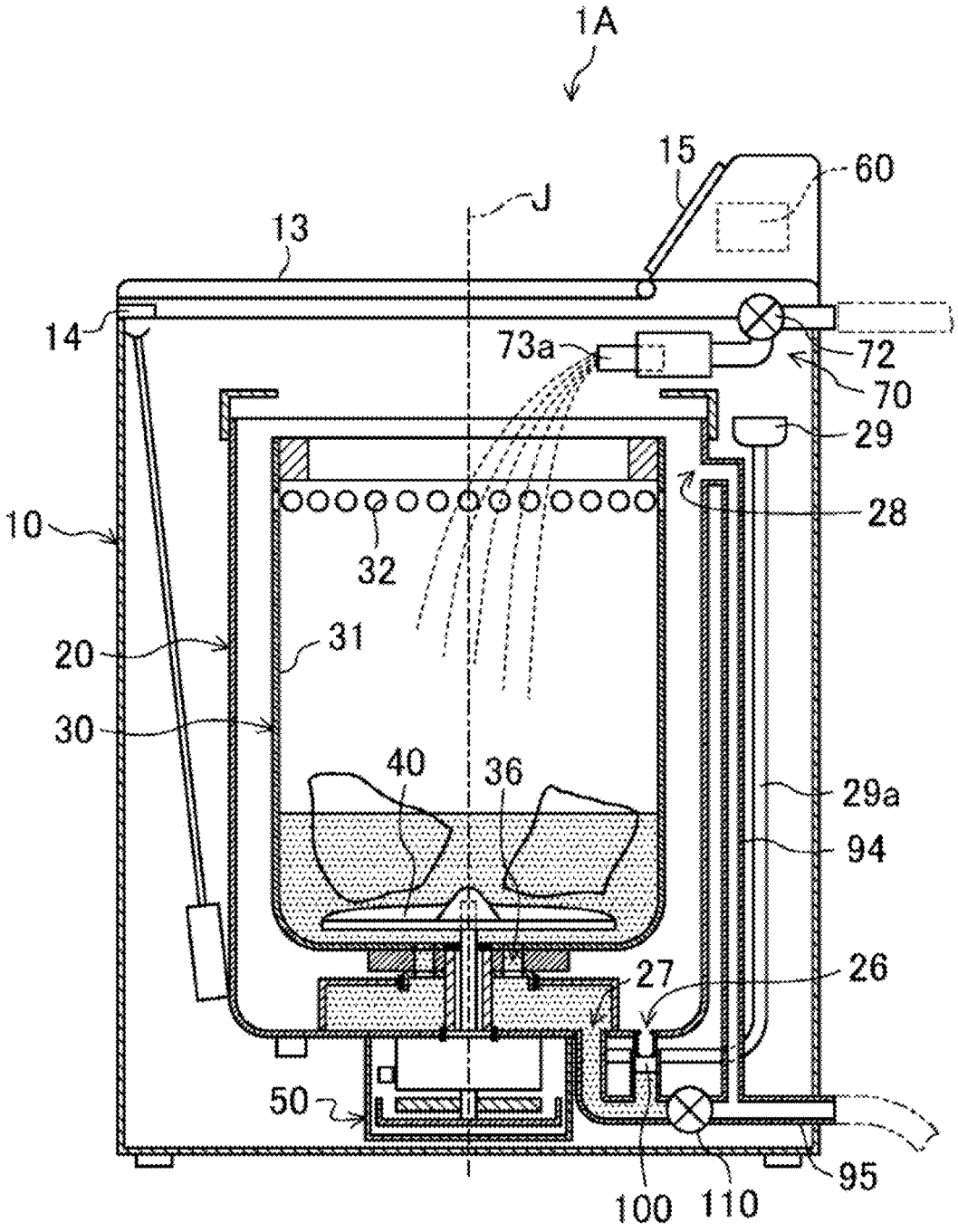
FIG. 6 is a schematic view showing a state when a washing operation is performed.

When a washing operation starts, the controller 60 may close the drain valve 110 and open the water supply valve 72. Accordingly, as shown in FIG. 6, tap water (simply, referred to as water) may enter the water supply 70 to be supplied to the rotating tub 30. At this time, the detergent may also be supplied to the rotating tub 30 together with the water. The water supplied to the rotating tub 30 may be stored gradually from the bottom of the body member 31, and thus flow downward from the outlet 36 to enter the fourth path 95 through the water guide path 91 and the second path 93.

However, since the drain valve 110 is in a closed state, no water may enter the fourth path 95. Therefore, the water may be stored gradually in the first path 92, the second path 93, and the vent pipe 29*a*. Thereby, a water level may rise, and accordingly, the float 101 in the stop valve 100 on the first path 92 may float to closely contact the upper restricting member 102*a*. Then, the flow path of the first path 92 may be closed to stop water. That is, water may be prevented from entering the inside of the water collecting tub 20.

Also, when water is supplied to the rotating tub 30, the water levels of the second path 93 (also, the water guide path 91 and the rotating tub 30) and the vent pipe 29*a*, except for the first path 92, may rise. When the water levels of the rotating tub 30 and the vent pipe 29*a* reach a predetermined water level, the controller 60 may stop supplying water based on a detection value of the water level sensor 29.

The controller 60 may control the driver 50, and switch the switch 52 to the second connection state. Then, the controller 60 may drive the motor 51 based on a detection value of the rotation sensor 53 to rotate the pulsator 40 forward and backward for a predetermined time period, without rotating the rotating tub 30. Thereby, a washing process may be performed.

When the washing process terminates, a drainage process may be performed, and the drain valve 110 may be opened by the controller 60. Accordingly, water collected in the rotating tub 30 may be drained. As the water level drops, the float 101 of the stop valve 100 may fall, and when the water level becomes lower than the lower restricting member 102*b*, the float 101 may be supported on the lower restricting member 102*b*. Accordingly, the flow path of the first path 92 may also open.

Figure 7:
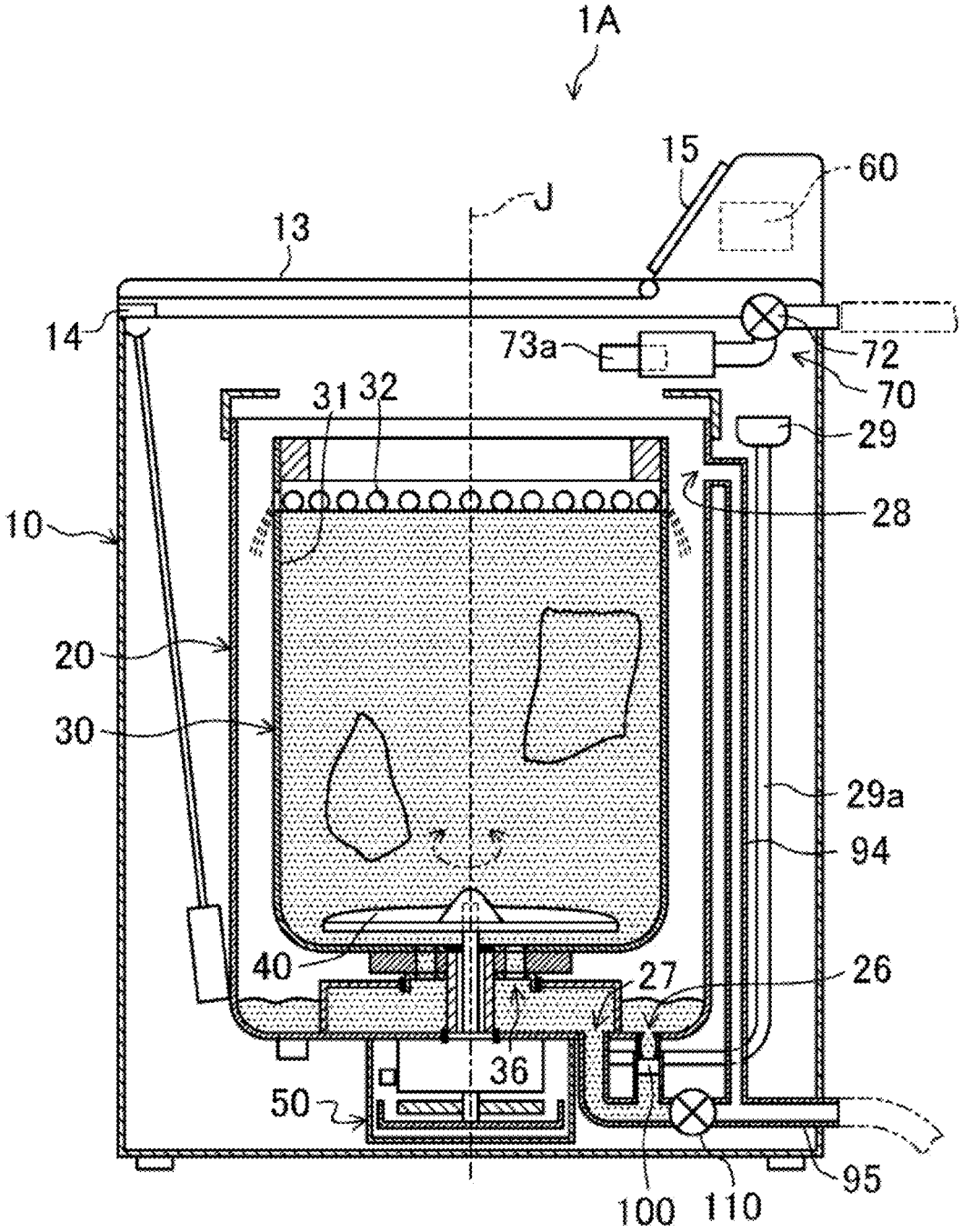
FIG. 7 is a schematic view showing a state when a rinsing operation is performed.

Successively, when a rinsing operation starts, like the washing operation, the controller 60 may close the drain valve 110 and open the water supply valve 72. Accordingly, water may enter the water supply 70 to be supplied to the rotating tub 30, so that the water is stored gradually. As shown in FIG. 7, when a predetermined amount of water is collected in the rotating tub 30. the controller 60 may control the driver 50 to rotate the pulsator 40 forward and backward.

The ringing process may be performed with an amount of water enough to be kept without overflowing. However, there may be a case in which the rinsing process is performed with an amount of water that may overflow or while water is supplied. FIG. 7 shows the case. In this case, when the level of water collected in the body member 31 rises, water may overflow through the dehydrating holes 32. Water overflowing through the dehydrating holes 32 may be stored in the water collecting tub 20 since the first path 92 is closed by the stop valve 100.

Water may be supplied within a range not exceeding the upper limit of storage of the water collecting tub 20. When an amount of water exceeding the upper limit of storage of the water collecting tub 20 is supplied due to failure of the water supply valve 72, etc., water may be drained through the third drain hole 28 and the third path 94. Accordingly, there is no probability that water leaks out of the water collecting tub 20 to cause a trouble such as failure in the electrical system.

After the rinsing process terminates, like the washing process, a drain process may be performed, and the drain valve 110 may be opened by the controller 60. Accordingly, while water is collected in the water collecting tub 20, water collected in the rotating tub 30 or the third path 94 may be drained. Then, when head pressure of water collected in the water collecting tub 20 becomes higher than pressure of water collected in the rotating tub 30 and buoyance of the float 101, the float 101 may drop down and the first path 92 may be opened so that the water stored in the water collecting tub 20 starts being drained. Accordingly, water stored in the rotating tub 30 and the water collecting tub 20 may be drained sequentially.

Figure 8:
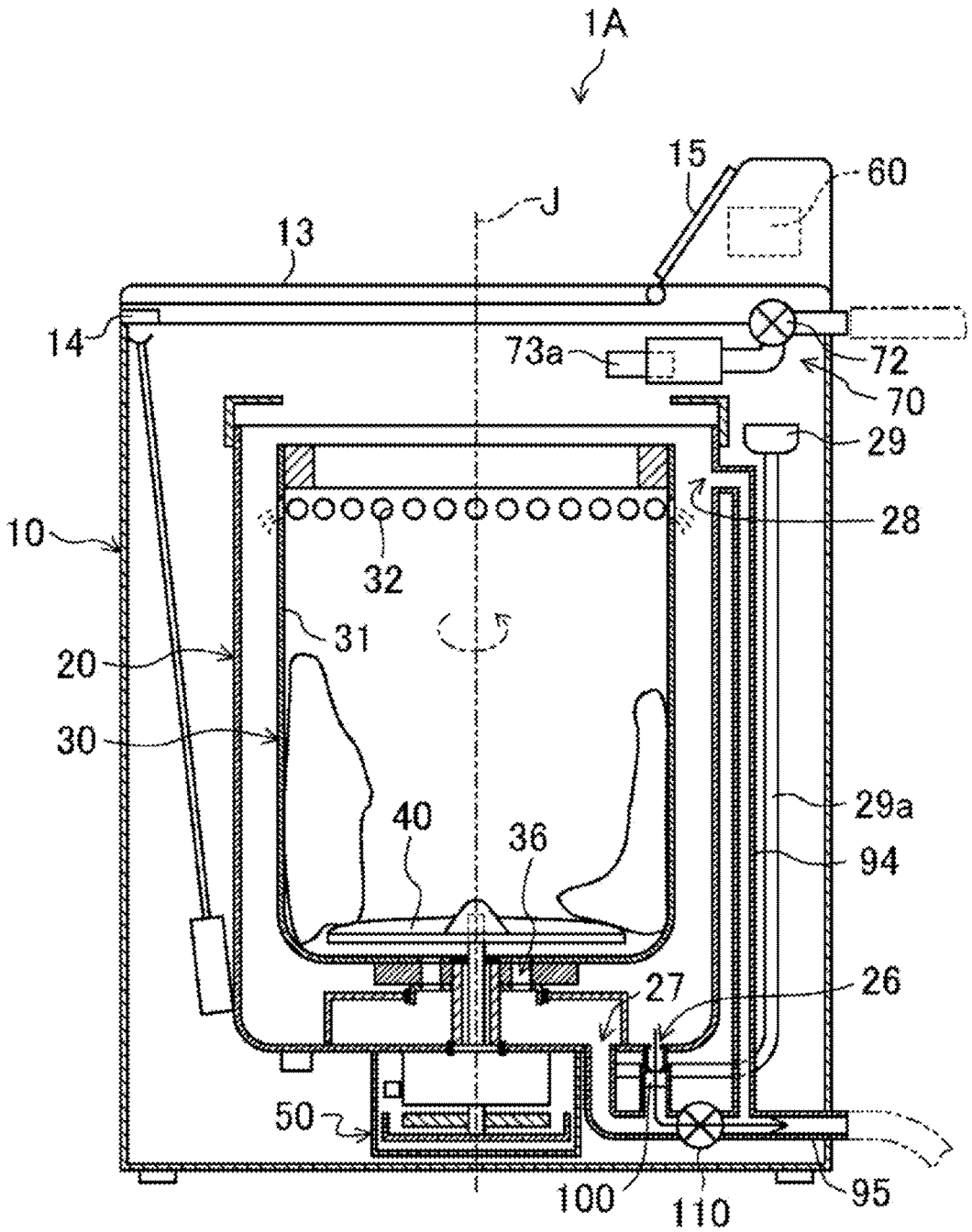
FIG. 8 is a schematic view showing a state when a dehydrating operation is performed.

Successively, when a dehydrating operation starts, the controller 60 may control the driver 50, while opening the drain valve 110, and switch the switch 52 to the first connection state so that the rotating tub 30 and the pulsator 40 rotate together. Thereby, as shown in FIG. 8, the controller 60 may drive the motor 51 to rotate the rotating tub 30, etc. at higher speed than during the washing operation or the rinsing operation. Accordingly, water included in laundry may rise along the inner surface of the body member 31 by a centrifugal force to overflow from the dehydrating holes 32. The water overflowing from the dehydrating holes 32 may fall to the bottom of the water collecting tub 20, and then be drained through the first drain hole 26, the first path (the stop valve 100 is in an opened state) 92, and the fourth path 95.

When a predetermined time period has elapsed, the controller 60 may stop driving the motor 61, and terminate the dehydrating operation. When the dehydrating operation terminates, drive completion may be notified to a user through a buzzer, etc., and simultaneously, the cover 13 may be unlocked to enable the user to take the laundry out of the rotating tub 30.

(Tub Cleaning)

In the case of the washing machine 1A in which the rotating tub 30 can store water independently, water may be little collected in the outer space 39 of the rotating tub 30, such as the inner wall of the water collecting tub 20 or the outer wall of the rotating tub 30. Therefore, dirt may be accumulated or mold may be formed in the outer space 39 of the rotating tub 30 so that the outer space 39 easily becomes an unsanitary condition. The user will want to keep the outer space 39 of the rotating tub 30 clean. Accordingly, it will be preferable that the washing machine 1A sets a course for cleaning the outer space 39. Hereinafter, an example of a tub cleaning course will be described.

Before starting tub cleaning, the user may put a detergent into the detergent supply case 73*a*. When the cover 13 is closed, the cover 13 may be locked. Then, the user may manipulate the control panel 15, and select a tub cleaning course. Then, the controller 60 may start a tub cleaning process.

Figure 9:
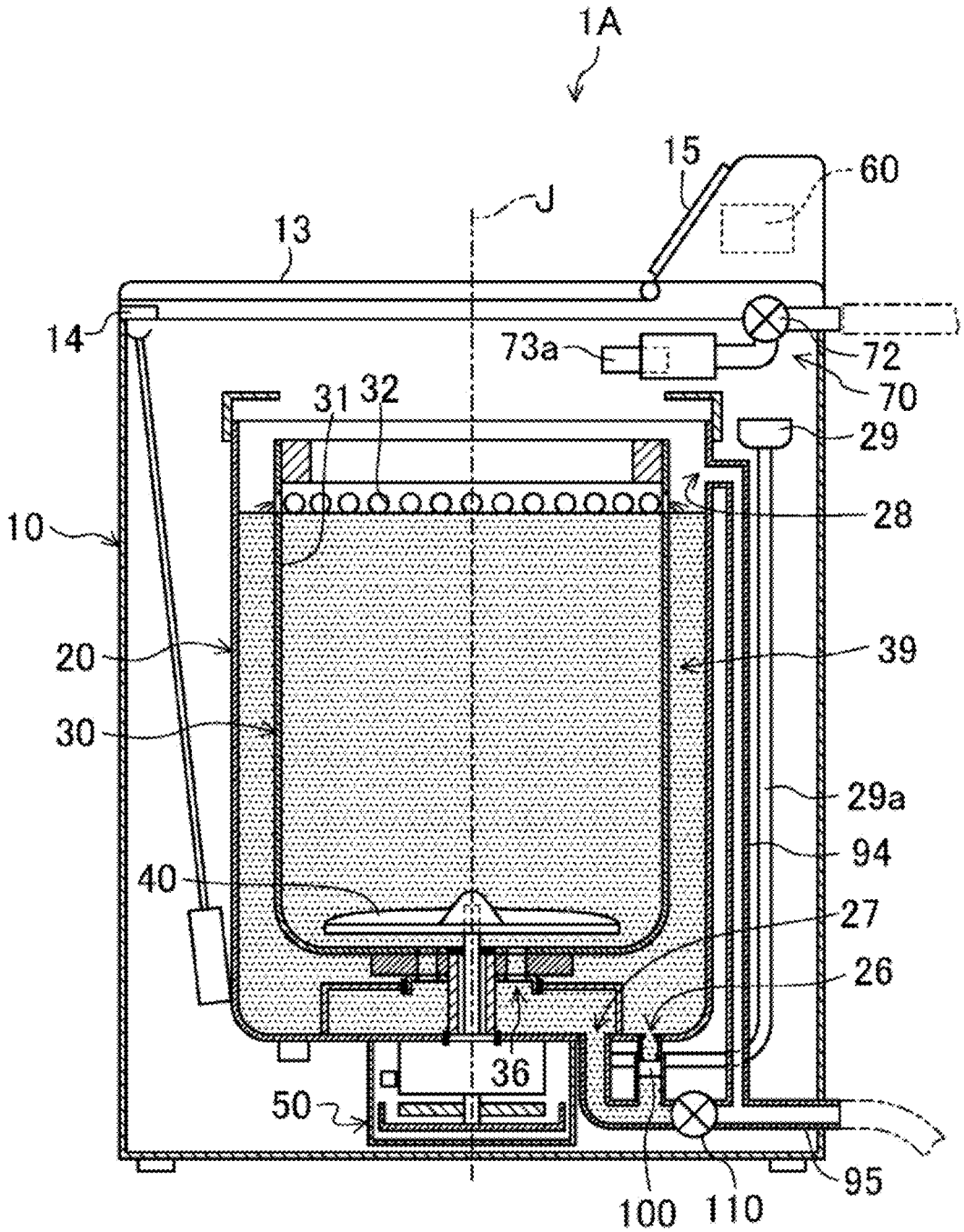
FIG. 9 is a schematic view showing a state when tub cleaning is performed.

When tub cleaning starts, the controller 60 may close the drain valve 110, and open the water supply valve 72, as in the washing operation. Accordingly, water may enter the water supply 70 to be supplied to the rotating tub 30. At this time, the detergent may be supplied to the rotating tub 30 together with the water, and stored in the rotating tub 30. Then, as shown in FIG. 9, when water is sufficiently filled in the rotating tub 30, water may overflow through the dehydrating holes 32. Accordingly, the overflowing water may be stored in the water collecting tub 20.

Water may be supplied to the water collecting tub 20 until a sufficient amount of water is collected in the water collecting tub 20, that is, until water exceeds the upper limit of storage of the water collecting tub 20. The controller 60 may control the driver 50 to rotate the pulsator 40 forward and backward. The controller 60 may rotate the pulsator 40 and the rotating tub 30 at low speed. In this case, washing water may be stirred to efficiently clean the outer space 39 of the rotating tub 30. Since washing water is stirred, the washing water may be, although rippling greatly in the outer space 39 of the rotating tub 30, drained through the third drain hole 28 so that there is no probability that the washing water overflows to the outside of the water collecting tub 20. Also, so-called immersion cleaning may be performed without driving the driver 50.

In this case, when a predetermined time period has elapsed, the controller 60 may open the drain valve 110 to drain washing water. After draining the washing water, the controller 60 may perform a rinsing operation to rinse the inside of the rotating tub 30.

<First Modification Example>

Figure 10:
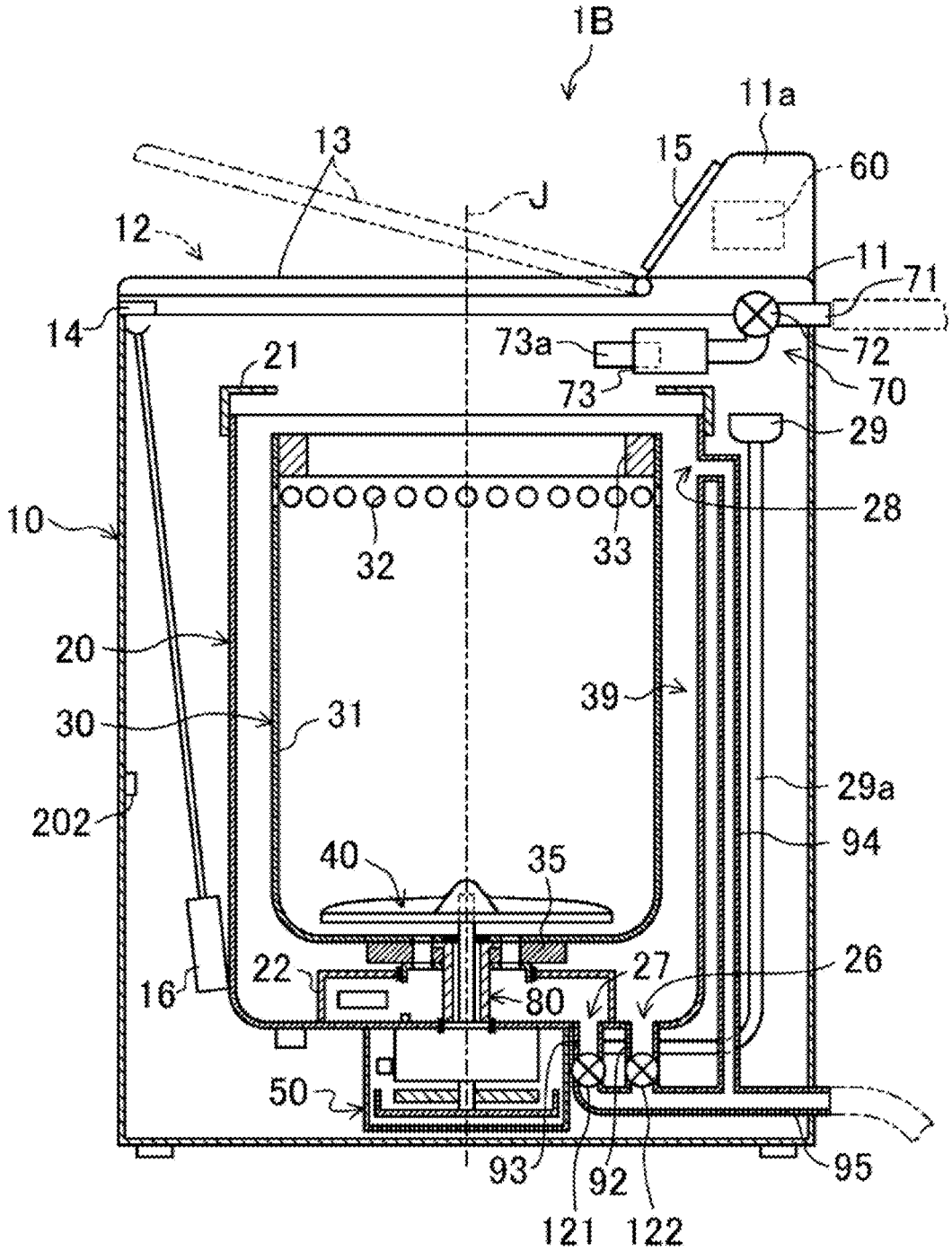
FIG. 10 schematically shows another type of a washing machine.

In FIG. 10, another type of washing machine 1B to which the first technique is applied is shown. A basic structure of the washing machine 1B may be the same as that of the washing machine 1A. Accordingly, the same components as those of the washing machine 1A will be assigned the same reference numerals, and detailed descriptions thereof will be omitted. Hereinafter, a difference in structure between the washing machine 1A and the washing machine 1B will be described.

The washing machine 1B may have a stop structure that is different from that of the washing machine 1A. More specifically, the washing machine 1B may include a first opening and shutting valve 121 and a second opening and shutting valve 122 installed respectively on the first path 92 and the second path 93, wherein the first opening and shutting valve 121 and the second opening and shutting valve 122 may be opened and closed under the control of the controller 60. No drain valve 110 may be installed on the fourth path 95.

The first opening and shutting valve 121 and the second opening and shutting valve 122 may have the same structure, and may be bellows type opening and shutting valves, like the drain valve 110. The controller 60 may control the first opening and shutting valve 121 and the second opening and shutting valve 122, independently.

Accordingly, when storing water in the rotating tub 30, the controller 60 may close the first opening and shutting valve 121, and when storing water in the outer space 39, the controller 60 may close the second opening and shutting valve 122. Through the control, it may be possible to freely drain water from the rotating tub 30 and the water collecting tub 20.

<Second Embodiment>

Figure 11:
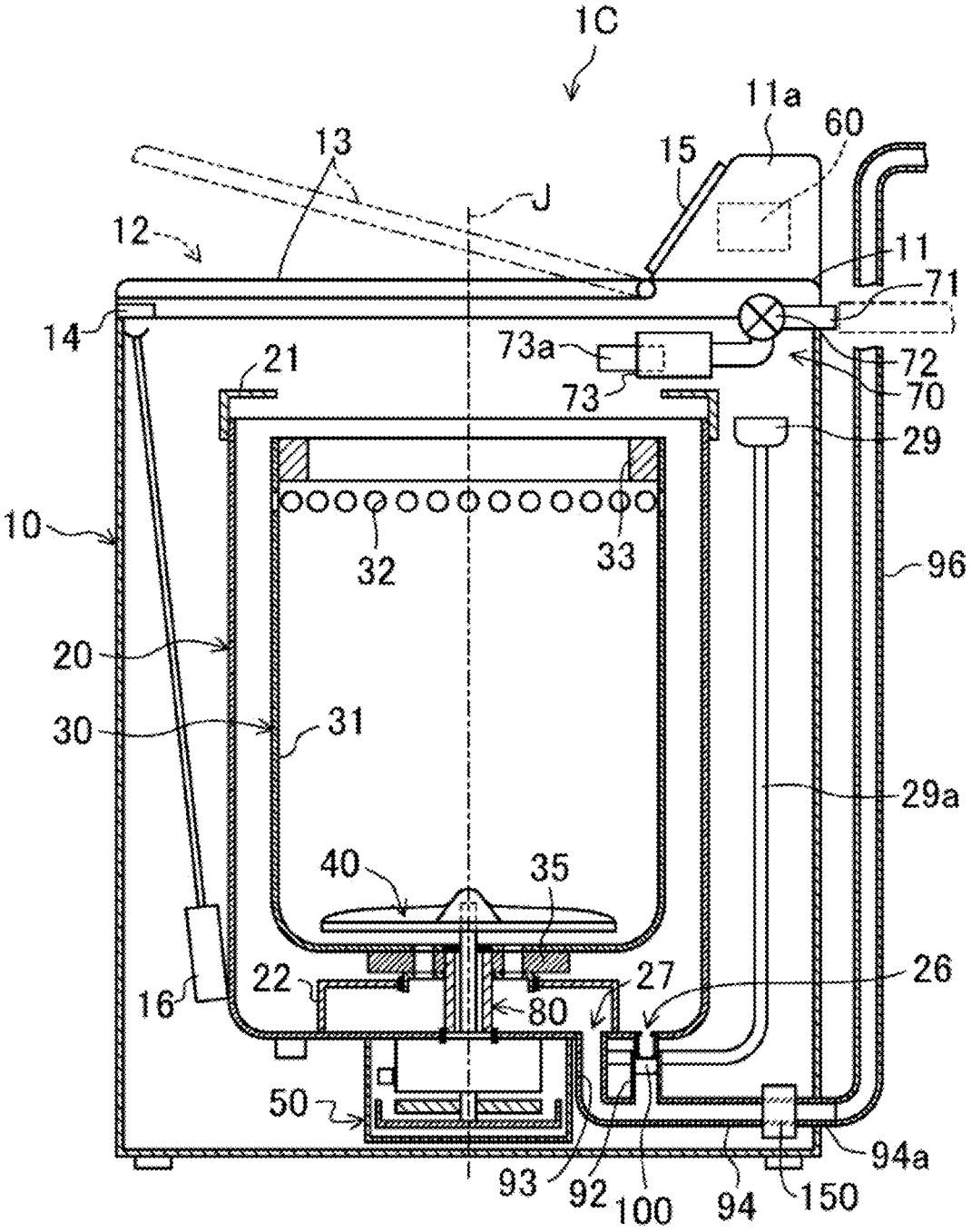
FIG. 11 schematically shows a washing machine according to a second embodiment, wherein main components inside a housing are shown.
Figure 12:
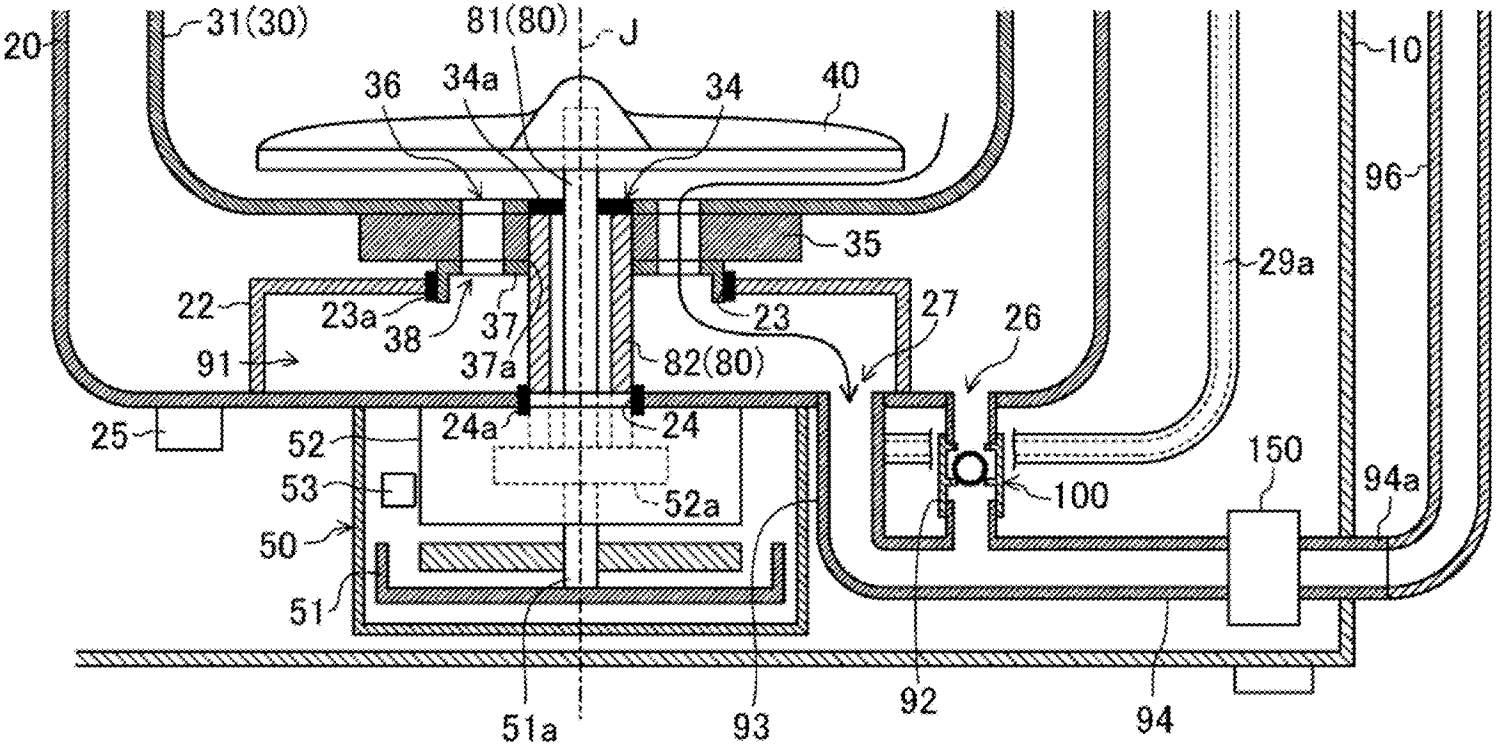
FIG. 12 schematically shows a lower structure of a washing machine, specifically, a drain path.
Figure 13:
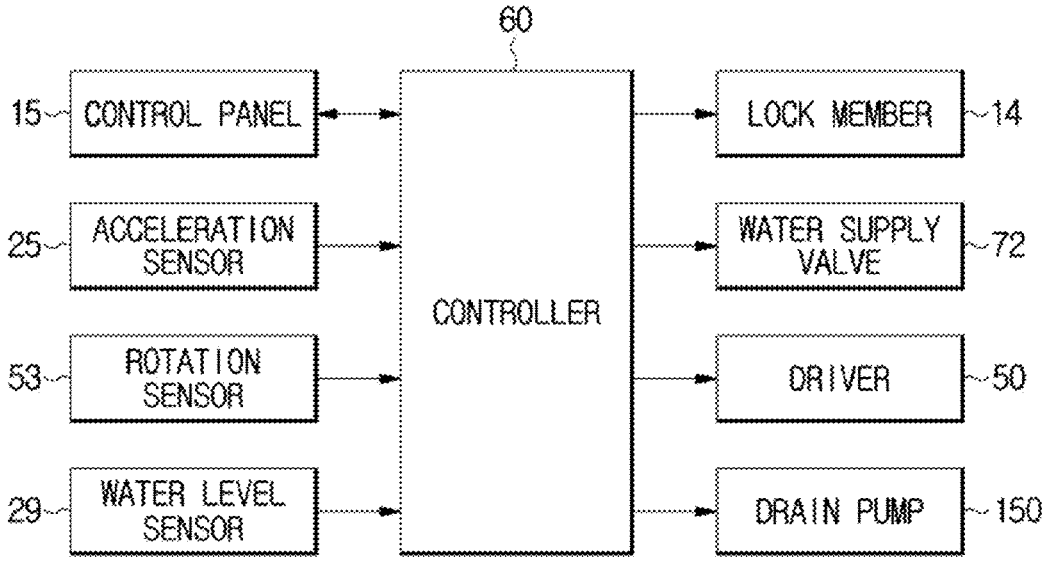
FIG. 13 is a block diagram of a controller and main input/output devices.

In FIGS. 11 and 12, a washing machine 1C to which the second technique is applied is shown. FIG. 13 shows a relationship between the controller 60 of the washing machine 1C, main input devices, and main output devices.

The washing machine 1C may be a type of draining water through a drain pump. A basic configuration of the washing machine 1C including the housing 10, the water collecting tub 20, the rotating tub 30, the pulsator 40, the driver 50, etc. may be the same as that of the washing machine 1A. Accordingly, the same components as those of the washing machine 1A will be assigned the same reference numerals, and detailed descriptions thereof will be omitted. Hereinafter, a difference in structure between the washing machine 1A and the washing machine 1C will be described.

(Drain Path)

In the bottom of the water collecting tub 20, the first drain hole 26 and the second drain hole 27 may be formed, wherein the first drain hole 26 opens to the inside space of the water collecting tub 20, and the second drain hole 2 opens to the water guide path 91. The second drain hole 27 may communicate with the outlet 36 via the water guide path 91 and the through hole 38.

Also, the first drain hole 26 may be connected to the upper end of the pipe (the first path 92) extending downward from the bottom of the water collecting tub 20. The second drain hole 27 may be connected to the upper end of the pipe (the second path 93) disposed in parallel to the first path 92 and extending downward from the bottom of the water collecting tub 20. On the second path 93, the water level sensor 29 may be installed through the vent pipe 29*a*. The water level sensor 29 may detect a level of water collected in the rotating tub 30, and output the detected level of water to the controller 60.

In the lower space of the housing 10, the pipe (the third path 94) extending along the bottom of the housing 10 inside the housing 10 may be installed, wherein the end (a hose connecting port 94*a*) of the third path 94 may protrude to the outside from the rear surface of the housing 10. On the third path 94, a drain pump 150 may be installed. The drain pump 150 may be driven by the control of the controller 60. The third path 94 located downstream from the drain pump 150 may be integrated into the drain pump 150. A drain hose 96 may be connected to the hose connecting port 94*a* integrated into the drain pump 150, wherein the drain hose 96 may extend to a higher location than a predetermined level (generally, the upper limit of storage of the water collecting tub 20) of water collected in the water collecting tub 20.

Accordingly, the washing machine 1C may be configured to forcedly drain water using the drain pump 150, instead of natural drainage in which water flows downward. Also, an upstream side of the third path 94 may be connected to the lower ends of the first and second paths 92 and 93. More specifically, the second path 93 and the first path 92 may be connected in this order from upstream to the third path 94 in such a way to be in parallel to the third path 94, and the drain pump 150 may be installed downstream from the junction of the first and second paths 92 and 93.

Accordingly, water collected in the rotating tub 30 may be drained from the outlet 36 through the water guide path 91, the second path 93, and the third path 94. Also, water collected in the water collecting tub 20 may be drained from the first drain hole 26 through the first path 92 and the third path 94.

Therefore, water collected in the rotating tub 30 or the water collecting tub 20 may be drained independently, and the two drain paths 92 and 93 may be located upstream from the drain pump 150. Thus, there is no probability that an excessive load is applied to the drain pump 150 unless both the drain paths 92 and 93 are clogged. Therefore, it may be possible to stably drain water through forced drainage by the drain pump 150.

(Stop Structure)

The washing machine 1C may include a stop structure composed of a combination of the stop valve 100 (see FIGS. 4A and 4B) and the drain pump 150 on the drain path in order to stably collect water in the rotating tub 30 with a simple structure. The stop valve 100 may be installed on the first path 92. The stop valve 100 may be a float type opening and shutting valve that operates nonelectrically according to a drain state. Accordingly, the stop valve 100 may not require complicated electrical control, and have few failures. That is, the stop valve 100 may have excellent durability.

(Driving and Drainage of Washing)

Figure 14:
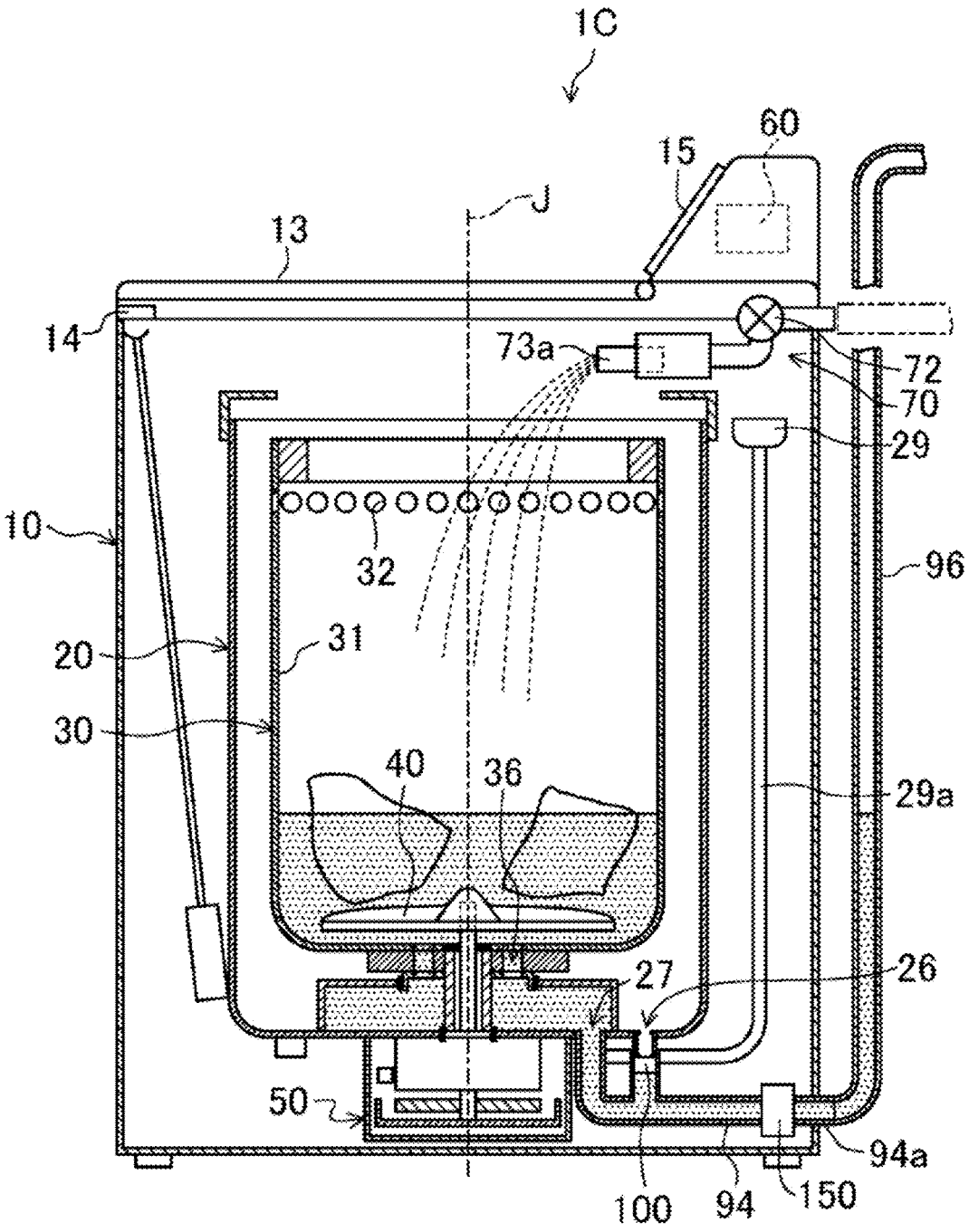
FIG. 14 is a schematic view showing a state when a washing operation is performed.

When a washing operation starts, the washing machine 1C may open the water supply valve 72. Accordingly, as shown in FIG. 14, tap water (simply, referred to as water) may enter the water supply 70 to be supplied to the rotating tub 30. At this time, a detergent may be supplied to the rotating tub 30 together with the water. The water supplied to the rotating tub 30 may be stored gradually from the bottom of the body member 31, and thus flow downward from the outlet 36 to enter the third path 94 through the water guide path 91 and the second path 93.

Since the drain hose 96 extends to a higher location than the level of water of the water collecting tub 20, the water entered the third path 94 may be not drained. Therefore, the water may be stored gradually in the first path 92, the second path 93, and the vent pipe 29*a*. Thereby, a water level may rise, and accordingly, the float 101 in the stop valve 100 on the first path 92 may float to closely contact the upper restricting member 102*a*. Then, the flow path of the first path 92 may be closed to stop water. That is, water may be prevented from entering the inside of the water collecting tub 20.

Also, when water is supplied to the rotating tub 30, the water levels of the second path 93 (also, the water guide path 91, the rotating tub 30, and the vent pipe 29*a*) and the vent pipe 29*a*, except for the first path 92, may rise. When the water levels of the rotating tub 30 and the vent pipe 29*a* reach a predetermined water level, the controller 60 may stop supplying water based on a detection value of the water level sensor 29.

The controller 60 may control the driver 50, and switch the switch 52 to the second connection state. Then, the controller 60 may drive the motor 51 based on a detection value of the rotation sensor 53 to rotate the pulsator 40 forward and backward for a predetermined time period, without rotating the rotating tub 30. Thereby, a washing process may be performed.

When the washing process terminates, a drainage process may be performed. The controller 60 may drive the drain pump 150 sequentially or intermittently for a predetermined time period. Accordingly, water collected in the rotating tub 30 may be forcedly drained. When the water level drops, the float 101 of the stop valve 100 may fall, and when the water level becomes lower than the lower restricting member 102*b*, the float 101 may be supported on the lower restricting member 102*b*. Accordingly, the flow path of the first path 92 may also open.

Figure 15:
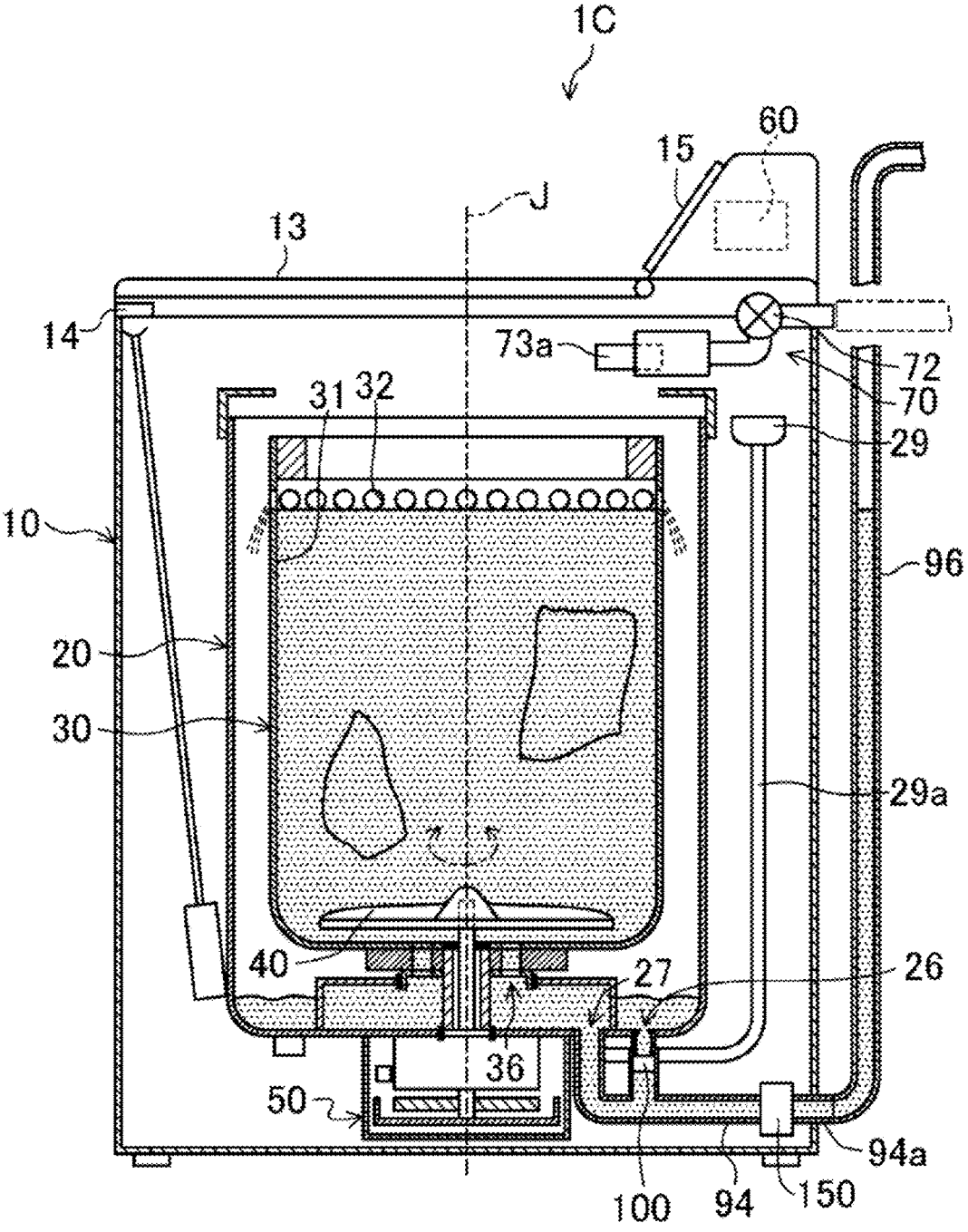
FIG. 15 is a schematic view showing a state when a rinsing operation is performed.

Successively, when a rinsing operation starts, like the washing operation, the controller 60 may open the water supply valve 72. Accordingly, water may enter the water supply 70 to be supplied to the rotating tub 30, so that the water is stored gradually. As shown in FIG. 15, when a predetermined amount of water is collected in the rotating tub 30, the controller 60 may control the driver 50 to rotate the pulsator 40 forward and backward.

The ringing process may be performed with an amount of water enough to be kept without overflowing. However, there may be a case in which the rinsing process is performed with an amount of water that may overflow or while water is supplied. FIG. 15 shows the case. In this case, when the level of water collected in the body member 31 rises, water may overflow through the dehydrating holes 32. Water overflowing through the dehydrating holes 32 may be stored in the water collecting tub 20 since the first path 92 is closed by the stop valve 100. The controller 60 may stop supplying water before water collected in the water collecting tub 20 reaches the upper limit of storage of the water collecting tub 20, and then terminate the rinsing process.

After the rinsing process terminates, unlike the washing process, a drainage process may be performed, and the controller 60 may drive the drain pump 150. Accordingly, while water is collected in the water collecting tub 20, water collected in the rotating tub 30 may be drained. Then, when head pressure of water collected in the water collecting tub 20 becomes higher than the pressure of water collected in the rotating tub 30 and buoyance of the float 101, the float 101 may drop and the first path 92 may be opened so that the water stored in the water collecting tub 20 starts being drained. Accordingly, water stored in the rotating tub 30 and the water collecting tub 20 may be drained.

Figure 16:
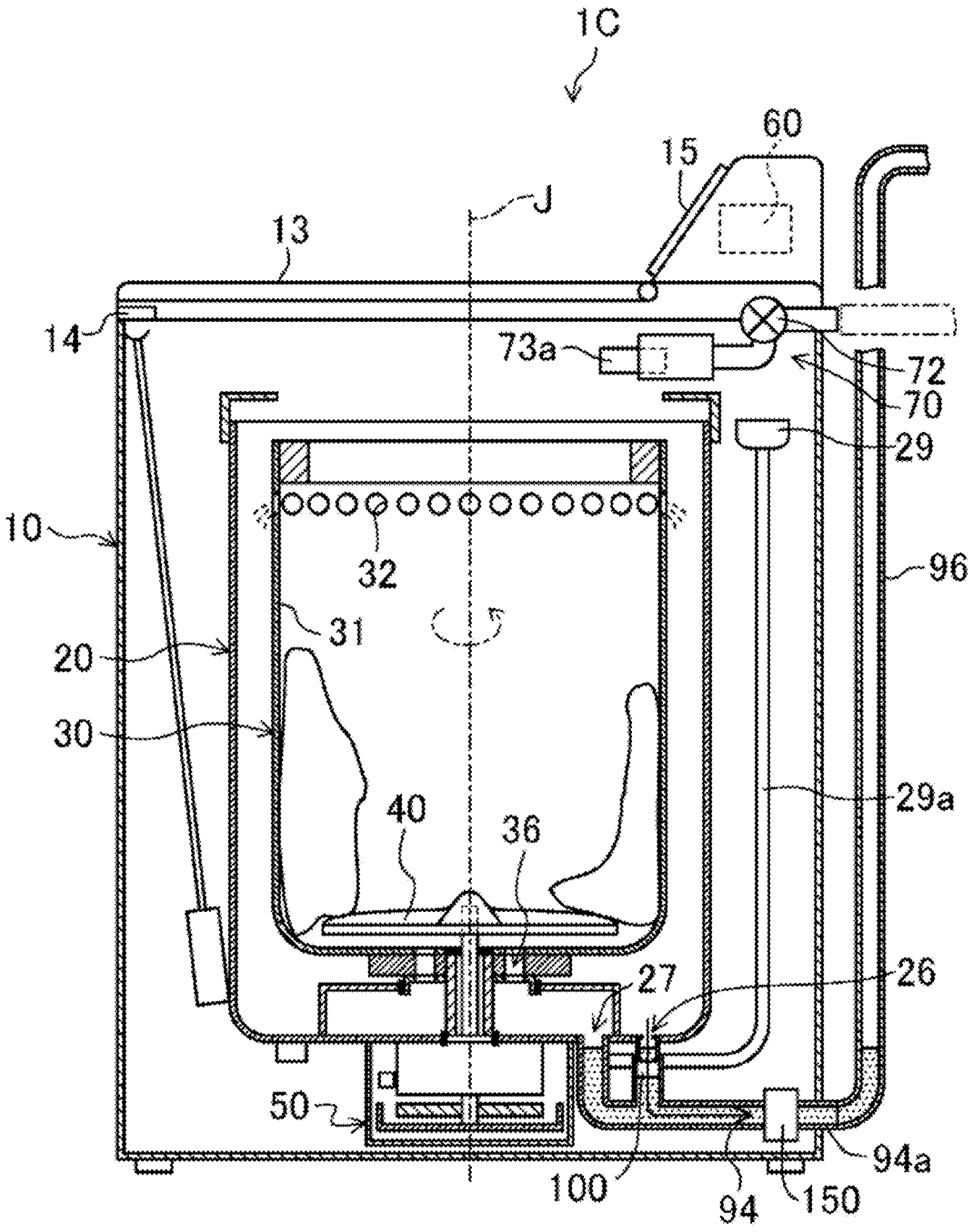
FIG. 16 is a schematic view showing a state when a dehydrating operation is performed.

Successively, when a dehydrating operation starts, the controller 60 may control the driver 50, and switch the switch 52 to the first connection state so that the rotating tub 30 and the pulsator 40 rotate together. Thereby, as shown in FIG. 16, the controller 60 may drive the motor 51 to rotate the rotating tub 30, etc. at higher speed than during the washing operation or the rinsing operation. Water included in laundry may rise along the inner surface of the body member 31 by a centrifugal force to overflow from the dehydrating holes 32. The water overflowing from the dehydrating holes 32 may fall to the bottom of the water collecting tub 20, and then be drained forcedly by driving of the drain pump 150 through the first drain hole 26, the first path (the stop valve 100 is in an opened state) 92, and the third path 94.

When a predetermined time period has elapsed, the controller 60 may stop driving the motor 61, and terminate the dehydrating operation. When the dehydrating operation terminates, drive completion may be notified to a user through a buzzer, etc., and simultaneously, the cover 13 may be unlocked to enable the user to take the laundry out of the rotating tub 30.

(Tub Cleaning)

Figure 17:
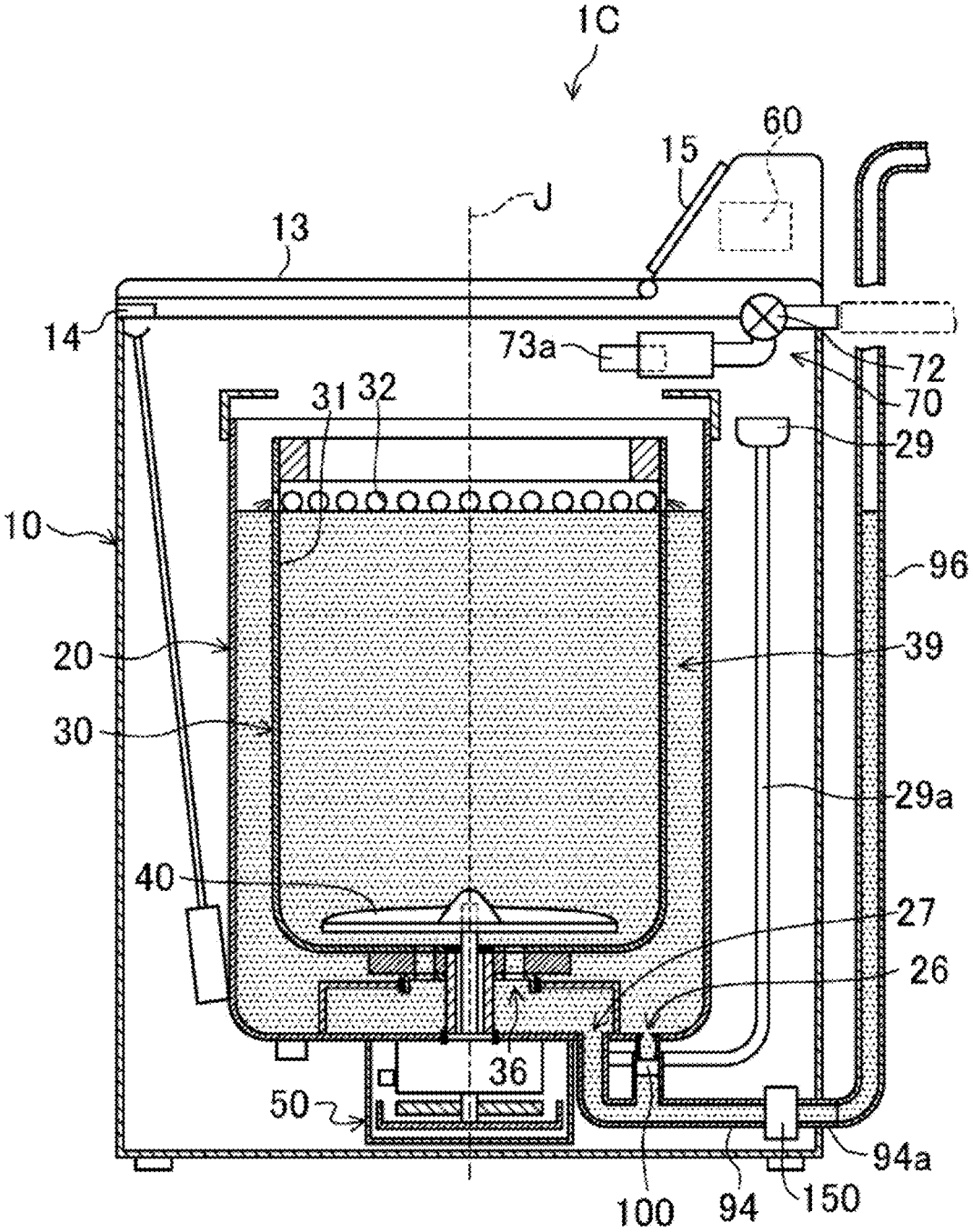
FIG. 17 is a schematic view showing a state when tub cleaning is performed.

An example of a tub cleaning course by the washing machine 1C will be described, as follows. When tub cleaning starts, the controller 60 may open the water supply valve 72, as in the washing operation. Accordingly, water may enter the water supply 70 to be supplied to the rotating tub 30. At this time, a detergent may be supplied to the rotating tub 30 together with the water, and stored in the rotating tub 30. Then, as shown in FIG. 17, when water is sufficiently filled in the rotating tub 30, water may overflow through the dehydrating holes 32. Accordingly, the overflowing water may be stored in the water collecting tub 20.

Water may be supplied to the water collecting tub 20 until a sufficient amount of water is collected in the water collecting tub 20, that is, until water exceeds the upper limit of storage of the water collecting tub 20. The controller 60 may control the driver 50 to rotate the pulsator 40 forward and backward. The pulsator 40 and the rotating tub 30 may rotate at low speed. In this case, washing water may be stirred to efficiently clean the outer space 39 of the rotating tub 30. Also, immersion cleaning may be performed without driving the driver 50.

<First Modification Example>

Figure 18:
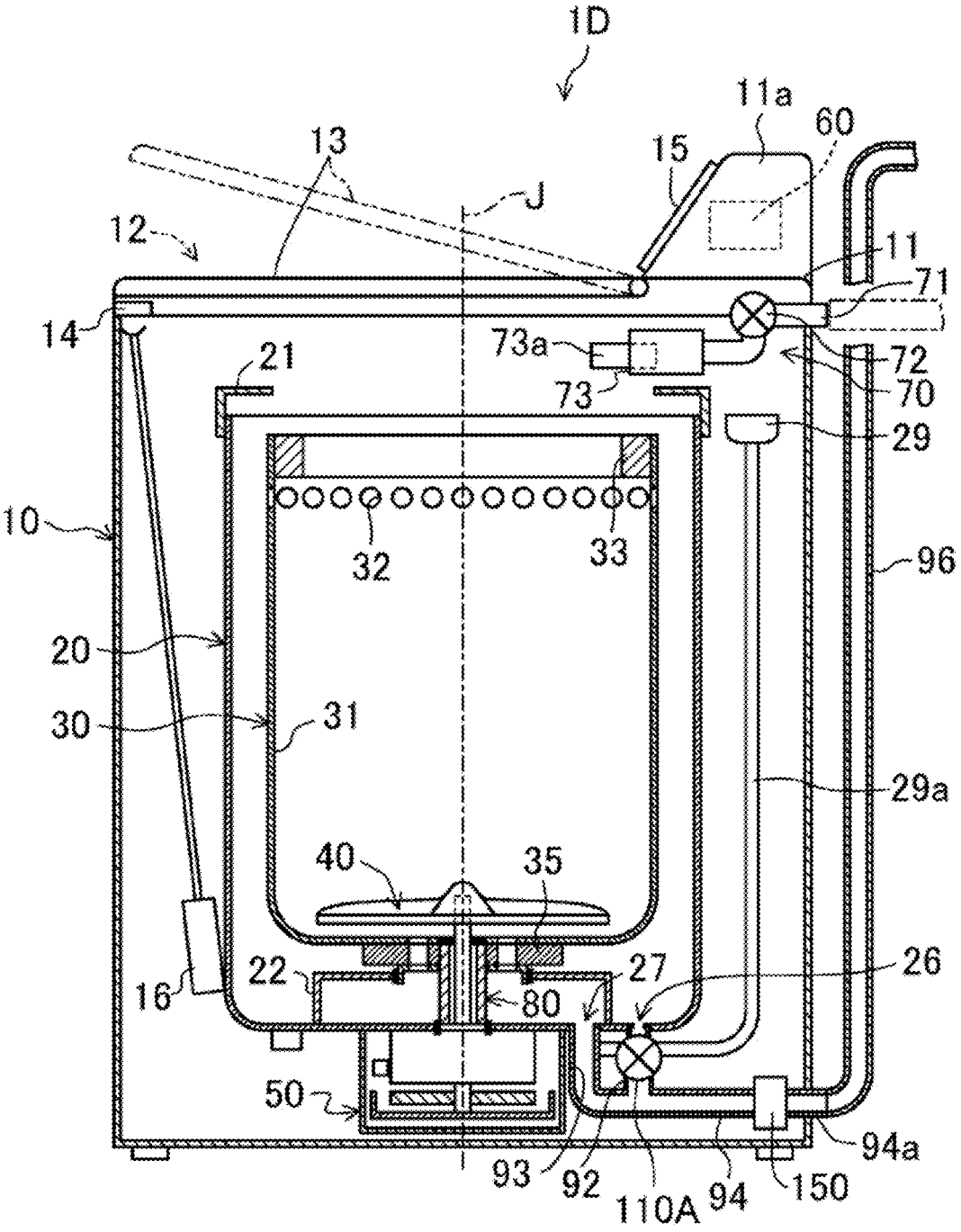
FIG. 18 is a schematic view showing a washing machine according to a first modification example.

In FIG. 18, a washing machine 1D to which the second technique is applied is shown. A basic structure of the washing machine 1D may be the same as that of the washing machine 1C. Accordingly, the same components as those of the washing machine 1C will be assigned the same reference numerals, and detailed descriptions thereof will be omitted. Hereinafter, a difference in structure between the washing machine 1C and the washing machine 1D will be described.

The washing machine 1D may have a stop structure that is different from that of the washing machine 1C. More specifically, the washing machine 1D may include a bellows type stop valve 110A, instead of the float type stop valve 100.

Figure 19:
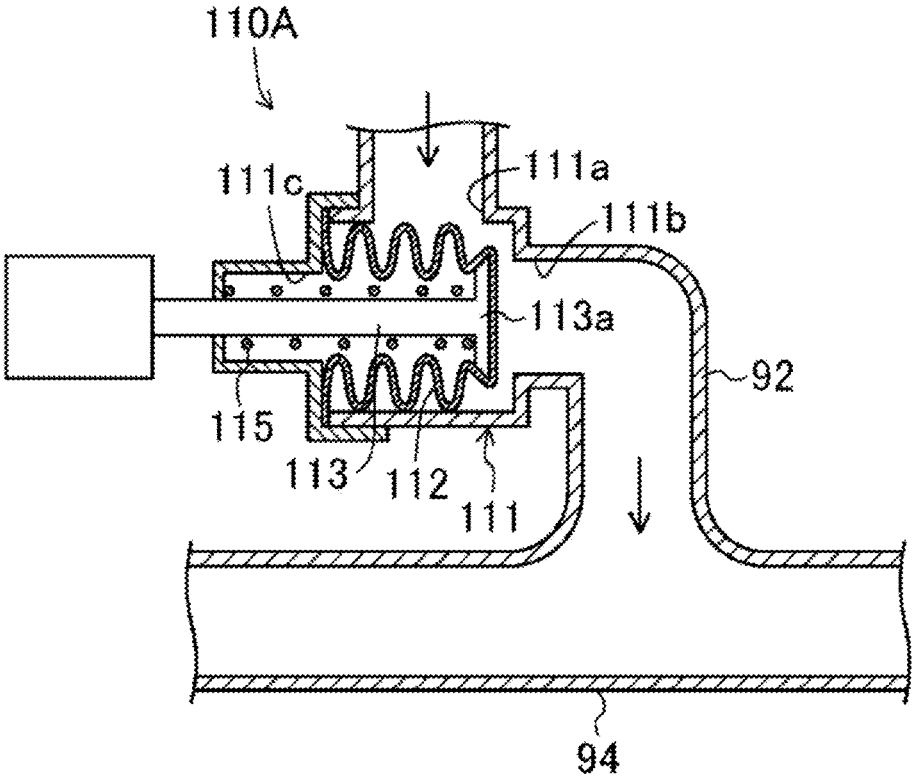
FIG. 19 is a schematic view showing a structure of a stop valve in the first modification example.

In FIG. 19, the stop valve 110A is shown. The stop valve 110A may include the valve chest 111, the bellows 112, the valve body 113, a coli spring 115, and the driving motor 114. The valve chest 111 may be interposed on the first path 92 to constitute a part of the flow path. The valve chest 111 may include the inlet 111*a* opening upstream from the flow path, and the outlet 111*b* opening downstream from the flow path. In the valve chest 111, a valve hole 111*c* may be formed to be opposite to the outlet 111*b*.

Through the valve hole 111*c*, the valve body 113 having the valve 113*a* at the top end may slide toward the outlet 111*b*. The bellows 112 may be installed in the valve chest 111 to close the valve hole 111*c*. The valve body 113 may slide together with the bellows 112 when the driving motor 114 operates to move between a closing position for closing the outlet 111*b* and an opening position for opening the outlet 111*b*. The operation of the driving motor 114 may be controlled by the controller 60.

<Second Modification Example>

Figure 20:
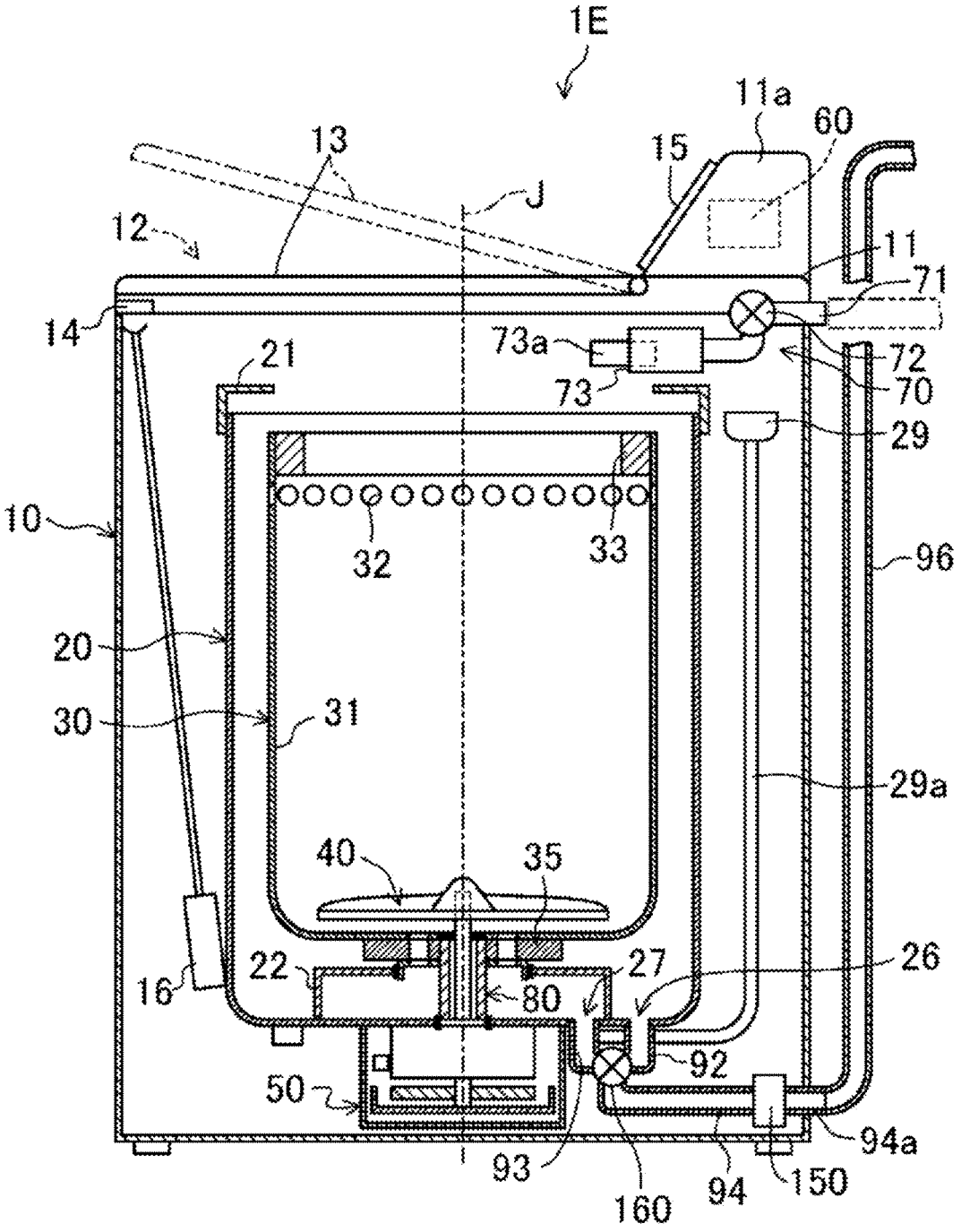
FIG. 20 is a schematic view showing a washing machine according to a second modification example.

In FIG. 20, a washing machine 1E to which the second technique is applied is shown. A basic structure of the washing machine 1E may be the same as that of the washing machine 1C. Accordingly, the same components as those of the washing machine 1C will be assigned the same reference numerals, and detailed descriptions thereof will be omitted. Hereinafter, a difference in structure between the washing machine 1C and the washing machine 1E will be described.

The washing machine 1E may have a stop structure that is different from that of the washing machine 1C. More specifically, the washing machine 1E may include a switch valve 160, instead of the float type stop valve 100.

Figure 21A:
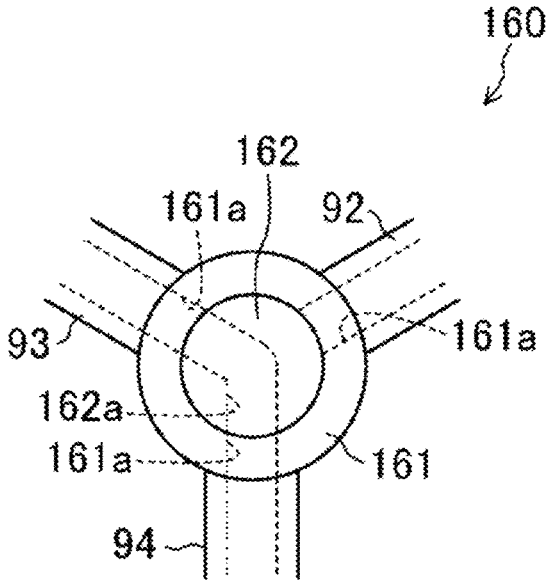
FIG. 21A is a schematic front view showing a switch valve in the second modification example.
Figure 21B:
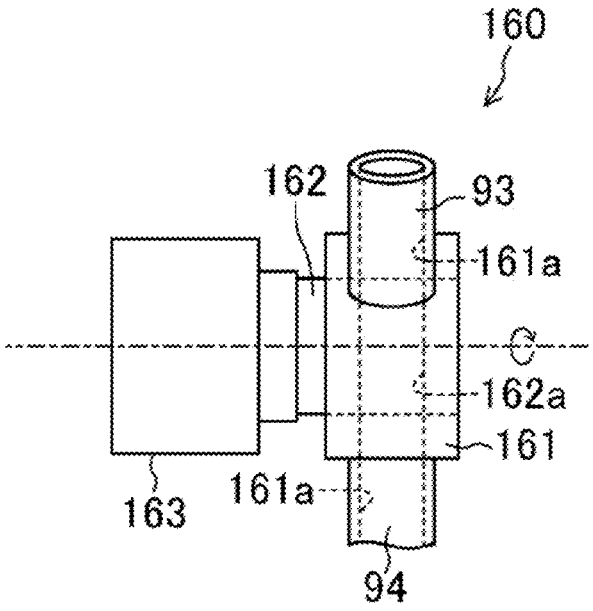
FIG. 21B is a schematic side view showing the switch valve in the second modification example.

In FIGS. 21A and 21B, the switch valve 160 is shown. The switch valve 160 may include a fixed valve body 161, a rotating valve body 162, and a control motor 163. The fixed valve body 161 may be a cylindrical member, and three flow paths 161*a* may extend in a diameter direction from the fixed valve body 161, wherein the flow paths 161*a* may be arranged at equidistant intervals (at intervals of about 120 degrees) in a circumferential direction of the fixed valve body 161 in such a way to penetrate the fixed valve body 161. The fixed valve body 161 may be located at the junction of the first path 92, the second path 93, and the third path 94 such that the first to third paths 92, 93, and 94 are respectively connected to the paths 161*a*.

The rotating valve body 162 may be a cylindrical member, and rotatably accommodated in the fixed valve body 161. In the rotating valve body 162, a V-shaped connection flow path 162*a* may be formed to communicate with any two flow paths 161*a* of the fixed valve body 161. The control motor 163 may be connected to the rotating valve body 162, and rotate the rotation valve body 162 according to an instruction from the controller 60 to locate the rotating valve body 162 at a predetermined position. Accordingly, the switch valve 160 may be switched to a first switching position at which the first path 92 communicates with the third path 94, a second switching position at which the second path 93 communicates with the third path 94, and a third switching position at which the first path 92 communicates with the second path 93, by the control motor 163.

During a washing operation of the washing machine 1E, the switch valve 160 may be controlled to the second switching position to communicate the inside of the rotating tub 30 with the third path 94. When a washing process terminates, the drain pump 150 may be driven to perform a drain process in the state in which the switch valve 160 is maintained at the position.

During a rinsing operation, the switch valve 160 may be controlled to the first switching position to communicate the inside of the water collecting tub 20 with the third path 94. Then, the drain pump 150 may be driven to perform a drain process in the state in which the switch valve 160 is maintained at the position. During a dehydrating operation, like the rinsing operation, the drain pump 150 may be driven to perform a drain process in the state in which the switch valve 160 is controlled to the first switching position to communication the inside of the water collecting tub 20 with the third path 94.

During tub cleaning, the switch valve 160 may be controlled to the third switching position (in the state in which the inside of the rotating tub 30 communicates with the inside of the water collecting tub 20 through the drain path) such that water is collected in the rotating tub 30 and the water collecting tub 20. When water is supplied, the water may be stored to the same water level in the rotating tub 30 and the water collecting tub 20. Accordingly, by detecting the water level through the water level sensor 29, it may be possible to fully fill water to the upper limit in the outer space 39 of the rotating tub 30.

When the tub cleaning terminates, the switch valve 160 may be switched to the first switching position and the second switching position, sequentially, to drain water. Thereby, water collected in the rotating tub 30 and the water collecting tub 20 may be drained.

<Third Modification Example>

Figure 22:
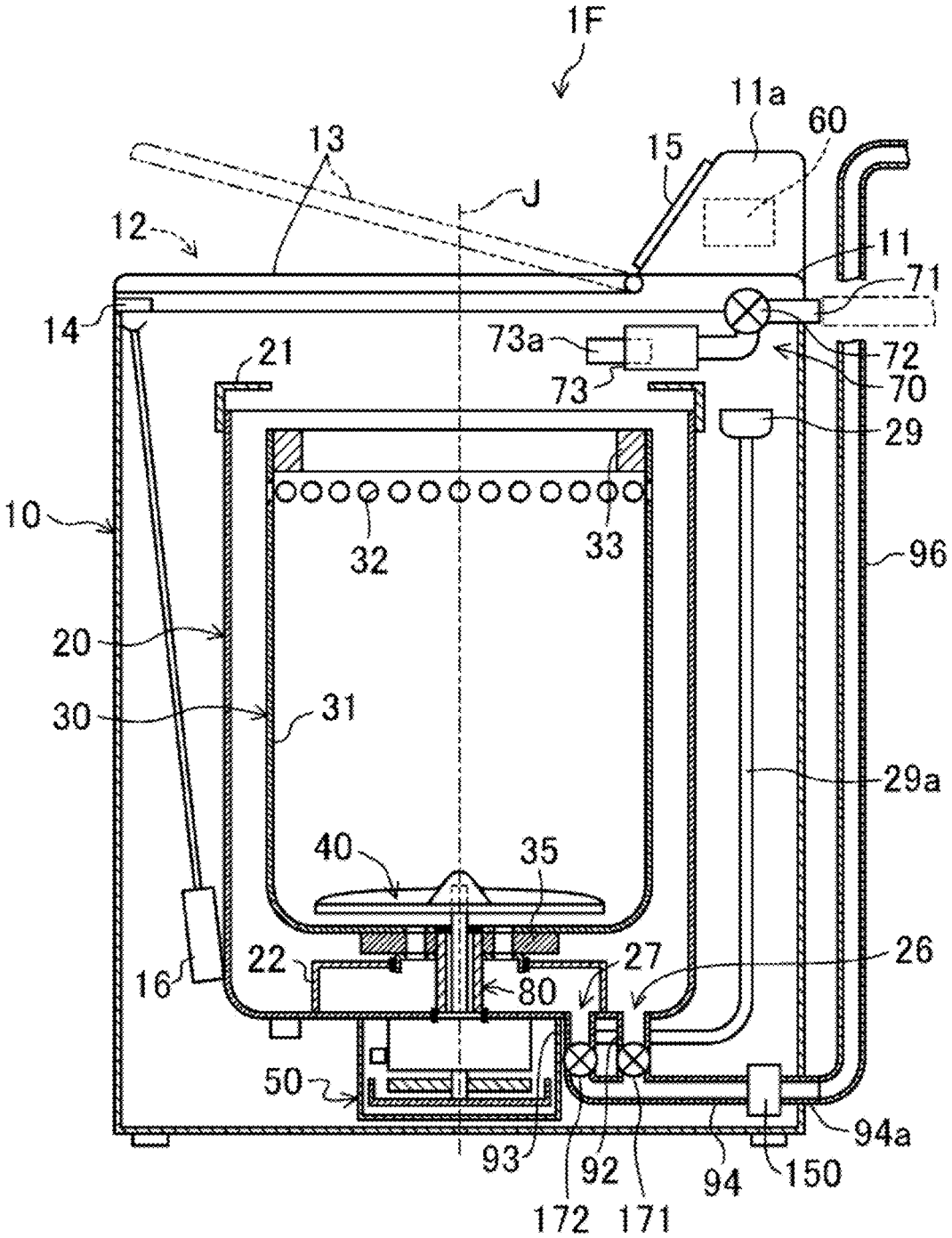
FIG. 22 is a schematic front view showing a switch valve in a third modification example.

In FIG. 22, a washing machine 1F to which the second technique is applied is shown. A basic structure of the washing machine 1F may be the same as that of the washing machine 1C. Accordingly, the same components as those of the washing machine 1C will be assigned the same reference numerals, and detailed descriptions thereof will be omitted. Hereinafter, a difference in structure between the washing machine 1F and the washing machine 1C will be described.

The washing machine 1F may have a stop structure that is different from that of the washing machine 1C. More specifically, the washing machine 1F may include a first opening and shutting valve 171 and a second opening and shutting valve 172 which operate electrically and are bellows types, instead of the float type stop valve 100.

That is, in the washing machine 1F, the first opening and shutting valve 171 and the second opening and shutting valve 172 which are opened or closed by the control of the controller 60 may be installed on the first path 92 and the second path 93, respectively.

Figure 23:
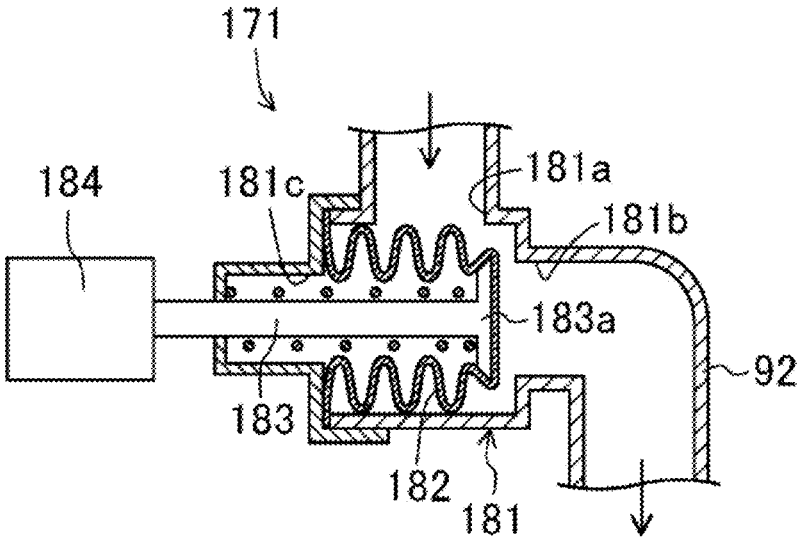
FIG. 23 is a schematic front view showing an opening and shutting valve in the third modification example.

In FIG. 23, the first opening and shutting valve 171 is shown (since the first opening and shutting valve 171 and the second opening and shutting valve 172 have the same structure although they stop water in different directions, the second opening and shutting valve 172 will be not described). The first opening and shutting valve 171 may include a valve chest 181, a bellows 182, a valve body 183, and a driving motor 184.

The valve chest 181 may be interposed on the first path 92 to constitute a part of the flow path. The valve chest 181 may include an inlet 181*a* opening upstream from the flow path, and an outlet 181*b* opening downstream from the flow path. In the valve chest 181, a valve hole 181*c* may be formed to be opposite to the outlet 181*b*.

Through the valve hole 181*c*, the valve body 183 having a valve 183*a* at the top end may slide toward the outlet 181*b*. The bellows 182 may be installed in the valve chest 181 to close the valve hole 181*c*. The valve body 183 may slide together with the bellows 182 when the driving motor 114 operates to move between a closing position for closing the outlet 181*b* and an opening position for opening the outlet 181*b*. The operation of the driving motor 184 may be controlled by the controller 60.

The controller 60 may control the first opening and shutting valve 171 and the second opening and shutting valve 172, independently, by interworking with the drain pump 150. For example, when water is stored in the rotating tub 30, that is, during a washing operation or a rinsing operation, the controller 60 may close the first opening and shutting valve 171 and the second opening and shutting valve 172, without driving the drain pump 150. During a drain process or a drain operation, the controller 60 may open the first opening and shutting valve 171 and the second opening and shutting valve 172. In this state, the controller 60 may drive the drain pump 150 to perform drainage and dehydrating.

When water is stored in the outer space 39 in order to perform tub cleaning, the controller 60 may open the first opening and shutting valve 171 and the second opening and shutting valve 172 to communicate the inside of the rotating tub 30 with the inside of the water collecting tub 20, thereby supplying water. As such, since the controller 60 opens or closes the first opening and shutting valve 171 and the second opening and shutting valve 172 by interworking with the drain pump 150, it may be possible to prevent failures of the drain pump 150 and to freely store/drain water in/from each of the rotating tub 30 and the water collecting tub 20.

<Third Embodiment>

Figure 24:
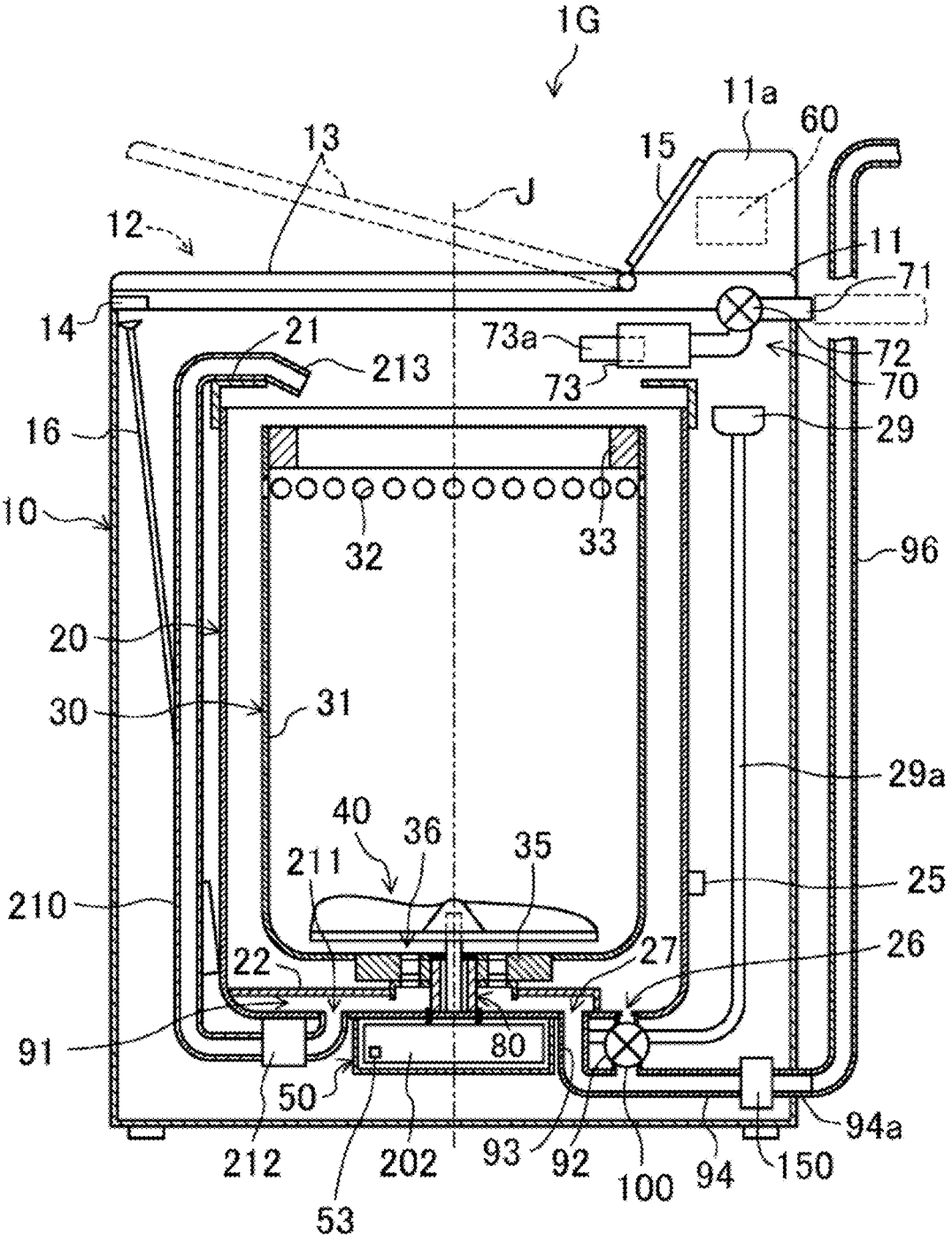
FIG. 24 is a schematic cross-sectional view showing an entire structure of a washing machine according to a third embodiment.
Figure 25:
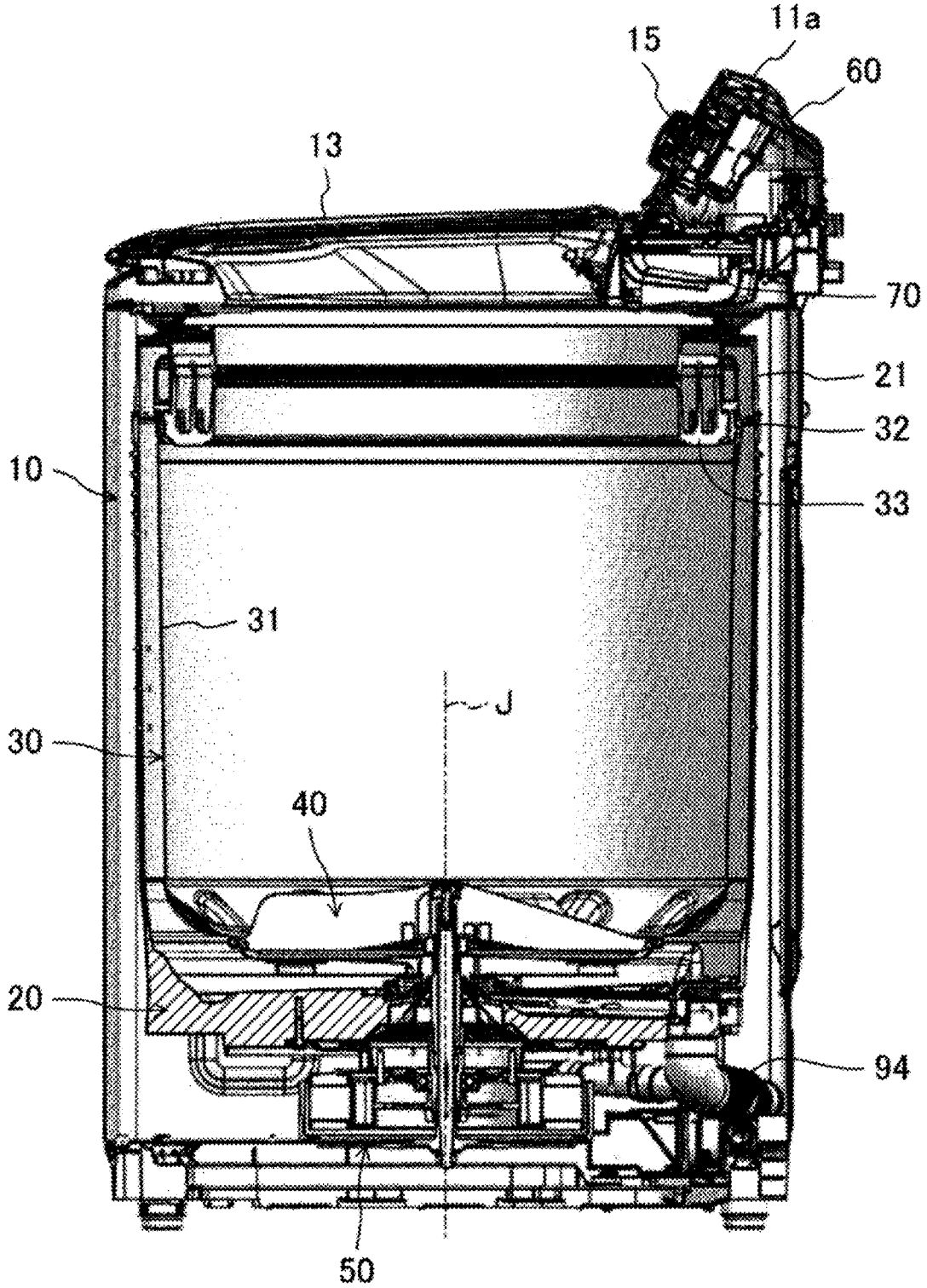
FIG. 25 is a schematic cross-sectional view detailedly showing the entire structure of the washing machine.

In FIGS. 24 and 25, the entire structure of a washing machine 1G to which the third technique is applied is shown. FIG. 24 schematically shows individual components of the washing machine 1G for easy understanding, and FIG. 25 detailedly shows the individual components of the washing machine 1G. FIGS. 26 to 34 detailedly show the individual components. Some of the components are shown in only one of the drawings.

As shown in FIGS. 24 and 25, the washing machine 1G may include the housing 10, the water collecting tub 20, the rotating tub 30, the pulsator 40, and the driver 50. A basic structure of the washing machine 1G may be the same as that of the washing machine 1C (type including a drain pump) described above. Accordingly, the same components as those of the washing machine 1C will be assigned the same reference numerals, and detailed descriptions thereof will be omitted. Hereinafter, a difference in structure between the washing machine 1G and the washing machine 1C will be described.

Figure 28:
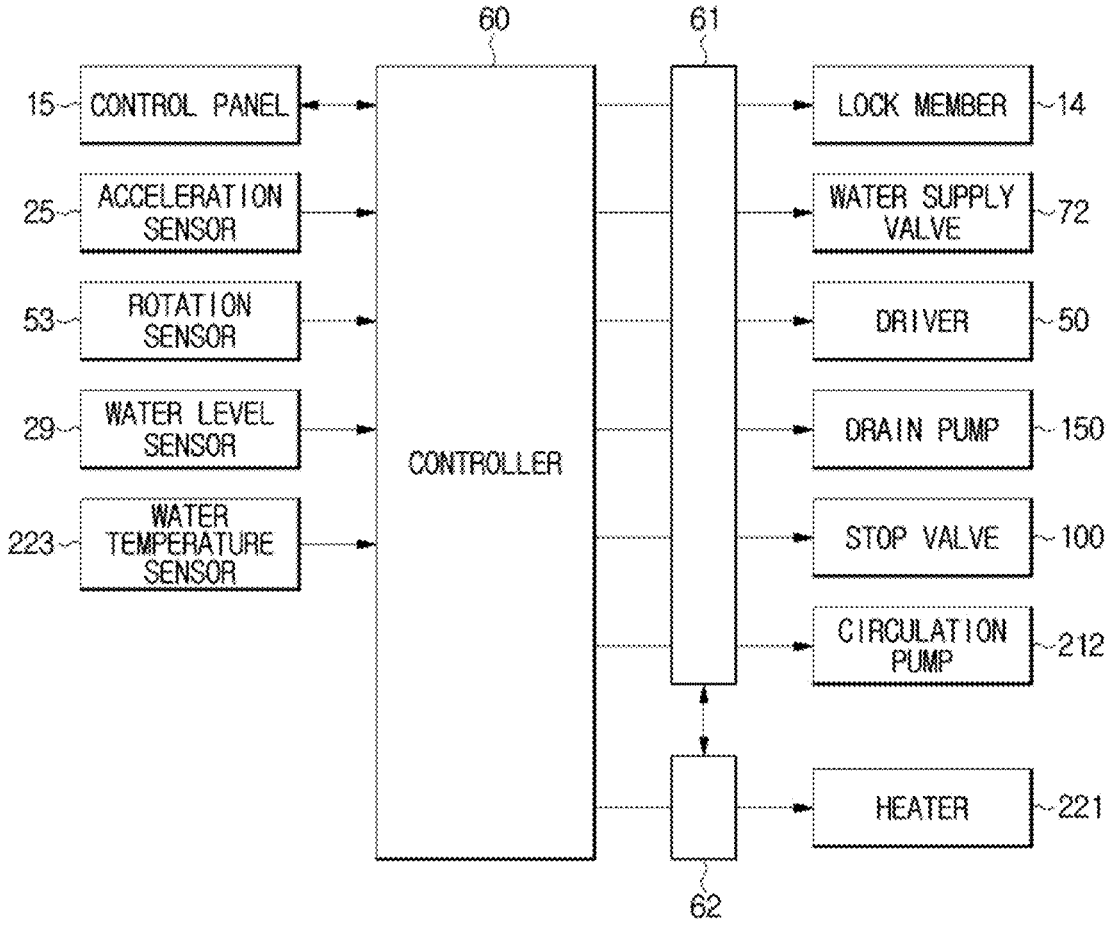
FIG. 28 is a block diagram of a controller and main input/output devices.

FIG. 28 shows a relationship between the controller 60 of the washing machine 1G, main input devices, and main output devices. The controller 60 may be connected to each output device through a driving circuit 61 or a driving circuit 62, and each output device may operate when the controller 60 controls the driving circuit 61 or the driving circuit 62.

Figure 29:
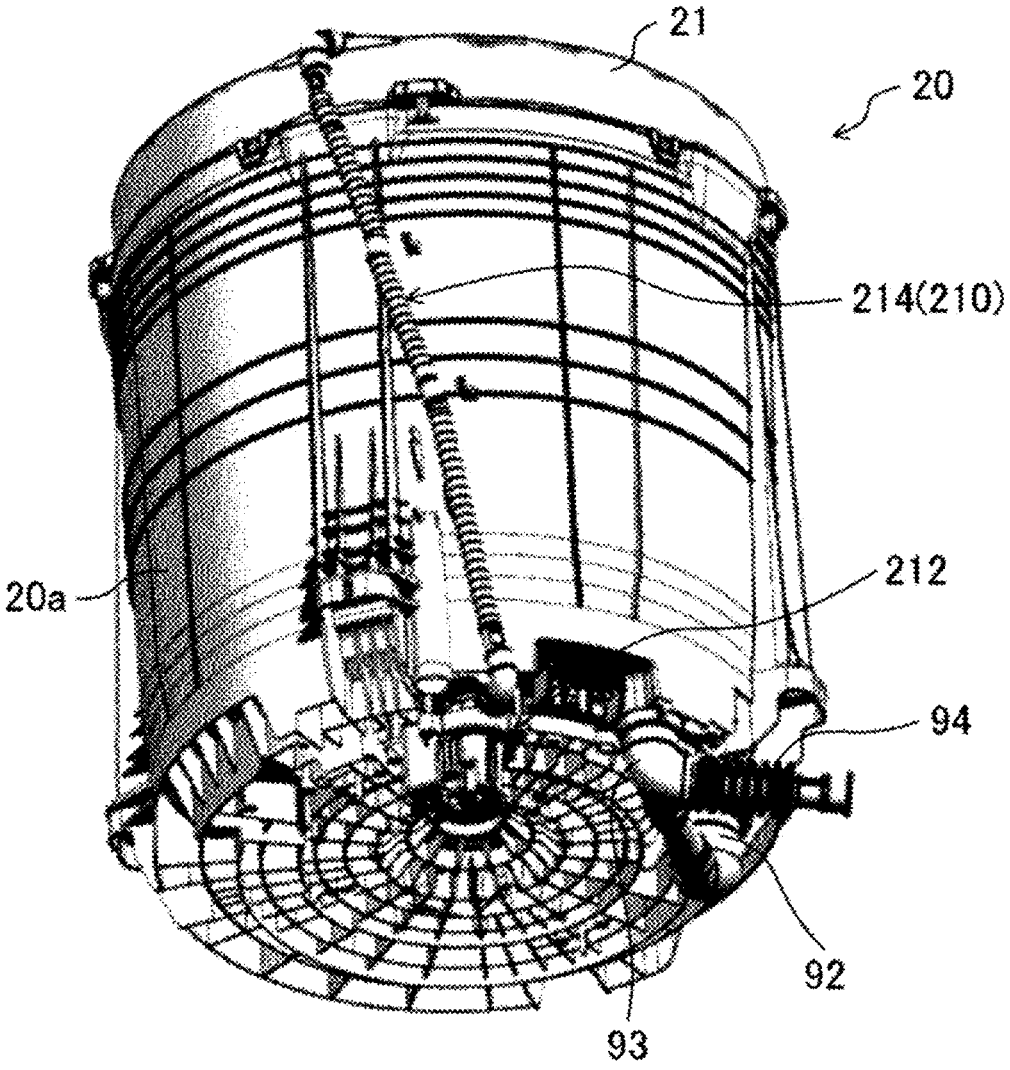
FIG. 29 is a schematic perspective view of a water collecting tub seen from below.

As shown in FIG. 29, the water collecting tub 20 may be a large container formed in the shape of a cylinder having a bottom and storing water. On the inner upper surface of the housing 10, the plurality of suspensions 16 that can be elastically deformed may be arranged at a plurality of different locations. The water collecting tub 20 may be suspended by the suspensions 16 to be shakably supported on the inner wall of the housing 10. On the top of the water collecting tub 20, the tub cover 21 formed in the shape of a flange and protruding inward may be disposed (see FIG. 30). The water feeding case 73 may cross the tub cover 21 above the tub cover 21 to protrude toward the opening of the rotating tub 30, in order to supply water to the inside of the rotating tub 30.

Figure 26:
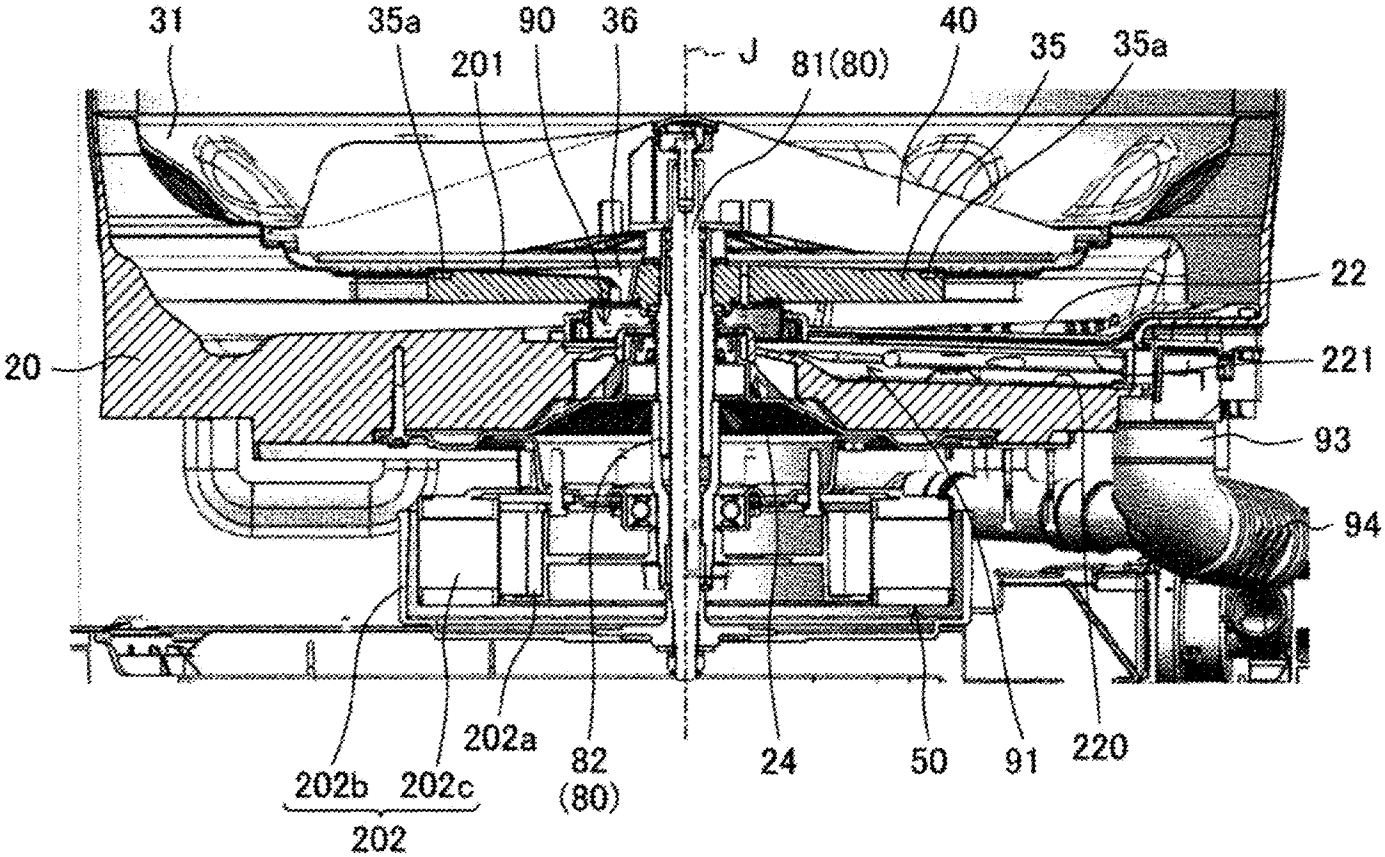
FIG. 26 is an enlarged view of a lower structure of the washing machine.
Figure 27:
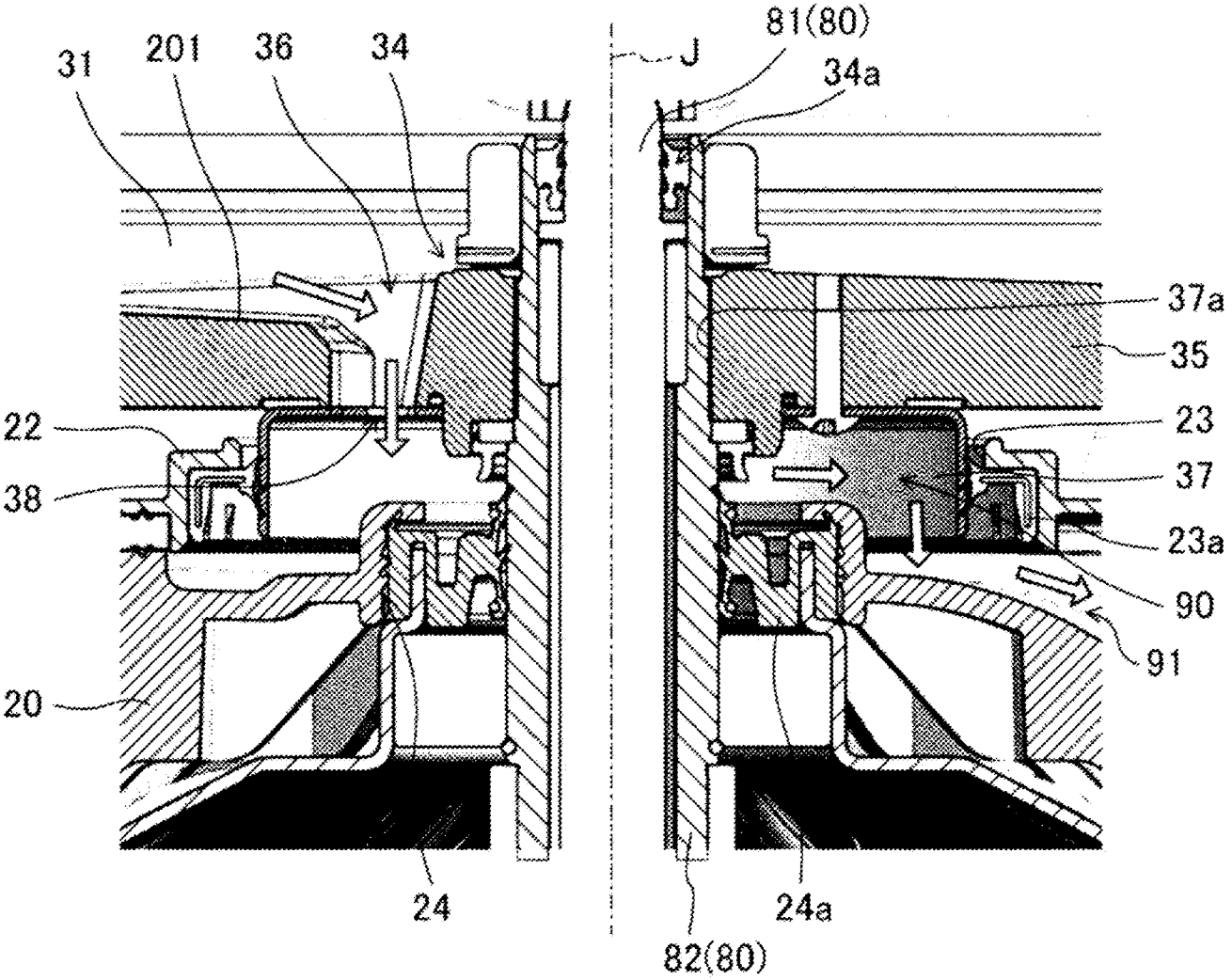
FIG. 27 is a further enlarged view of the lower structure of the washing machine.

As enlarged in FIGS. 26 and 27, a space between the first shaft 81 and the second shaft 82 may be sealed up by the oil seal 34*a*. The bottom of the body member 31 may be fixed at the protruding end of the second shaft 82 that is concentric with the first shaft 81. The first shaft 81 and the second shaft 82 may be integrated into the shaft unit 80, and be rotatable independently.

On the other surface (outer surface) of the bottom of the body member 31, the flange shaft 65 may be disposed through a seal member 35*a*. The flange shaft 35 may reinforce the strength of the bottom of the rotating tub 30. In the bottom of the body member 31, three outlets 36 may open around the shaft hole 34 (see FIG. 31).

Figure 31:
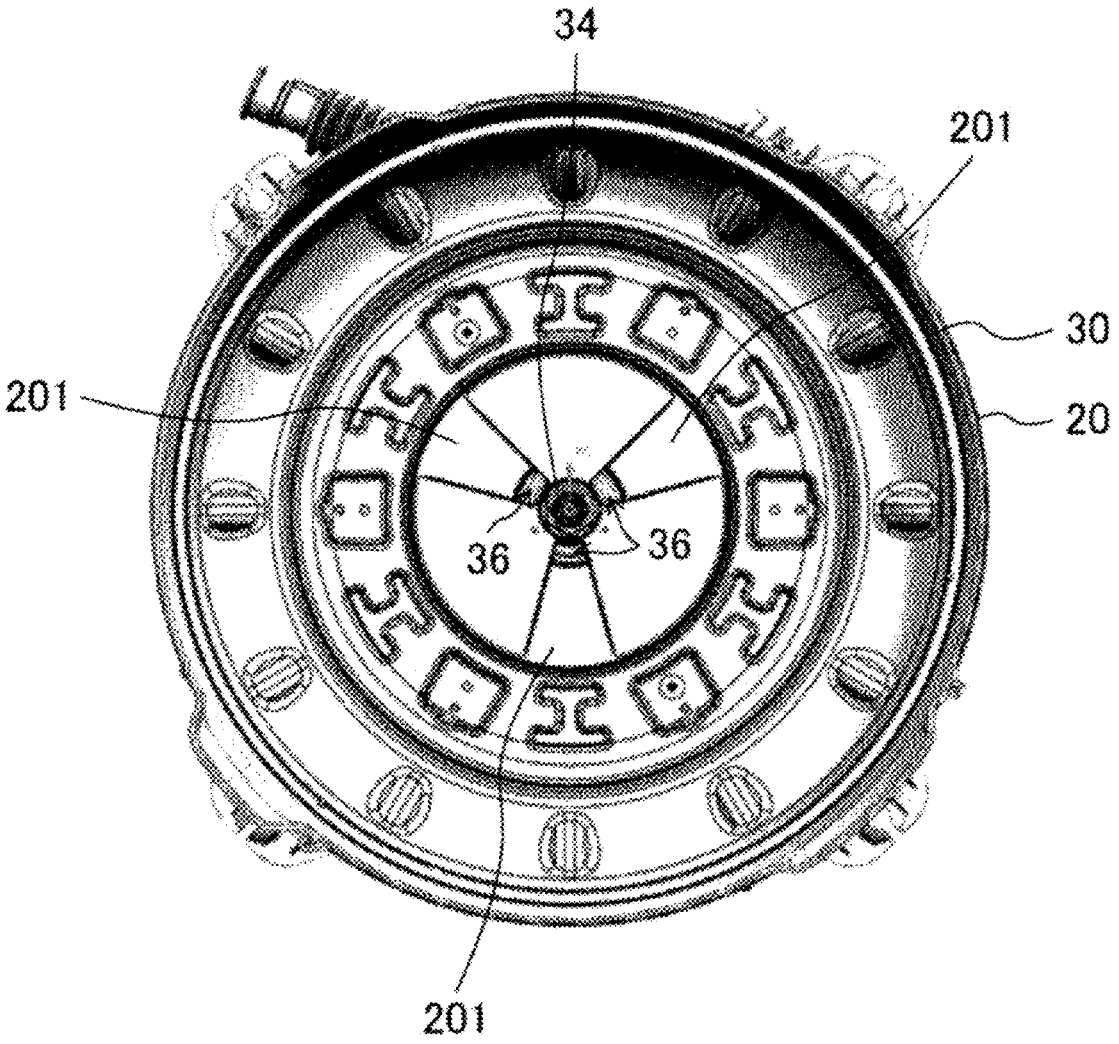
FIG. 31 is a schematic view of a bottom of a rotating tub seen from above.

As shown in FIG. 31, on the bottom (the inner surface) of the body member 31, a water guide surface 201 may be inclined downward toward the center from the outer circumference. At the lowest location of the water guide surface 201, the outlets 36 may open. Accordingly, water collected in the rotating tub 30 may be guided in a direction indicated by white arrows of FIG. 27 by the water guide surface 201 to be discharged through the outlets 36 so that no water remains.

Also, a total opening area (a sum of areas of three openings) of the outlets 36 may be greater than or equal to the minimum value of the cross-section area (a cross-sectional area in a direction that is orthogonal to each flow path) of each of flow paths of a rotating side water guide path 90 and a fixing side water guide path 91 to which the outlets 36 open. Accordingly, the outlets 36 may not reduce drainage. Water collected in the rotating tub 30 30 may stably flow downward from the outlets 36.

Below the flange shaft 35, a sealing ring 37 may be disposed, and the shaft hole 37*a* may be formed to penetrate the flange shaft 35 and the sealing ring 37. The shaft unit 80 may extend vertically through the shaft hole 37*a*, and the flange shaft 35 and the sealing ring 37 may be fixed at the body member 31 to pass the second shaft 82 through. In the flange shaft 35 and the sealing ring 37, the through hole 38 may be formed around the shaft hole 37*a*.

The flange shaft 35 and the sealing ring 37 may define the rotating side water guide path 90 below the bottom of the body member 31, wherein the rotating side water guide path 90 may be partitioned. The inside of the rotating tub 30 may communicate with the rotating side water guide path 90 through the outlets 36.

Figure 32:
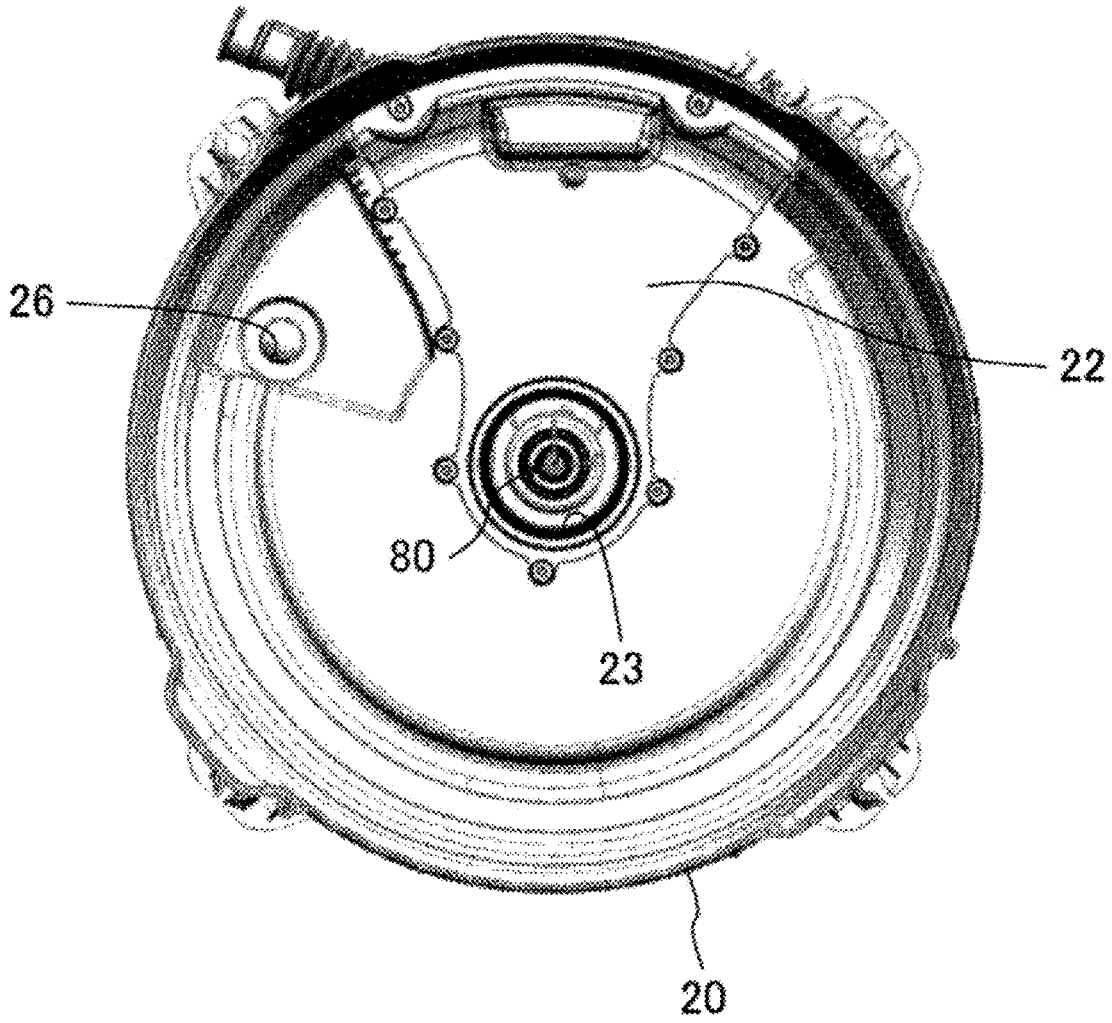
FIG. 32 is a schematic view of a bottom of the water collecting tub seen from above.

As shown in FIG. 32, a partition plate 22 corresponding to the sealing holder 22 may be attached on the bottom (inner bottom) of the water collecting tub 20 to cover the bottom of the water collecting tub 20. By the partition plate 22, the inside space of the bottom of the water collecting tub 20 may be partitioned, and the fixing side water guide path 91 may be formed in the inside space of the bottom. The rotating side water guide path 90 may communicate with the fixing side water guide path 91 through the through hole 38. In the upper center portion of the partition plate 22, the sealing opening 23 may be formed to receive the sealing ring 37 in a state of being rotatable. An oil seal 23*a* may be disposed between the sealing ring 37 and the sealing opening 23 to seal up a space between the sealing ring 37 and the sealing opening 23. The fixing side water guide path 91 will be described in detail, later.

On the other surface of the bottom of the water collecting tub 20, the driver 50 may be installed. Also, on the bottom of the water collecting tub 20, the acceleration sensor 25 may be installed to detect an amount of shaking of the water collecting tub 20 and output the detected amount of shaking to the controller 60. The driver 50 according to the current embodiment may include a motor 202 in which an inner rotor 202*a* and an outer rotor 202*b* are respectively disposed in the inside and outside of a single stator 202*c* to be rotatable independently, as shown in FIG. 26. Driving of the motor 202 may be controlled by the controller 60. In the driver 50, the rotation sensor 53 may be installed to detect the RPM of the motor 202 and output the detected RPM to the controller 60.

The shaft unit 80 protruding from the bottom of the water collecting tub 20 may be connected to the motor 202. More specifically, the first shaft 81 may be connected to the outer rotor 202*b*, and the second shaft 82 may be connected to the inner rotor 202*a*. The controller 60 may control complex current that is supplied to the stator 202*c*, to thereby switch between a first state in which the first shaft 81 and the second shaft 82 rotate synchronously in the same direction and a second state in which only the first shaft 81 rotates.

Accordingly, in a dehydrating operation among operations that are performed during washing, the controller 60 may set the first state to rotate the rotating tub 30 and the pulsator 40 in the same direction. In a washing operation or a rinsing operation, the controller 60 may set the second state to rotate the pulsator 40 forward and backward without rotating the rotating tub 30. However, in the washing operation, the rotating tub 30 and the pulsator 40 may rotate simultaneously in different directions. That is, the rotating tub 30 and the pulsator 40 may rotate in various ways.

(Drain Path)

As shown in FIG. 24, in the bottom of the water collecting tub 20, the first drain hole 26, the second drain hole 27, and a third drain hole 211 (a drain hole for circulation) may be formed, wherein the first drain hole 26 opens to the inside space of the water collecting tub 20, the second drain hole 2 opens to the fixing side water guide path 91, and the third drain hole 211 communicates with a circulation path 210 which will be described later (see FIG. 33). The second drain hole 27 and the third drain hole 211 may be formed in the lower inner surface of the fixing side water guide path 91 to open to the inside space of the fixing side water guide path 91. Accordingly, the second drain hole 27 and the third drain hole 211 may communicate with the outlets 36 through the fixing side water guide path 91, the through hole 38, and the rotating side water guide path 90. Accordingly, water collected in the rotating tub 30 may be introduced to the fixing side water guide path 91 through the outlets 36 and the rotating side water guide path 90, as indicated by the white arrows of FIG. 27 by the water guide surface 201 to be discharged through any one of the second drain hole 27 or the third drain hole 211.

In the lower space of the housing 10, the pipe (the third path 94) extending along the bottom of the housing 10 inside the housing 10 may be installed, wherein the end (the hose connecting port 94*a*) of the third path 94 may protrude to the outside from the rear surface of the housing 10. On the third path 94, the drain pump 150 may be installed. The drain pump 150 may be driven by the control of the controller 60. A drain hose 96 may be connected to the hose connecting port 94*a* integrated into the drain pump 150, wherein the drain hose 96 may extend to a higher location than a predetermined level (generally, the upper limit of storage of the water collecting tub 20) of water collected in the water collecting tub 20.

Accordingly, the washing machine 1G cannot perform natural drainage in which water flows downward, and may forcedly drain water using the drain pump 150. Also, a part of the third path 94 located upstream from the drain pump 150 may be connected to the lower ends of the first and second paths 92 and 93. More specifically, the second path 93 and the first path 92 may be connected in this order from upstream to the third path 94 in such a way to be in parallel to the third path 94, and the drain pump 150 may be installed downstream from the junction of the first and second paths 92 and 93.

Accordingly, water collected in the rotating tub 30 may be drained from the outlets 36 through the rotating side water guide path 90, the fixing side water guide path 91, the second path 93, and the third path 94. Also, water collected in the water collecting tub 20 may be drained from the first drain hole 26 through the first path 92 and the third path 94.

Therefore, water collected in the rotating tub 30 or the water collecting tub 20 may be drained independently, and the two drain paths 92 and 93 may be located upstream from the drain pump 150. Stable drainage may be possible through the drain paths 92 and 93 in which forced drainage is performed by the drain pump 150.

(Stop Structure)

The washing machine 1G may include a stop structure composed of a combination of the stop valve 100 and the drain pump 150 on the drain path in order to stably collect water in the rotating tub 30 with a simple structure. The stop valve 100 may be installed on the first path 92. The stop valve 100 may be installed on the first path 92, and opened and closed according to a drain state. The stop valve 100 may be a motor-driven opening and shutting valve that is controlled by a controller, or a float type opening and shutting valve that operates nonelectrically according to a drain state.

(Circulation Path)

As shown in FIG. 24, a circulation path 210 for circulating water collected in the rotating tub 30 may extend upward along the circumferential surface of the water collecting tub 20. The third drain hole 211 may be connected to an end (lower end) of the circulation path 210. As shown in FIG. 29, a circulation pump 212 may be formed on the other surface of the bottom of the water collecting tub 20. Driving of the circulation pump 212 may be controlled by the controller 60. The circulation pump 212 may be disposed on the circulation path 210. At a top end of the circulation path 210, an outlet 213 may be formed to return water to the inside of the body member 31 through the opening of the body member 31.

Figure 30:
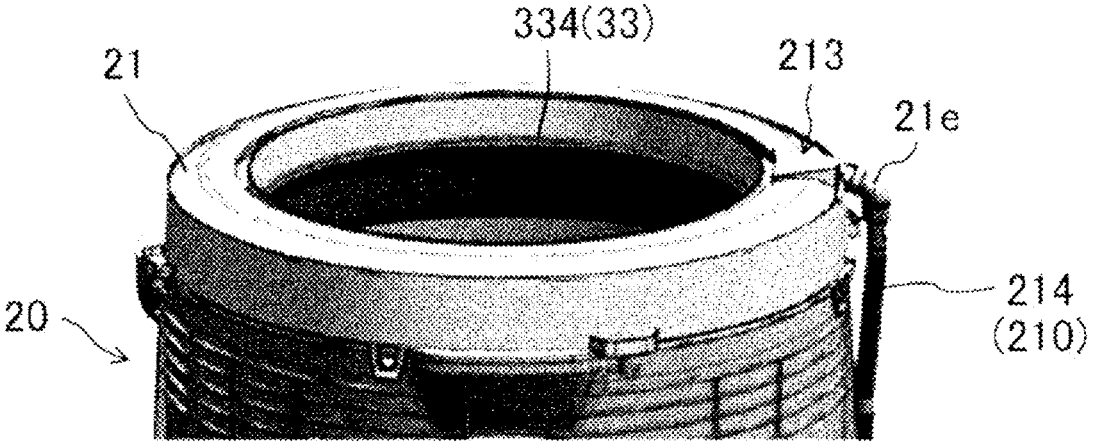
FIG. 30 is a schematic perspective view showing a top of the water collecting tub.

As shown in FIG. 30, the outlet 213 may be integrated into the tub cover 21 mounted on the water collecting tub 20. The circulation pump 212 may be connected to the outlet 213 through a hose member 214. Since the outlet 213 of the circulation path 210 is integrated into the water collecting tub 20, the positional relation between the outlet 213 and the opening of the body member 31 may not change although the water collecting tub 20 shakes. Accordingly, it may be possible to stably return circulating water to the inside of the body member 31.

A lower end of the circulation path 210 may be connected to the third drain hole 211 through a connection member 215 functioning as both a seal member and a foreign material removing member.

Figure 36:
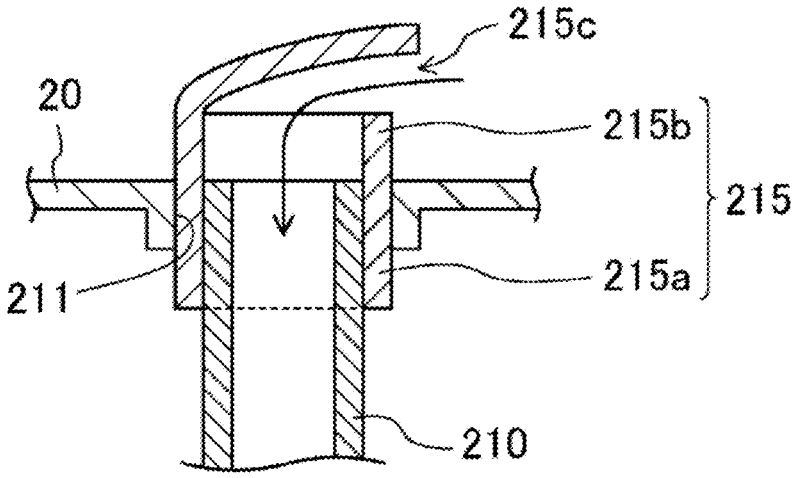
FIG. 36 is a schematic cross-sectional view showing a structure of a drain hole for circulation.

More specifically, as shown in FIG. 36, the connection member 215 may include a connecting portion 215*a* pressed in the third drain hole 211 and closely contacting the third drain hole 211 at the outer surface, and a foreign material cut-off portion 215*b* protruding toward the inside of the fixing side water guide path 91, wherein the lower end of the circulation path 210 may be pressed in the connecting portion 215*a* and the inner surface of the connecting portion 215*a* closely contacts the lower end of the circulation path 210.

Since the connecting portion 215*a* closely contacts the lower end of the circulation path 210 and the third drain hole 211, a gap between the circulation path 210 and the third drain hole 211 may be sealed up. Also, since the foreign material cut-off portion 215*b* protrudes toward the inside of the fixing side water guide path 91, a restricting wall for preventing foreign materials such as buttons from entering the third drain hole 211 may be formed. Accordingly, it may be possible to prevent foreign materials from entering the circulation pump 212. Water may flow to the third drain hole 211 through a slit 215*c* opening to the side of the foreign material cut-off portion 215*b*.

(Fixing Side Water Guide Path)

The cross-section of the fixing side water guide path 91 may spread along the bottom of the water collecting tub 20 in order to efficiently heat circulating water with a compact configuration.

Figure 33:
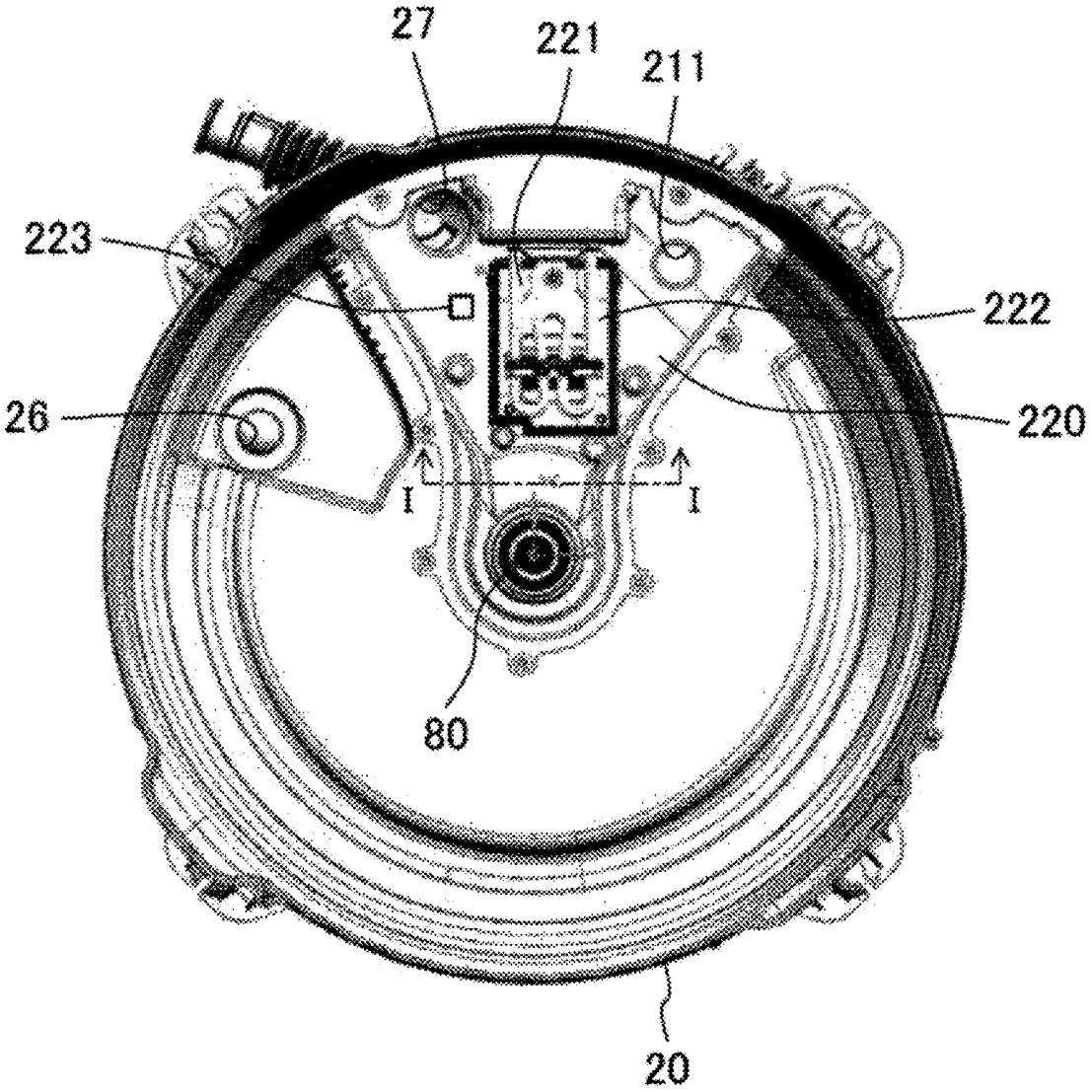
FIG. 33 is a schematic view of the bottom of the water collecting tub seen from above, when a partition plate is removed.
Figure 34:
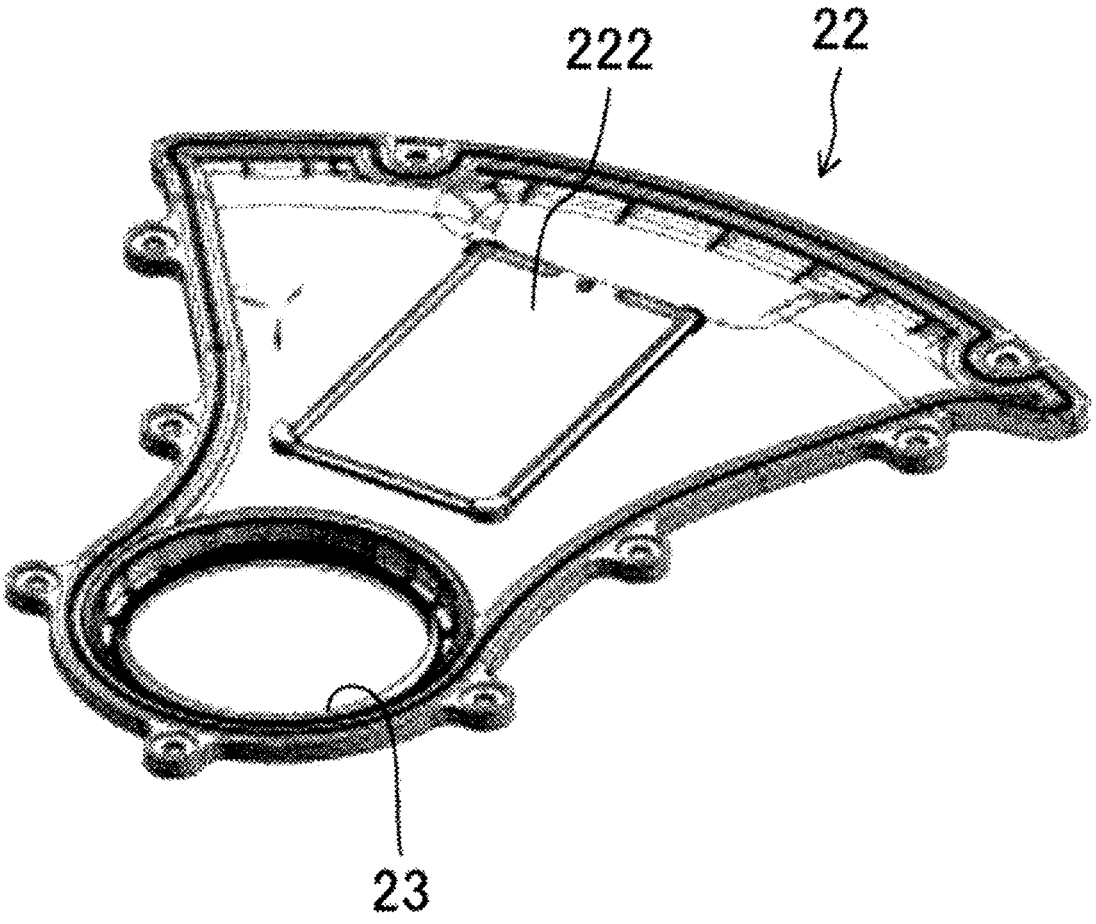
FIG. 34 is a schematic perspective view of the partition plate seen from an inner surface side.
Figure 35:
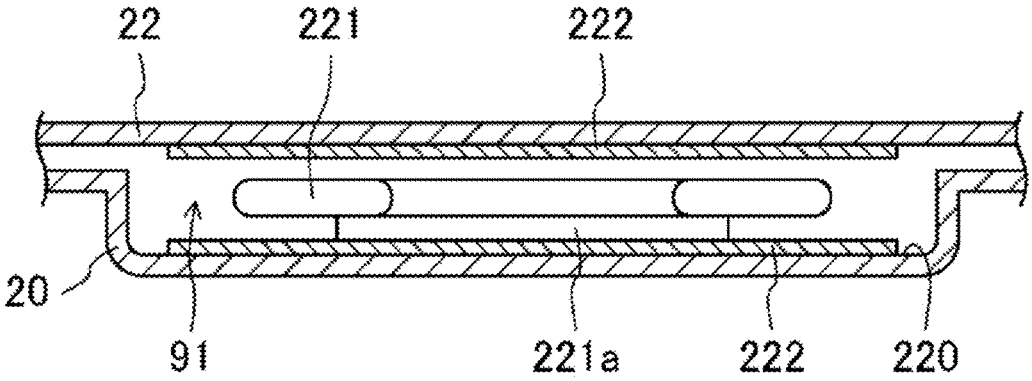
FIG. 35 is a cross-sectional view of the bottom of the water collecting tub shown in FIG. 33, taken along an arrow line I-I.

More specifically, as shown in FIGS. 26, 33, and 35, a wide-width concave portion 220 may be formed in the bottom of the water collecting tub 20. The wide-width concave portion 220 may be formed as a small Y-shaped recess (as seen in the vertical-axis direction) in a predetermined area ranged from the center of the water collecting tub 20. Since the partition plate 22 shown in FIG. 34 is installed on the bottom of the water collecting tub 20, the wide-width concave portion 220 may be covered from above to define the fixing side water guide path 91 in the bottom of the water collecting tub 20, as shown in FIG. 32.

As shown in FIG. 33, the second drain hole 27 and the third drain hole 211 may be disposed in the lower surface (configuring the lower inner surface of the fixed SIDE water guide path 91) of the wide-width concave portion 220 to be spaced at both sides in the circumferential direction. As shown in FIG. 32, the sealing opening 23 may be formed in the center of the inner surface (configuring the upper inner surface of the fixing side water guide path 91) of the partition plate 22, and water may flow to the fixing side water guide path 91 through the rotating side water guide path 90 formed in the inside of the sealing opening 23. Accordingly, in the fixing side water guide path 91, a flow toward the circumferential direction from the center in the diameter direction may be formed. The fixing side water guide path 91 may be formed such that the cross section of the flow path spreads thinly along the bottom of the water collecting tub 20.

By using the wide bottom of the water collecting tub 20, a wide, thin cross-section of a flow path may be obtained. Since the fixing side water guide path 91 is formed with a thin thickness along the bottom of the water collecting tub 20, there may be no space waste. Accordingly, it may be possible to increase the capacity of the water collecting tub 20 or the rotating tub 30 with respect to the housing 10, and to achieve a compact size.

In the inside of the fixed side water guide path 91, a heater 221 may spread (extend along the inside space of the fixing side water guide path 91), wherein the operation of the heater 221 is controlled by the controller 60. The heater 221 may be configured by bending a heating element formed in the shape of a micro channel repeatedly and then flattening it so as to be efficiently accommodated in a wide narrow space. The heater 221 may be supported by a support member 221*a* to be positioned in the center of the fixing side water guide path 91, while being spaced from the lower surface of the wide-width concave portion 220 and the partition plate 22.

On the lower surface of the wide-width concave portion 220 and the inner surface of the partition plate 22, insulation plates 222 made of a metal may be disposed to be opposite to the heater 221. The insulation plates 222 may be made of stainless steel to be rust resistant, to suppress radiation loss, and to obtain excellent warmth preserving. The insulation plates 222 may prevent the partition plate 22 from being heated excessively, thereby preventing the partition plate 22 which may be made of a synthetic resin from being deformed. A water temperature sensor 223 for measuring water temperature and outputting the measurement result to the controller 60 may be installed around the heater 221.

As such, since the heater 221 spreads widely in the inside of the thin flow path, circulating water may be efficiently heated in the small space. That is, the heater 221 may heat a small amount of water to high temperature in a short time.

(Interworking Control Circuit)

The washing machine 1G may include a circuit configuration for preventing empty heating of the heater 221. A circuit for controlling driving of the circulation pump 212 and heating of the heater 221 may be provided independently from the control of the controller 60 to interwork with driving of the heater 221 and driving of the circulation pump 212, such that the circulation pump 212 operates necessarily when the heater 221 is heated (interworking control circuit 230).

Figure 37:
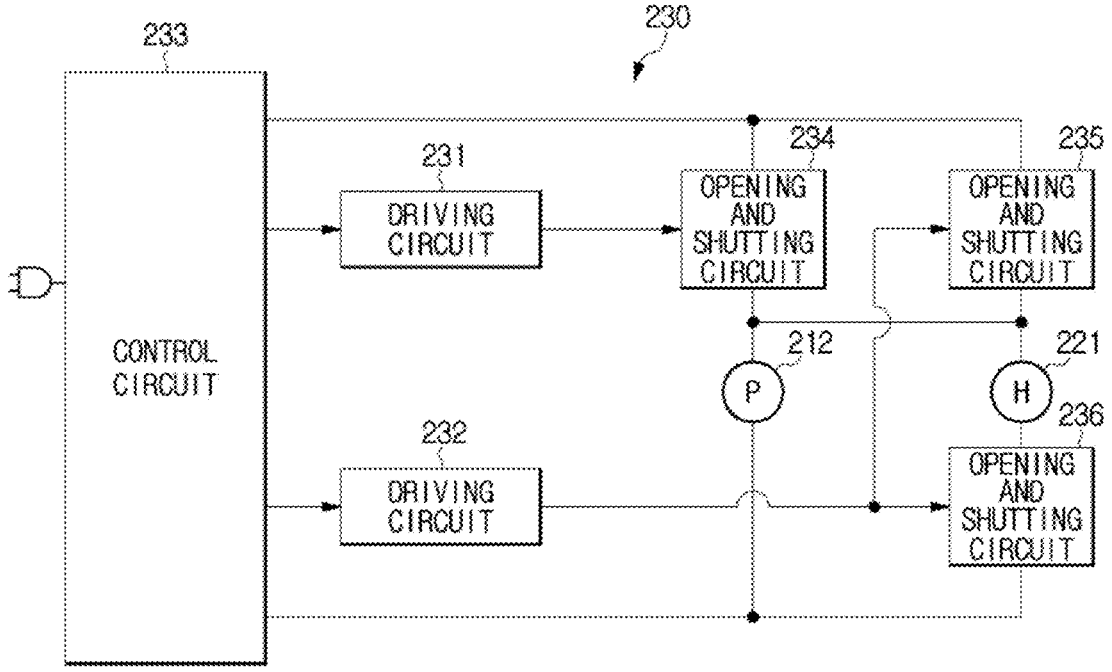
FIG. 37 is a block diagram of an interlock control circuit.

In FIG. 37, the interworking control circuit 230 is shown. As shown in FIG. 28, the controller 60 may be connected to the circulation pump 212 through the driving circuit 61, and also connected to the heater 221 through the driving circuit 62. The controller 60 may include a control circuit 233 for controlling first and second driving circuits 231 and 232 in the driving circuits 61 and 62, and the control circuit 233 may open and close the driving circuits 231 and 232 to control driving of the circulation pump 212 and heating of the heater 221.

The interworking control circuit 230 may include first to third opening and shutting circuits 234, 235, and 236. Each of the driving circuits 231 and 232 and the opening and shutting circuits 234, 235, and 236 may be opened when no current is applied (normal open).

The control circuit 233 may be electrically connected to the circulation pump 212 through the first opening and shutting circuit 234. The first opening and shutting circuit 234 may be closed when the first driving circuit 231 is closed. When the control circuit 233 closes the first driving circuit 231, power may be supplied to the circulation pump 212 to drive the circulation pump 212.

The control circuit 233 may also be electrically connected to the heater 221 through the second opening and shutting circuit 235 and the third opening and shutting circuit 236 respectively disposed at an input side line and an output side line of the power. The second opening and shutting circuit 235 and the third opening and shutting circuit 236 may be closed when the second driving circuit 232 is closed. The circulation pump 212 may be electrically connected to the first opening and shutting circuit 234, and the second opening and shutting circuit 235 may be electrically connected to the heater 221.

When the control circuit 233 closes the second driving circuit 232, and the second opening and shutting circuit 235 and the third opening and shutting circuit 236 are closed, power may be supplied to the heater 221 so that the heater 221 emits heat. Since the second opening and shutting circuit 235 is closed, power may be supplied to the circulation pump 212 although the first opening and shutting circuit 234 is not closed (although driving control of the circulation pump 212 is performed) so that the circulation pump 212 may be driven. That is, when the heater 221 is heated, the circulation pump 212 may be driven necessarily.

Also, when the circulation pump 212 is not driven, the heater 221 may be not heated.

Figure 38:
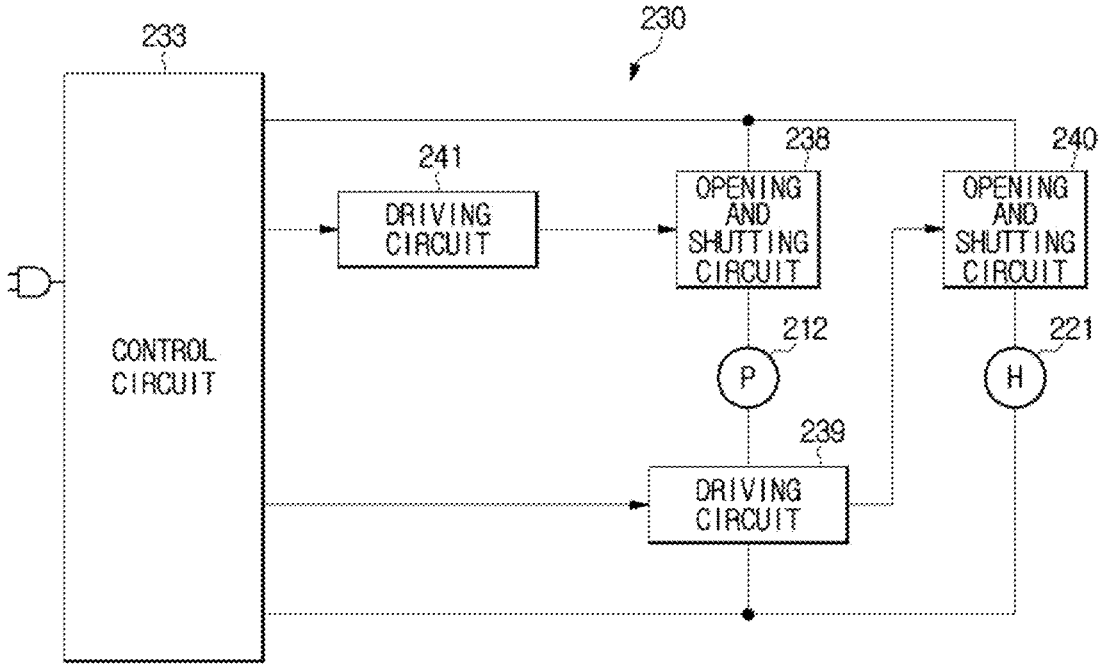
FIG. 38 is a block diagram of another interlock control circuit.

In FIG. 38, a configuration of the interworking control circuit 230 is shown. The interworking control circuit 230 may include a fourth opening and shutting circuit 238, a third driving circuit 239, a fifth opening and shutting circuit 240, and a fourth driving circuit 241 (all of them are normal open).

The control circuit 233 may also be electrically connected to the circulation pump 212 through the fourth opening and shutting circuit 238 and the third driving circuit 239 respectively disposed at an input side line and an output side line of the power. The control circuit 233 may also be electrically connected to the heater 221 through the fifth opening and shutting circuit 240. The fifth opening and shutting circuit 240 may be closed when the third driving circuit 239 is closed. The third driving circuit 239 may include a relay that is closed when power is supplied to the circulation pump 212, and if no power is supplied to the circulation pump 212, no current may be supplied to the fifth opening and shutting circuit 240 although the control circuit 233 closes the third driving circuit 239.

When the control circuit 233 closes the fourth driving circuit 241, the fourth opening and shutting circuit 238 may be closed to supply power to the circulation pump 212 so that the circulation pump 212 may be driven. Meanwhile, if no power is supplied to the circulation pump 212 although the control circuit 233 closes the third driving circuit 239, the fifth opening and shutting circuit 240 may be not closed, and the heater 221 may be not heated. When power is supplied to the circulation pump 212, the relay installed in the third driving circuit 239 may be closed to supply current to the fifth opening and shutting circuit 240, and the fifth opening and shutting circuit 240 may be closed so that the heater 221 emits heat.

<Driving of Washing Machine 1G>

A main driving operation of the washing machine 1G will be described below. A basic driving operation of the washing machine 1G may be the same as that of the washing machine 1C (type having a drain pump) described above. Briefly, after laundry and a detergent are put, the cover 13 may be locked, and the controller 60 may perform a series of processes based on a user's instruction. Hereinafter, a drain structure for a washing operation configuring each washing course will be briefly described, and mechanism of heating and circulating water in the rotating tub 30 will be described in detail.

When a washing operation starts, the controller 60 may open the water supply valve 72. Accordingly, tap water (also referred to as water) may enter the water supply 70 to be supplied to the rotating tub 30. At this time, a detergent may be supplied to the rotating tub 30 together with the water. Since the drain hose 96 extends to a higher location than the level of water of the water collecting tub 20, the supplied water may be not drained. Therefore, when the water levels of the rotating tub 30 and the vent pipe 29*a* reach a predetermined water level, the controller 60 may stop supplying water based on a detection value of the water level sensor 29.

The controller 60 may control the driver 50, and switch the switch 52 to the second connection state. Then, the controller 60 may drive the motor 202 based on a detection value of the rotation sensor 53 to rotate the pulsator 40 forward and backward for a predetermined time period, without rotating the rotating tub 30. Thereby, a washing process may be performed. When the washing process terminates, a drainage process may be performed. The controller 60 may drive the drain pump 150 sequentially or intermittently for a predetermined time period according to the result of detection by the water level sensor 29. Accordingly, water collected in the rotating tub 30 may be forcedly drained. A rinsing operation may be performed by the same control as that applied to the washing operation.

When a dehydrating operation starts, the controller 60 may control the driver 50, and perform switching to the first connection state so that the rotating tub 30 and the pulsator 40 rotate together. Thereby, the controller 60 may drive the motor 202 to rotate the rotating tub 30, etc. at higher speed than during the washing operation or the rinsing operation. Accordingly, water included in laundry may rise along the inner surface of the body member 31 by a centrifugal force to overflow from the dehydrating holes 32. The water overflowing from the dehydrating holes 32 may fall to the bottom of the water collecting tub 20, and then be forcedly drained by driving of the drain pump 150 through the first drain hole 26, the first path (the stop valve 100 is in an opened state) 92, and the third path 94.

When a predetermined time period has elapsed, the controller 60 may stop driving the motor 202, and terminate the dehydrating operation. When the dehydrating operation terminates, drive completion may be notified to a user through a buzzer, etc., and simultaneously, the cover 13 may be unlocked to enable the user to take the laundry out of the rotating tub 30.

(Circulating and Heating of Water)

During the washing operation or the rinsing operation described above, washing water or rinsing water may need to be circulated. In this case, a process of heating washing water or rinsing water to create hot water may be performed as necessary. This will be described in detail in regard of an example of a washing operation, below.

Figure 39:
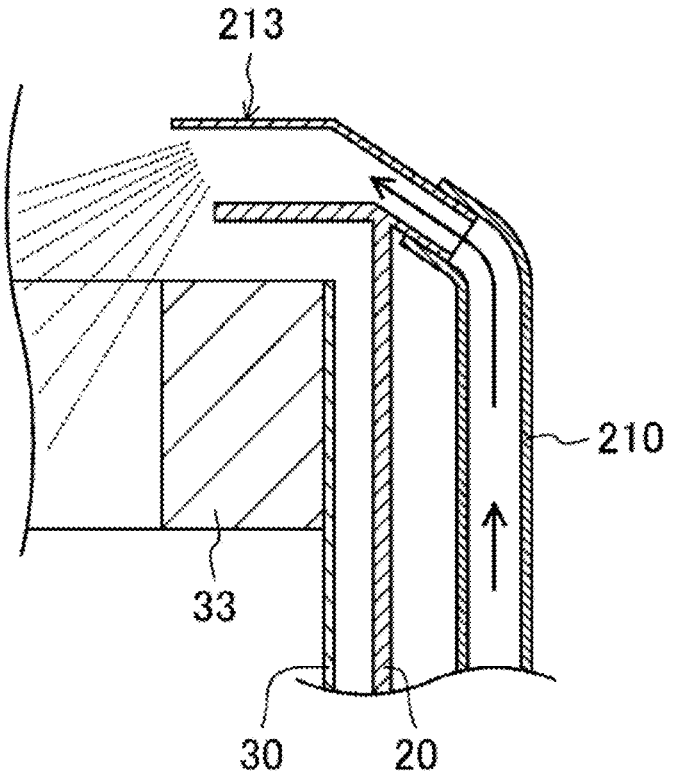
FIG. 39 is a schematic cross-sectional view of an outlet when water circulates.

When a washing operation starts so that the controller 60 stops supplying water, and rotates the pulsator 40 forward and backward, the controller 60 may drive the circulation pump 212. Accordingly, water collected in the rotating tub 30 may be sent to the outlet 213 through the rotating side water guide path 90 or the fixing side water guide path 91 and the circulation path 210, and as shown in FIG. 39, the water may be discharged from the outlet 213 to return to the inside of the rotating tub 30 through the opening of the rotating tub 30.

Since the outlet 213 is integrated into the water collecting tub 20, the position of the outlet 213 will not change although the water collecting tub 20 shakes due to a rotation of the pulsator 40. Therefore, it may be possible to stably return water to the inside of the rotating tub 30.

At this time, the controller 60 may heat the heater 221 to heat the circulating washing water. As described above, since the interworking control circuit 230 is installed, empty heating of the heater 221 may be prevented. The controller 60 may heat the heater 221 based on a detection value from the water temperature sensor 223 until the temperature of the circulating washing water reaches predetermined temperature (for example, the predetermined temperature is set according to the kind of laundry, the ingredients of contaminants, etc.). Accordingly, an excellent washing effect may be obtained.

Heating of the heater 221 may be performed simultaneously or alternately with driving of the driver 50. When heating of the heater 221 is performed simultaneously with driving of the driver 50, the circulating water may be heated to raise the temperature of the washing water uniformly. Heating of the heater 221 or driving of the driver 50 may require large power. Accordingly, when a supply amount of power is insufficient, that is, when there are difficulties in performing heating of the heater 221 simultaneously with driving of the driver 50, heating of the heater 221 and driving of the driver 50 may be performed alternately for stable driving.

In a rising operation, like the washing operation, rinsing water may be heated to improve a rinsing effect. Also, by raising the temperature of water to a temperature level for heat sterilization, microbes remaining in the rotating tub 30 or the water collecting tub 20 may be cleaned.

<Modification Example>

In the third embodiment, the interworking control circuit 230 is installed to prevent empty heating of the heater. However, for higher stability, a control for preventing empty heating may be performed.

More specifically, a program for causing the controller 60 to heat the heater 221 when the level of water collected in the rotating tub 30 is higher than or equal to a predetermined lower limit value may be installed. Thereby, it may be possible to prevent empty heating of the heater 221, as long as the water level sensor 29 does not break down or operate wrongly.

Also, a pump operation check mechanism may be installed in the circulation pump 212 to detect an operation state of the circulation pump 212 and output the detected operation state to the controller 60. As examples of the pump operation check mechanism, a current sensor for detecting driving current of the circulation pump 212 may be installed to detect a driving state of the circulation pump 212, or a flow sensor may be installed on the circulation path 210 to detect a circulating state of water. Thereby, it may be possible to prevent empty heating of the heater 221 due to a failure of the circulation pump 212.

Also, by performing driving of the circulation pump 212 and heating of the heater 221 independently, instead of installing the interworking control circuit 230, a control based on the temperature of water may be performed.

That is, a program for causing the controller 60 to drive the circulation pump 212 when the temperature of water is higher than or equal to a predetermined setting value, that is, optimal temperature which is target temperature may be installed. Thereby, water in the fixing side water guide path 91 may be first heated by the heater 221, and when the temperature of the water reaches the predetermined setting value, the circulation pump 212 may be driven. Then, the water in the fixing side water guide path 91 may be replaced with new one, and accordingly, the temperature of water may be lowered. When the temperature of water becomes lower than predetermined temperature, driving of the circulation pump 212 may stop. Thereafter, water in the fixing side water guide path 91 may be again heated, and when the temperature of the water reaches the predetermined setting value, the circulation pump 212 may be driven. Since the circulation pump 212 is driven intermittently, power consumption may be suppressed. Also, excessive heating may be suppressed.

Figure 40:
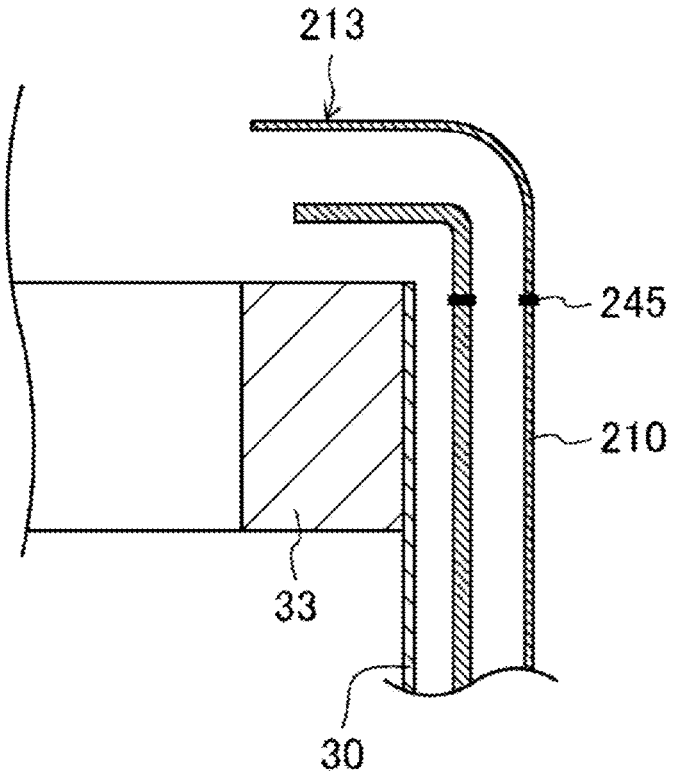
FIG. 40 is a schematic cross-sectional view of a modification example of the outlet.

As shown in FIG. 40, the circulation path 210 may be integrated into the water collecting tub 20. More specifically, in the side of the water collecting tub 20, the circulation pump 210 formed in the shape of a duct may be integrated into the water collecting tub 20. The outlet 213 may be integrated into the tub cover 21 to be connected to the circulation path 210. At the junction, a packing 245 for preventing leakage may be installed, and the cover 21 may be installed in the water collecting tub 20 to thereby connect the outlet 213 to the circulation path 210.

The circulation path 210 may not get out of its position although the water collecting tub 20 is shaking, unlike a connection by the hose member 214.

Also, in the third embodiment, the washing machine of circulating water using the circulation pump 212 is shown. However, the washing machine may circulate water using the pulsator 40.

Figure 41:
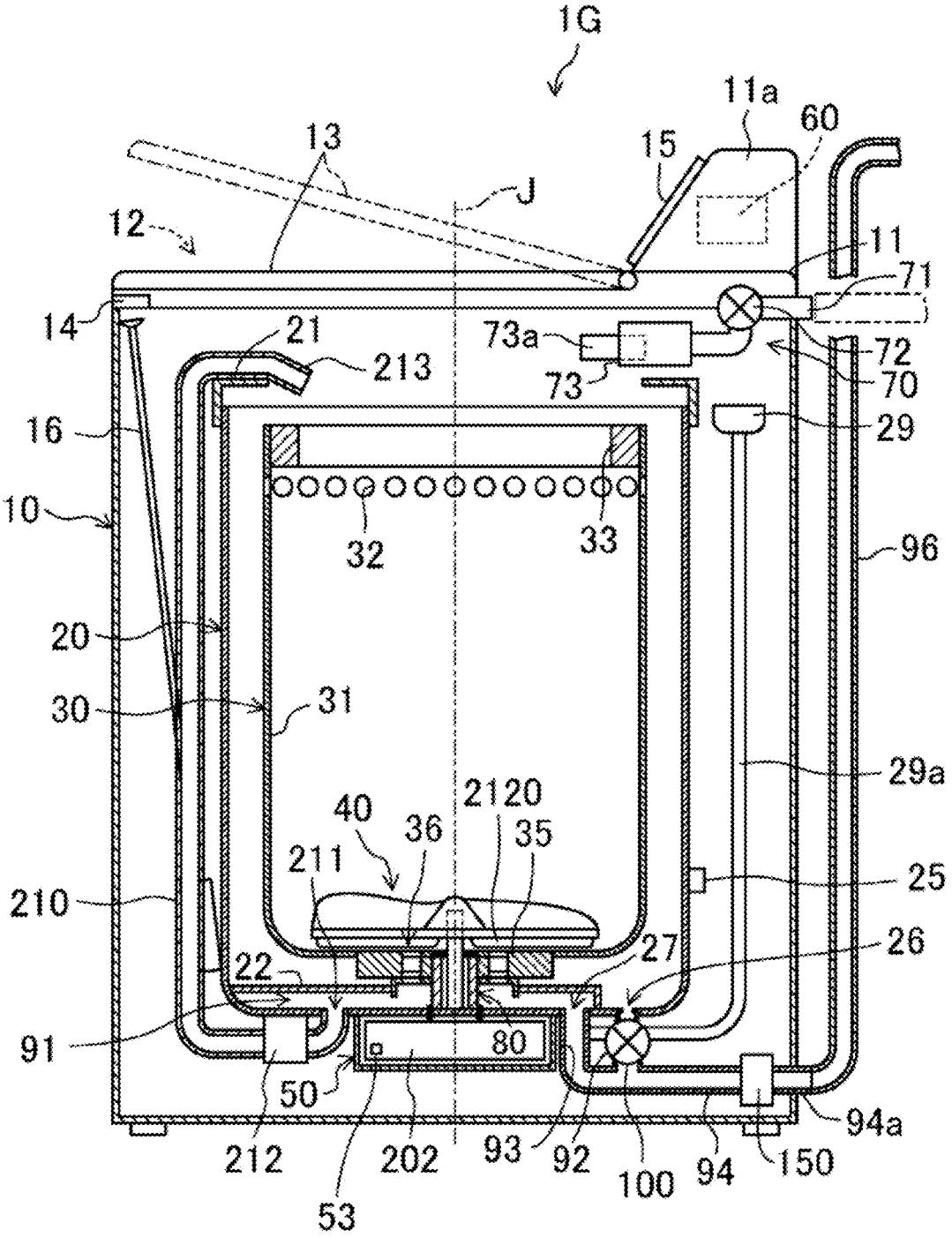
FIG. 41 is a schematic view showing an application example of a washing machine.

In FIG. 41, an example is shown. On the other surface of the pulsator 40, a plurality of rear blades 2120 may be formed radially. In this case, when the pulsator 40 rotates, water around the other surface of the pulsator 40 may be extruded outward in the diameter direction by the influence of the rear blades 2120. Thereby, in the center of the other surface of the pulsator 40, pressure may be lowered. As a result, water in the fixing side water guide path 91 or the rotating side water guide path 90 may be drawn to enter the inside of the rotating tub 30 through the outlet 36.

Accordingly, by rotating the pulsator 40 in addition to circulation of water by the circulation pump 212, water in the rotating tub 30 may be heated and circulated. In this case, the circulation pump 212 or the circulation path 210 may be omitted.

Also, the third embodiment relates to the washing machine including the drain pump, however, the third technique may be applied to a washing machine including no drain pump, that is, a washing machine that performs natural drainage in which water flows downward. <Fourth Embodiment>

Figure 42:
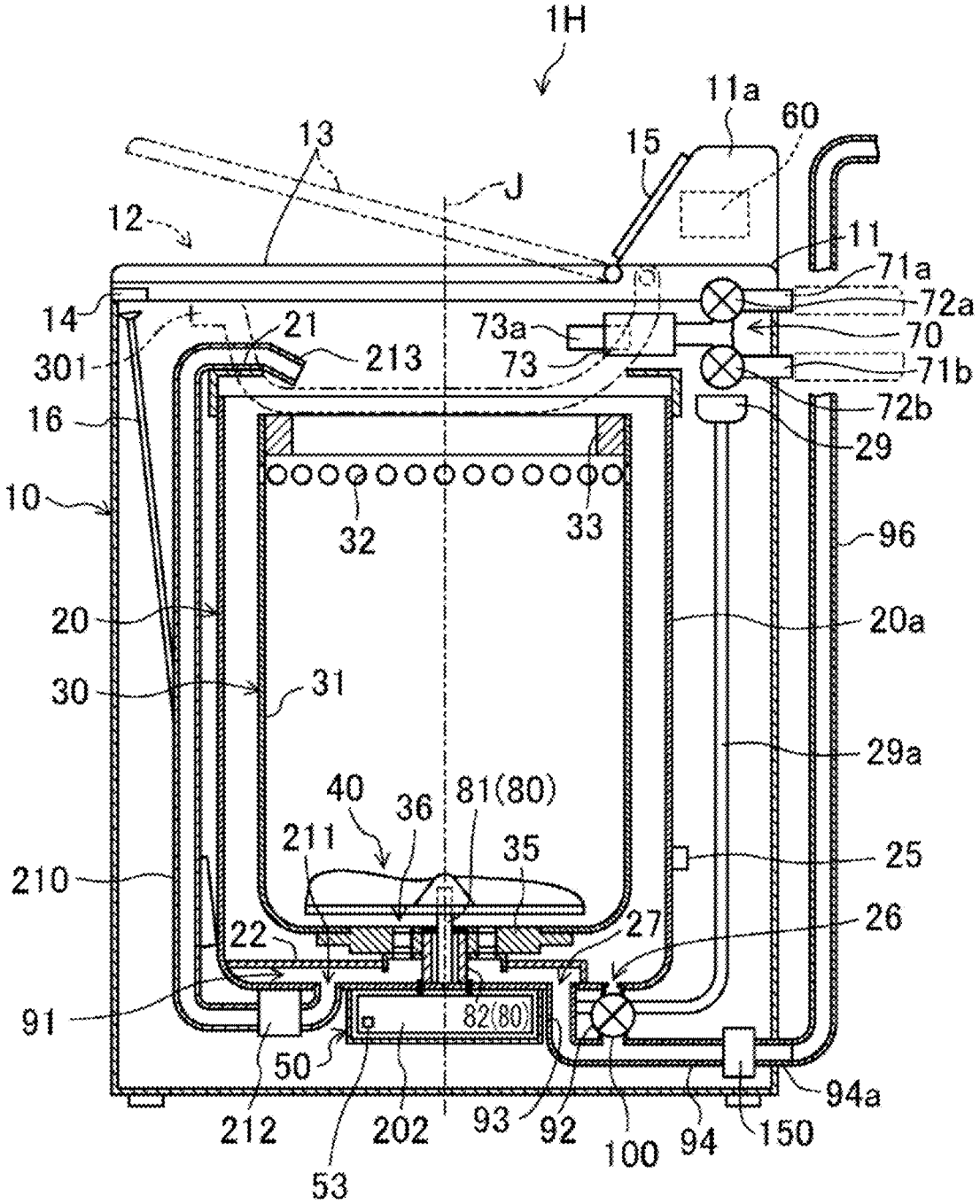
FIG. 42 is a schematic cross-sectional view showing an entire structure of a washing machine according to a fourth embodiment.
Figure 43:
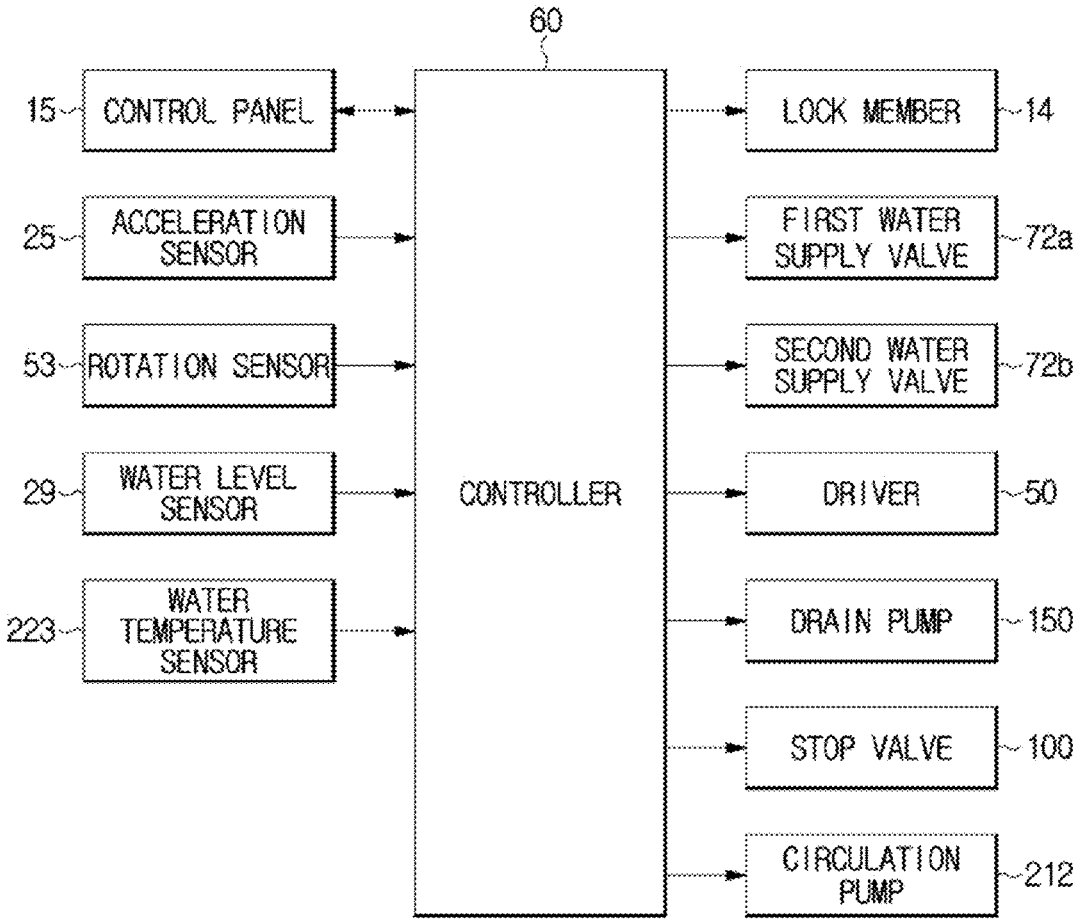
FIG. 43 is a block diagram of a controller and main input/output devices.

In FIG. 42, a washing machine 1H according to a fourth embodiment is shown. In FIG. 43, a relationship between the controller 60, main input devices, and main output devices of the washing machine 1H is shown. A basic configuration of the washing machine 1H including the housing 10, the water collecting tub 20, the rotating tub 30, the pulsator 40, the driver 50, etc. may be the same as that of the washing machine 1G. Accordingly, the same components as those of the washing machine 1G will be assigned the same reference numerals, and detailed descriptions thereof will be omitted. Hereinafter, a difference in structure between the washing machine 1H and the washing machine 1G will be described.

In the inside of the cover 13 of the top cover 11, a hand-washing container member 301 may be installed to hand-wash a small amount of laundry, as shown by imaginary lines in FIG. 42, wherein the hand-washing container member 301 may be shakable. When the hand-washing container member 301 bounds backward together with the cover 13, the inlet 12 may open to enable a user to put laundry in the rotating tub 30.

The water supply 70 may include a first water supply connecting pipe 71*a*, a second water supply connecting pipe 71*b*, a first water supply valve 72*a*, a second water supply valve 72*b*, and a water feeding case 73. The upstream ends of the first water supply connecting pipe 71*a* and the second water supply connecting pipe 71*b* may protrude to the outside of the housing 10, and a tap, a hot water supply, etc. which is a water supply source may be connected to the first water supply connecting pipe 71*a* and the second water supply connecting pipe 71*b* through a hose, etc. In the first water supply connecting pipe 71*a* and the second water supply connecting pipe 71*b*, a first water supply valve 72*a* and a second water supply valve 72*b* may be installed respectively which are opened or closed by the controller 60. The downstream ends of the first water supply connecting pipe 71*a* and the second water supply connecting pipe 71*b* may be connected to the water feeding case 73.

As shown in FIG. 29 described above, the water collecting tub 20 may have a tub main body 20*a* formed in the shape of a cylinder having a bottom to store water, and a tub cover 21 disposed at the top of the tub main body 20*a*. The tub cover 21 will be described later. The water collecting tub 20 may be suspended by the plurality of suspensions 16 to be elastically supported in the inside of the housing 10 such that the water collecting tub 20 is shakable. In the center of the bottom of the body member 31, the first shaft 81 extending along the vertical axis J may protrude to the inside of the body member 31. The pulsator 40 may be fixed at a protruding end of the first shaft 81.

Also, the drain path, the stop structure, and the circulation path of the washing machine 1H may be the same as the corresponding ones of the washing machine 1G.

(Tub Cover)

Figure 45:
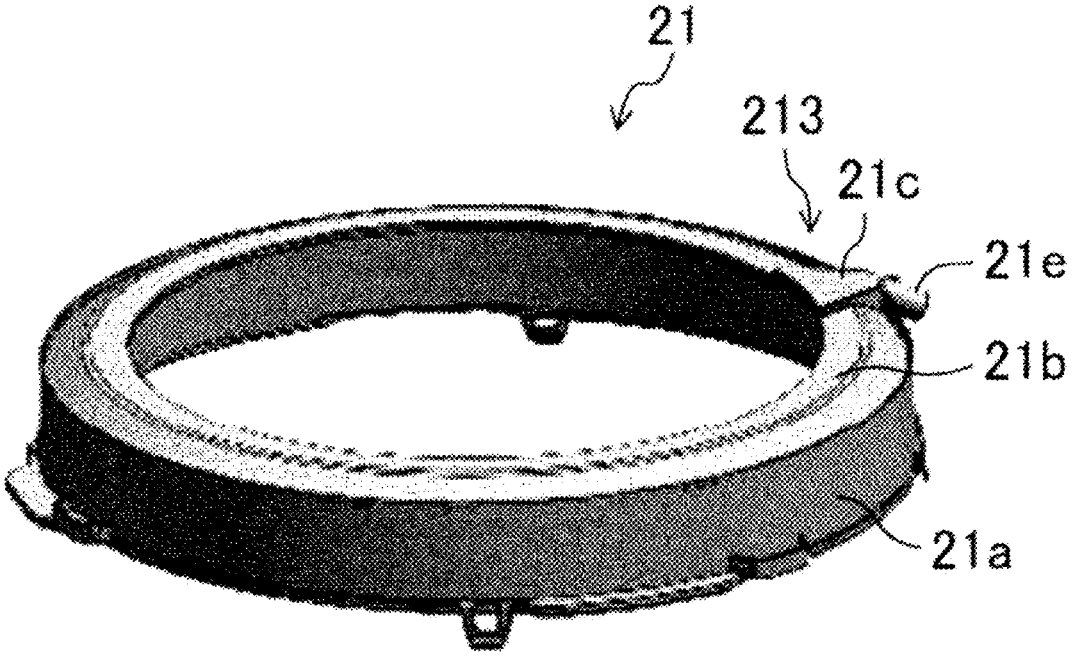
FIG. 45 is a schematic perspective view of a tub cover seen from above.
Figure 46:
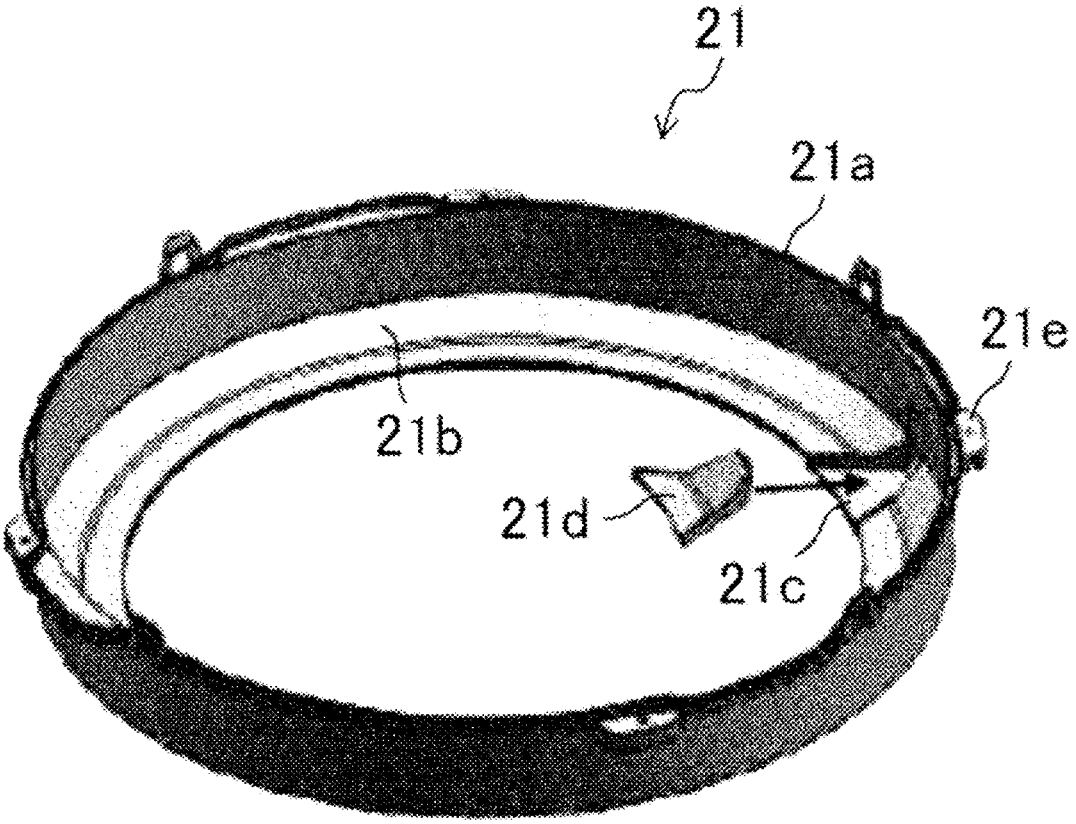
FIG. 46 is a schematic perspective view of the tub cover seen from below.

In FIGS. 45 and 46, the tub cover 21 is shown. The tub cover 21 may be a member formed in the shape of a ring frame. The tub cover 21 may include a wall portion 21*a* formed in the shape of a cylinder, and a flange portion 21*b* protruding inward in the diameter direction from the upper edge of the wall portion 21*a* to form an annular shape. In a part of the flange portion 21*b*, an inlet structure 21*c* may be formed in a V shape spreading inward in the diameter direction. In the inlet structure 21*c*, an inlet structure part 21*d* formed in the shape of a tray spreading in a V shape may be installed so that the outlet 213 may be integrated into the flange portion 21*b*. In a side of the inlet structure 21*c*, a hose connecting portion 21*e* communicating with the outlet 213 may be formed.

Figure 44:
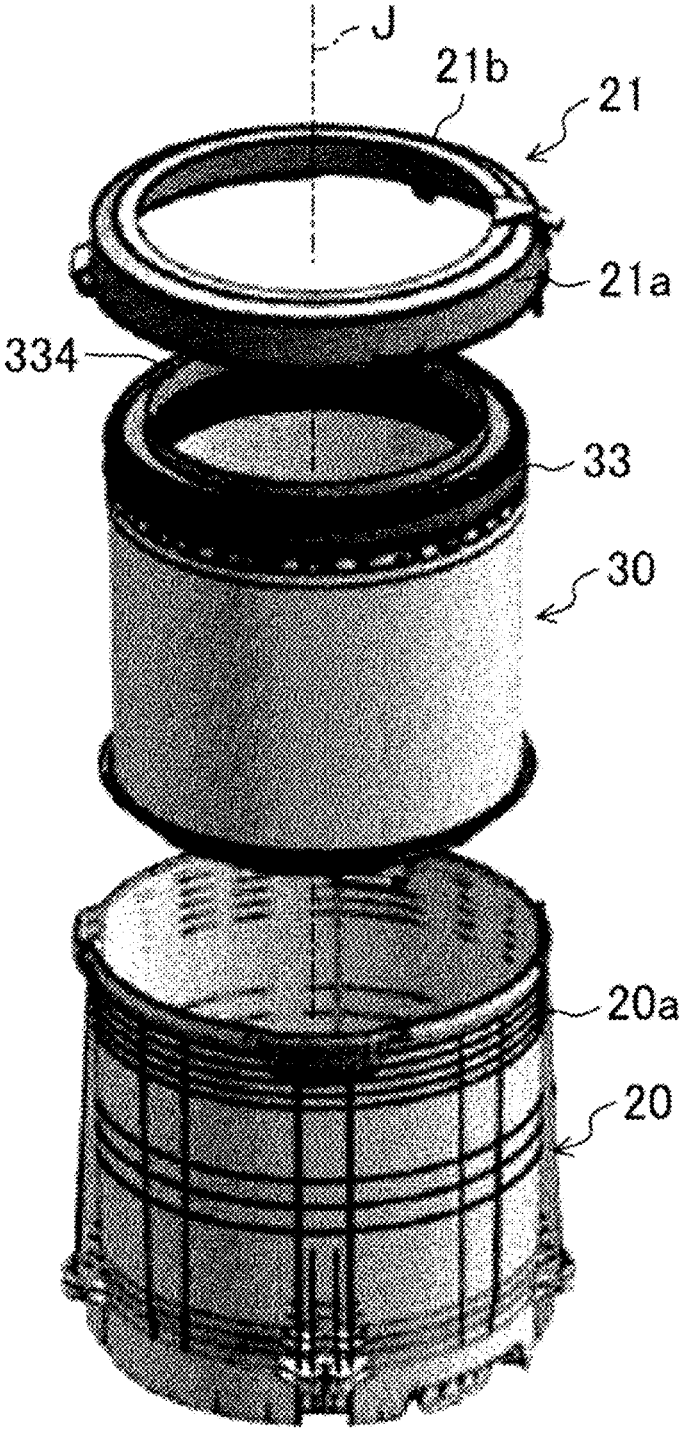
FIG. 44 is an exploded perspective view showing an assembly of a water collecting tub and a rotating tub.

As shown in FIG. 44, in the state in which the rotating tub 30 is accommodated in the tub main body 20*a*, the wall portion 21*a* may be fixed at the top of the tub main body 20*a*, and as shown in FIG. 30 described above, the tub cover 21 may be integrated into the tub main body 20*a*. Accordingly, the flange portion 21*b* may protrude upward from the edge of the opening of the body member 31, and a gap (a gap in the diameter direction) between the tub main body 20*a* and the opening of the body member 31 may be covered by the flange portion 21*b*. The circulation pump 212 may be connected to the hose connecting portion 21*e* of the outlet 213 through the hose member 214. The outlet 213 may open toward the center of the body member 31, and when the circulation pump 212 operates so that water is sprinkled from the outlet 213, the water may be sprinkled to spread toward the center of the body member 31.

(Balancer)

Figure 47:
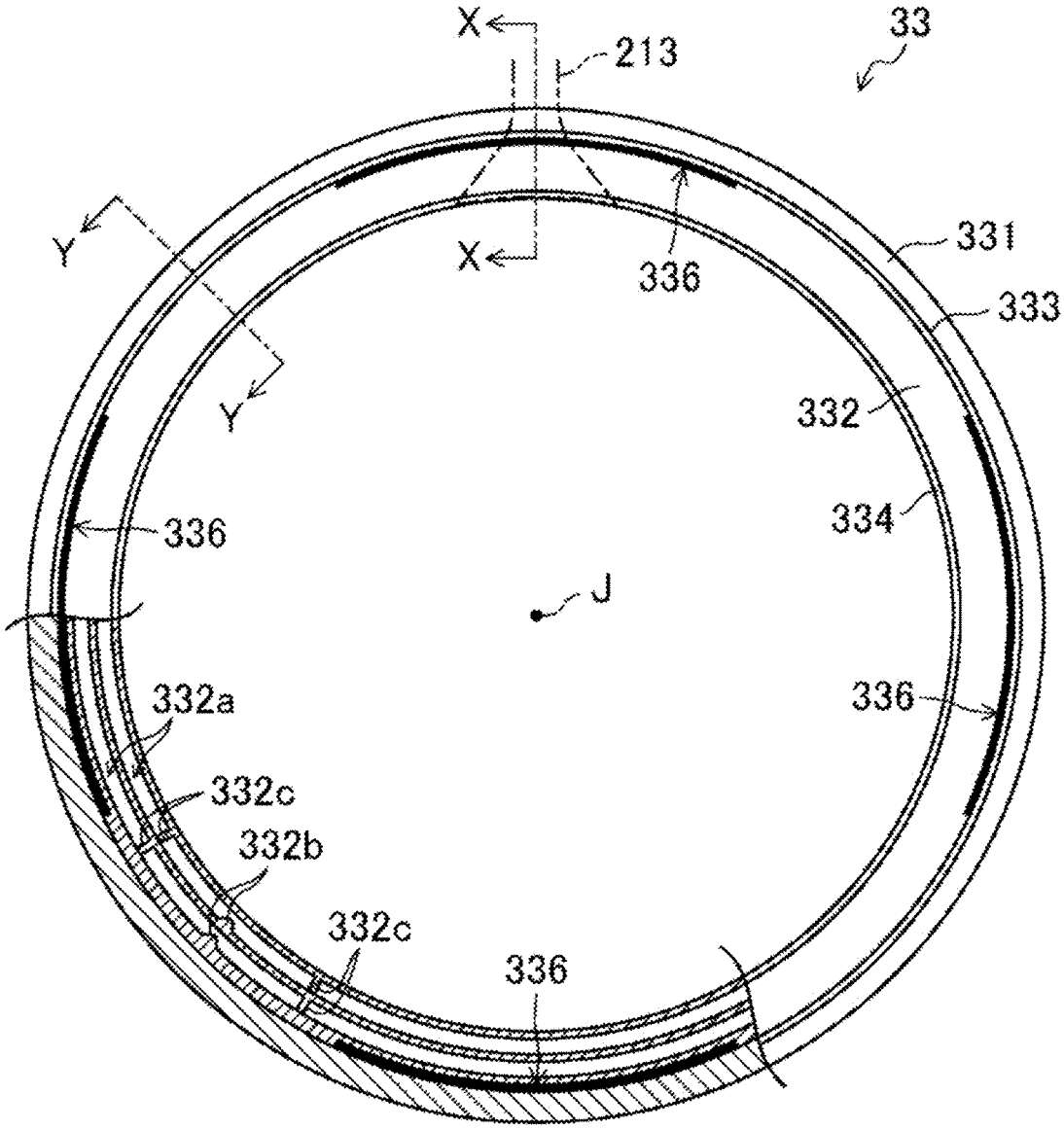
FIG. 47 is a schematic top view of a balancer, wherein a part of the balancer is cut in order to show the inside structure.
Figure 48A:
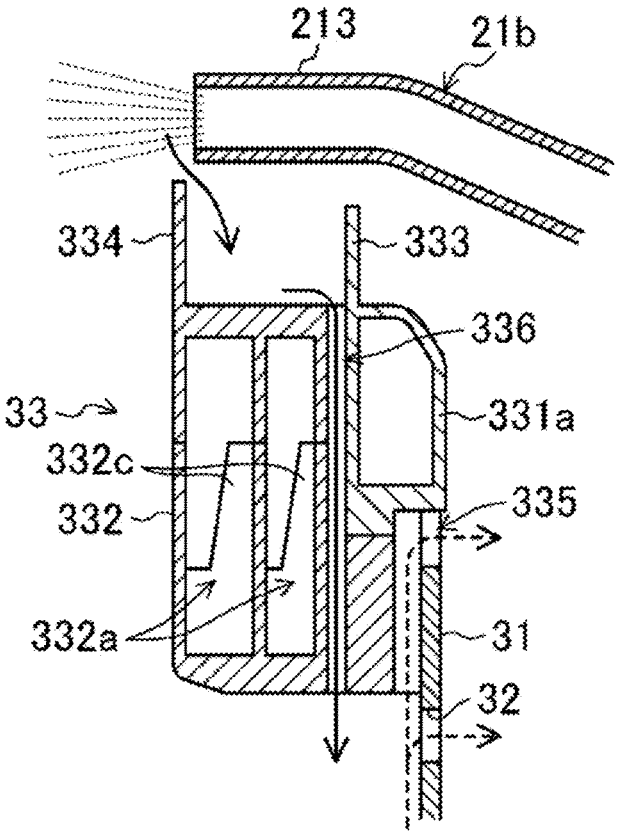
FIG. 48A is a schematic cross-sectional view of the balancer shown in FIG. 47, taken along an arrow line X-X.
Figure 48B:
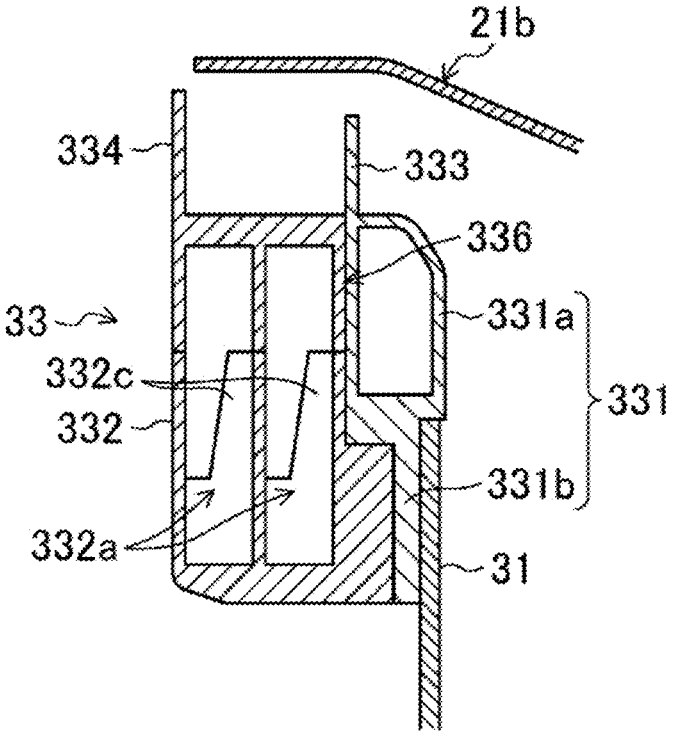
FIG. 48B is a schematic cross-sectional view of the balancer shown in FIG. 47, taken along an arrow line Y-Y.

In FIGS. 47, 48A, and 48B, the balancer 33 is shown. The balancer 33 according to the fourth embodiment may be a fluid balancer having a fluid therein, and may include an installing portion 331 and a balance adjusting portion 332. The installing portion 331 and the balance adjusting portion 332 may be resin molds.

The installing portion 331 may include a hollow frame part 331*a* formed in the shape of a ring, and an insertion coupling part 331*b* extending from the hollow frame portion 331*a* and formed in the shape of a cylinder. The installation portion 331 may be installed in the body member 31 by inserting the insertion coupling part 331*b* into the inner side of the body member 31. A stop rib 333 formed in the shape of a cylinder may protrude upward from the top of the hollow frame portion 331*a*.

The balance adjusting portion 332 may be a ring-shaped member, and include a pair of fluid chambers 332*a* partitioned into two layers in the diameter direction therein. The balance adjusting portion 332 may be formed by depositing a pair of members vertically to bond them. In each fluid chamber 332*a*, a predetermined amount of fluid made of high-density antifreeze may be sealed up. A flow suppressing part 332*b* or a restricting rib 332*c* for preventing the fluid from flowing excessively may be formed at a plurality of locations along the circumferential direction of each fluid chamber 332*a*, in such a way to protrude toward the inside of the fluid chamber 332*a* in the diameter direction.

The balance adjusting portion 332 may be integrated into the inner side of the installing portion 331 installed in the body member 31 by spin deposition, vibration deposition, etc. As such, when the balance 33 is configured with the installing portion 331 and the balance adjusting portion 332 and deposited by spin deposition, the balancer 33 may be integrated into the body member 31 in a short time, which leads to an improvement of productivity.

A cover rib 334 formed in the shape of a cylinder may protrude upward from the top of the balance adjusting portion 332. The cover rib 334 may be opposite to the stop rib 333 to be positioned at the inside in diameter direction from the stop rib 333 with a gap from the stop rib 333.

Since the rotating tub 30 is positioned in the inside of the water collecting tub 20, the positional relation between the body member 31, the balancer 33, and the flange portion 21*b* may not change although the water collecting tub 20 shakes. Therefore, it may be possible to position the protruding ends of the cover rib 334 and the stop rib 333 protruding upward rather than the balancer 33 around the flange portion 21*b*.

More specifically, the protruding end of the cover rib 334 may be adjacent to the protruding end of the flange portion 21*b*, and a gap (a gap in the vertical direction) between the balancer 33 and the flange portion 21*b* may be blocked by the cover rib 334. Accordingly, when the rotating tub 30 rotates, laundry may be prevented from entering the gap.

The cover rib 334 may be disposed immediately below the opening of the outlet 213 formed in the flange portion 21*b*. The outlet 213 may protrude inward in the diameter direction rather than the stop rib 333 to open to the inside of the rotating tub 30.

A plurality of overflow paths 335 may be formed at a plurality of locations along the circumferential direction between the body member 31 and the installing portion 331 such that the lower space of the balancer 33 communicates with the upper outside of the body member 31. More specifically, the dehydrating holes 32 may be formed at a plurality of locations of the top end of the body member 31 throughout the entire circumference, and the dehydrating holes 32 may be located below the balancer 33. Also, the overflow paths 335 may extend upward from the dehydrating holes 32 along the inner surface of the body member 31 to cause water to overflow the top end of the body member 31. The overflow paths 335 may be formed at a plurality of locations in the circumferential direction between the body member 31 and the installing portion 331.

Also, at the plurality of locations in the circumferential direction between the body member 31 and the balance adjusting portion 332, a plurality of flow paths 336 may be formed to return water entered an annular groove formed between the stop rib 333 and the cover rib 334 to the inside of the body member 31. More specifically, as the flow paths 336, a plurality of vertical slits opening vertically along the stop rib 333 may be formed at a plurality of locations in the circumferential direction of the balance adjusting portion 332 on the outer circumferential surface in diameter direction of the balance adjusting portion 332. The vertical slits 336 may communicate a space between the stop rib 333 and the cover rib 334 above the balancer 33 with a lower space of the balancer 33.

<Driving of Washing Machine 1H>

In main driving operations of the washing machine 1H, a difference between the washing machine 1H and the washing machine 1G will be described below.

When a washing operation starts, the controller 60 may rotate the pulsator 40, and estimate a weight of laundry (dried state) based on a load applied to the motor. Thereafter, the controller 60 may rotate the rotating tub 30 or the pulsator 40 appropriately, and open the first water supply valve 72*a* or the second water supply valve 72*b*. Accordingly, tap water or hot water (simply, referred to as water) may be supplied to the water supply 70 to be supplied to the rotating tub 30. At this time, a detergent may be supplied to the rotating tub 30 together with the water.

When the water levels of the rotating tub 30 and the vent pipe 29*a* reach a predetermined water level (the predetermined water level is set based on the estimated weight of the laundry), the controller 60 may stop supplying water based on a detection value of the water level sensor 29.

Figure 49:
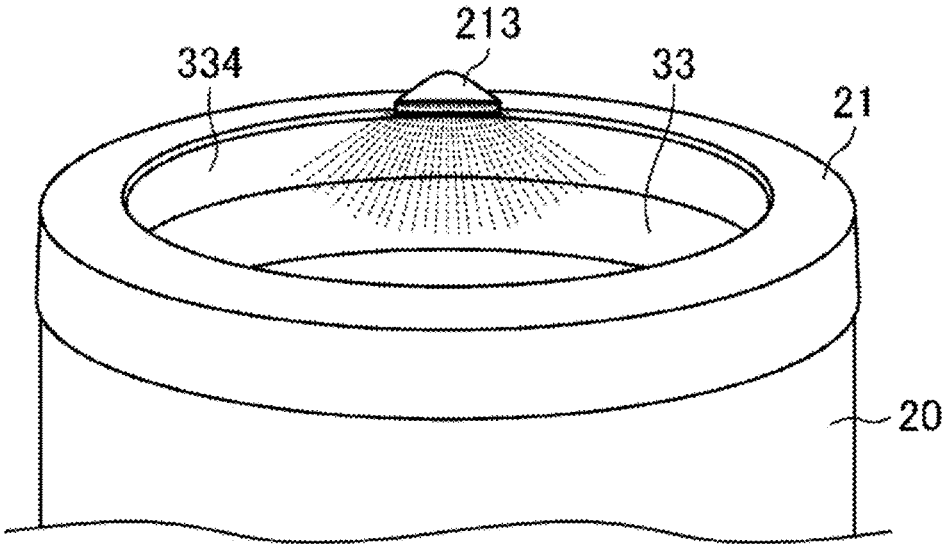
FIG. 49 is a schematic view showing a state of an outlet when water circulates.

While the washing process is being performed, the circulation pump 212 may be driven to send water collected in the rotating tub 30 to the outlet 213. As shown in FIG. 49, the water sent to the outlet 213 may be sprinkled toward the center of the rotating tub 30 from the outlet 213, and thus return to the inside of the rotating tub 30.

Since the outlet 213 is integrated into the water collecting tub 20, the outlet 213 may stably return water to the inside of the rotating tub 30. However, when the strength of water sprinkled from the outlet 213 is weakened, for example, when the circulation pump 212 starts or stops, a liquid sag may occur. As indicated by an arrow in FIG. 48A, water discharged from the outlet 213 may enter the other surface side of the cover rib 334. If the water is discharged to the water collecting tub 20, the water may not return to the rotating tub 30, and in this case, water in the rotating tub 30 may be reduced gradually, resulting in a reduction of washing performance.

In regard of this, since the washing machine 1H includes the stop rib 333, water entered the other surface side of the cover rib 334 may be prevented from being discharged to the water collecting tub 20. The vertical slits 336 may be formed between the stop rib 333 and the cover rib 334 so as to return water to the inside of the rotating tub 30 without collecting the water between the stop rib 333 and the cover rib 334, as indicated by an arrow in FIG. 48A.

Since the vertical slits 336 are formed along the inner surface of the stop rib 333, water collected to the outer side in the diameter direction due to shaking may be induced to the vertical slits 336 to smoothly fall to the inside of the rotating tub 30.

Since water entered the other surface side of the cover rib 334 is a small amount, the flow paths of the vertical slits 336 may have a small cross-section, and accordingly, small vertical slits may be formed in a part of the balancer 33 along the circumferential direction since a total cross-section of the flow paths is small. Accordingly, it may be unnecessary to reduce the fluid chambers 332*a* of the balancer 33 or to degrade the function of the balancer 33, in order to form the vertical slits 336.

When a dehydrating operation starts, the rotating tub 30 may rotate at high speed, and water included in laundry may rise along the inner surface of the body member 31 by a centrifugal force.

Since the balancer 33 is disposed at the inner top of the body member 31, the rising water may be received by the balancer 33. Since the dehydrating holes 32 are located below the balancer 33, the rising water may overflow through the dehydrating holes 32.

A part of water may be collected in a lower corner (above the dehydrating holes 32) of the balancer 33. However, since the washing machine 1H includes the overflow paths 335, the collected water may also overflow through the overflow paths 335, as indicated by broken-line arrows in FIG. 48A. That is, since all of the rising water overflows without remaining, excellent dehydrating performance can be obtained.

The water overflowing through the dehydrating holes 32 may fall to the bottom of the water collecting tub 20, and then be forcedly drained by driving of the drain pump 150 through the first drain hole 26, the first path 92 (the stop valve 100 is in an opened state), and the third path 94.

<Modification Example>

The structure of the balancer 33 may be modified appropriately according to specifications. Some modification examples will be described below.

Figure 50A:
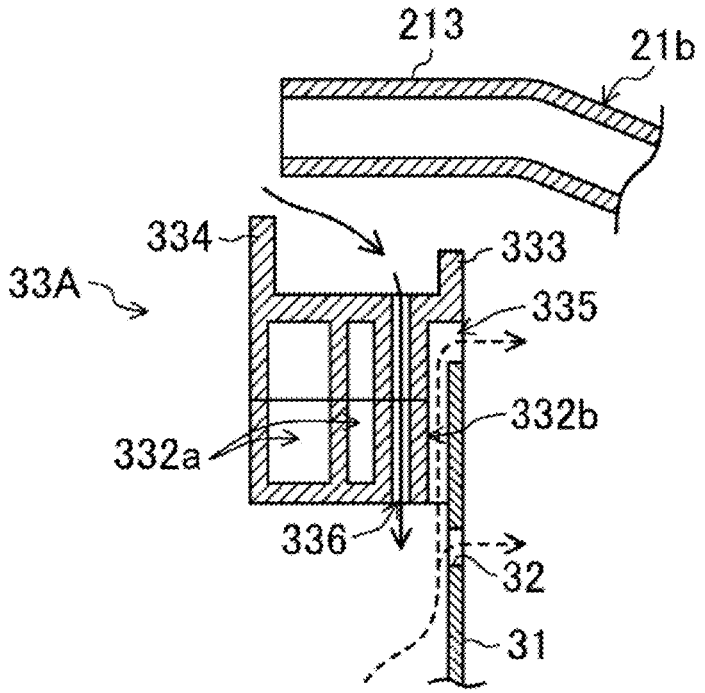
FIG. 50A is a schematic cross-sectional view showing a modification example of a balancer.

In FIG. 50A, a balancer 33A according to a first modification example is shown. The balancer 33 according to the fourth embodiment is configured with a plurality of members including the installing portion 331 and the balance adjusting portion 332, however, in the balancer 33A, the installing portion 331 and the balance adjusting portion 332 are integrated into a single member (integral type). The integral type balancer 33A may be configured with a small number of components.

A structure for installing the balancer 33A in the body member 31 may be the same as the installing portion 331, and the same overflow path 335 as in the balancer 33 according to the fourth embodiment may also be formed. However, flow paths 336 penetrating the balancer 33A may need to be formed since the balancer 33A is an integral type. Reducing the fluid chambers 332*a* in order to form a hole may degrade the function of the balancer 33A. Accordingly, the flow paths 336 may be formed by forming vertical slits vertically penetrating the flow suppressing part 332*b* in the balancer 33A.

As described above, since the flow paths 336 can have a small cross-section, and the total cross-section of the flow paths 336 can also be small, vertical slits of a small diameter may be formed at a plurality of locations in the flow suppressing part 332*b*. Accordingly, the integral type balancer 33A may obtain the same function as the balancer 33 described above.

Figure 50B:
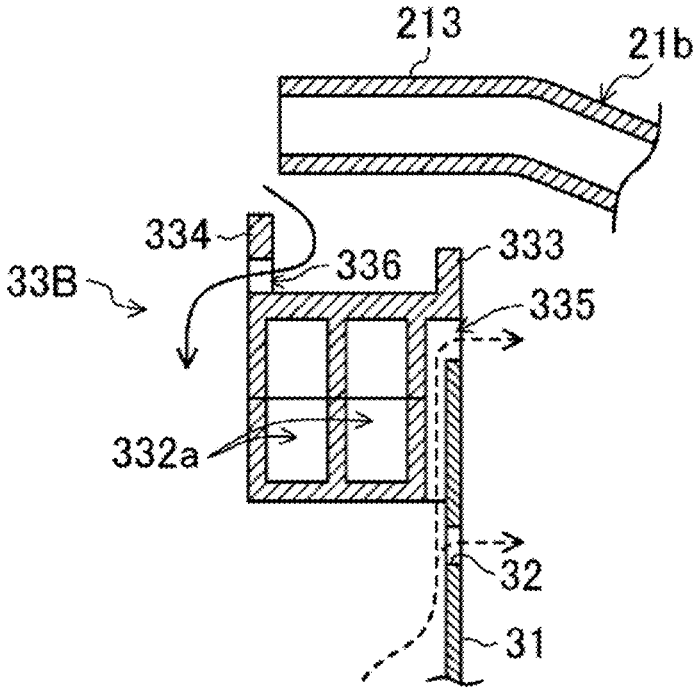
FIG. 50B is a schematic cross-sectional view showing a modification example of a balancer.

In FIG. 50B, a balancer 33B according to a second modification example is shown. The balancer 33B may be an integral type, like the first modification example. However, the balancer 33B may be different from the first modification example in view of the structure of the flow paths 336. More specifically, at a plurality of locations of the lower part of the cover rib 334, a plurality of horizontal holes horizontally penetrating the cover rib 334 may be formed as the flow paths 336.

Figure 50C:
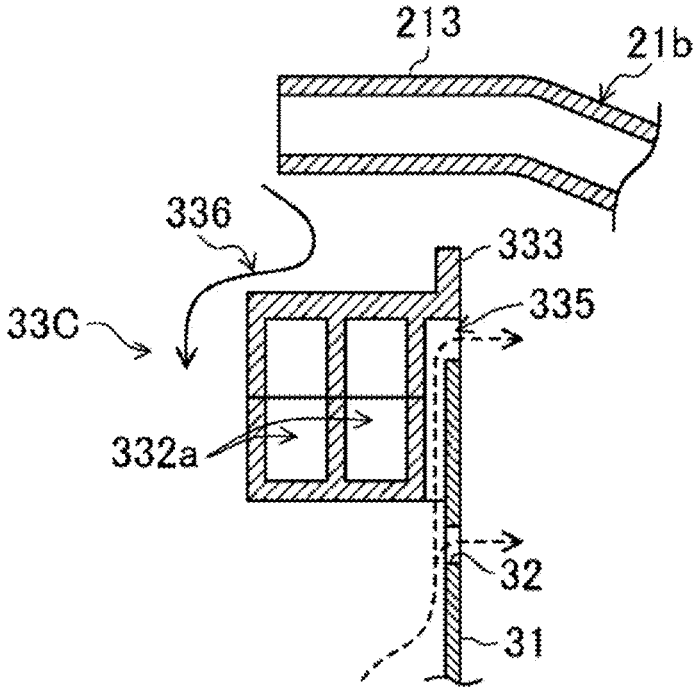
FIG. 50C is a schematic cross-sectional view showing a modification example of a balancer.

In FIG. 50C, a balancer 33C according to a third modification example is shown. The balancer 33C may also be an integral type, and may omit the cover rib 334 in order to form the flow paths 336.

The fourth embodiment relates to the washing machine including the drain pump. However, the fourth technique may be applied to a washing machine having no drain pump, that is, a washing machine that performs natural drainage in which water flows downward.

The balancer is not limited to a fluid balancer, that is, the balancer may be a ball balancer. That is, a plurality of balls, instead of a fluid, may be movably accommodated in the inside of the balancer.

The stop rib 333 or the cover rib 334 is not limited to a thin film shape, and may be in the shape of a protrusion as long as it can block water. The structure of the overflow path may also be, like the flow paths, modified appropriately according to specifications.

<Fifth Embodiment>

Figure 51:
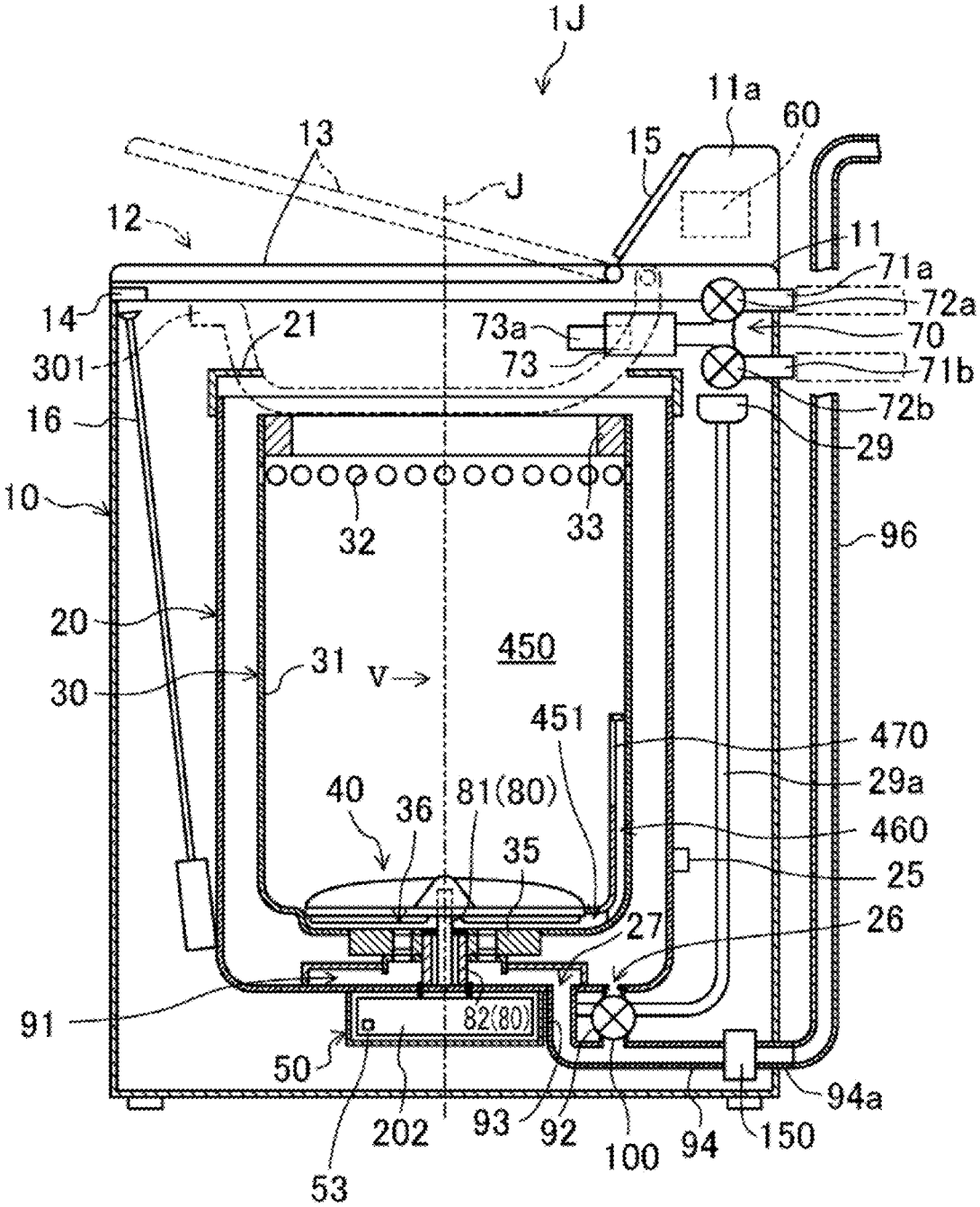
FIG. 51 is a schematic cross-sectional view showing an entire structure of a washing machine according to a fifth embodiment.

In FIG. 51, the entire structure of a washing machine 1J according to a fifth embodiment is shown. A basic configuration of the washing machine 1J including the housing 10, the water collecting tub 20, the rotating tub 30, the pulsator 40, the driver 50, etc. may be the same as that of the washing machine 1H. Accordingly, the same components as those of the washing machine 1H will be assigned the same reference numerals, and detailed descriptions thereof will be omitted. Hereinafter, a difference in structure between the washing machine 1J and the washing machine 1H will be described.

A block diagram of the controller 60 of the washing machine 1J may be a configuration in which the water temperature sensor 223 and the circulation pump 212 are omitted from the block diagram of FIG. 43.

The inside of the body member 31 may be partitioned into a washing space 450 (upper space) in which laundry is accommodated to perform a process such as washing, and a pump space 451 (lower space) in which a pump operation is performed by a rotation of the pulsator 40, by the pulsator 40.

In the side of the body member 31, a circulation path 460 for communicating the washing space 450 with the pump space 451 may be formed. A plurality of circulation paths 460 (two circulation paths 460 are provided in the washing machine 1J) may be disposed to be opposite to each other with a vertical axis J in between. In the side of the body member 31, a lint filter 470 may be installed in correspondence to each circulation path 460. The circulation path 460 and the lint filter 470 will be described later.

(Drain Path)

Since the washing machine 1J does not include the circulation path 210, the first drain hole 26 may open to the inside space of the water collecting tub 20, and the second drain hole 27 may open to the water guide path 91, in the bottom of the water collecting tub 20. The second drain hole 27 may open toward the lower inner surface of the water guide path 91, and face the inside space of the water guide path 91. Accordingly, the second drain hole 27 may communicate with the outlet 36 through the water guide path 91. Therefore, water collected in the rotating tub 30 may be introduced to the water guide path 91 from the outlet 36, and discharged through the second drain hole 27.

(Pulsator)

Figure 52:
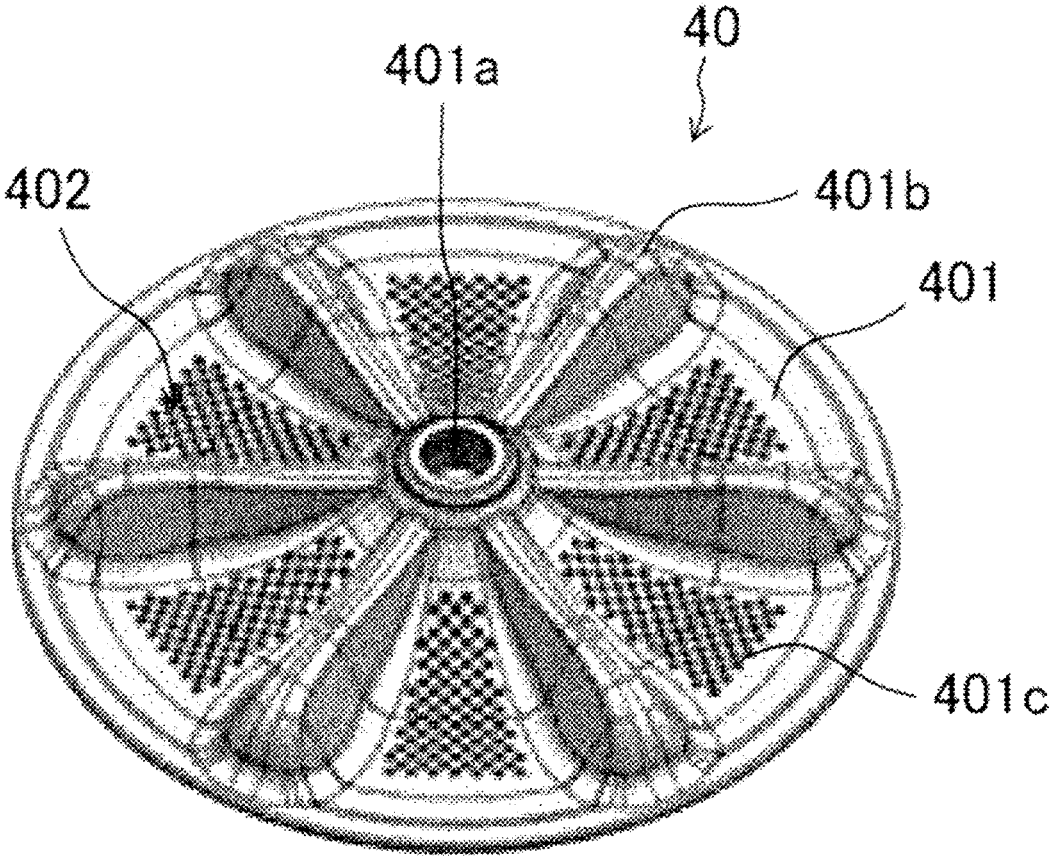
FIG. 52 is a schematic perspective view of a pulsator seen diagonally from above.
Figure 53:
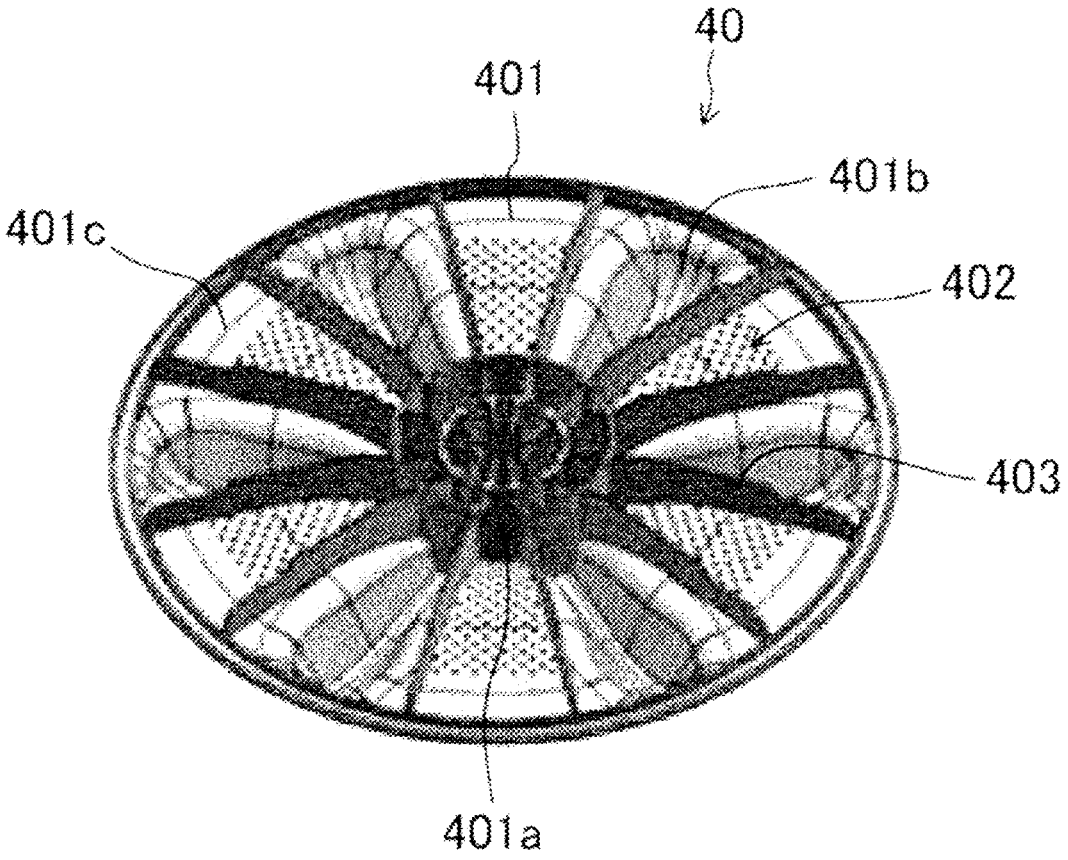
FIG. 53 is a schematic perspective view of a pulsator seen diagonally from below.

In FIGS. 52 and 53, the pulsator 40 is shown. The pulsator 40 may be an injection-molded part made of a resin and formed as one body, and have a base 401 formed in the shape of a disc. On the center surface of the base 401, a boss portion 401*a* having a cone shape, at which the first shaft 81 is fixed, may be formed. Also, on the surface of the base 401, a plurality of stirring blades 401*b* (the pulsator 40 includes six stirring blades) may be formed to extend radially from the boss portion 401*a*.

Each stirring blade 401*b* may protrude from the surface of the base 401, and have a U-shaped or V-shaped cross-section, wherein a horizontal width of the stirring blade 401*b* is widened toward the circumference from the center. A planar portion 401*c* whose circumferential side is nearly flat may spread between two neighboring stirring blades 401*b*. The pulsator 40 may be in the shape of a plate, not in the shape of a cup.

Also, in each planar portion 401*c*, a group of water-passage holes 402 penetrating the base 401 may be formed (the water-passage holes 402 will be described later). The water-passage holes 402 may have a size through which small things, that is, foreign materials such as buttons included in laundry cannot pass. Also, a pitch between the neighboring water-passage holes 402 may be set within a range capable of securing required strength.

On the other surface of the base 401, a plurality of rear blades 403 may be installed. Each rear blade 403 may be a thin plate member, and the rear blades 403 may be arranged radially toward the circumference from the boss portion 401*a*.

(Circulation Path and Lint Filter)

Figure 54:
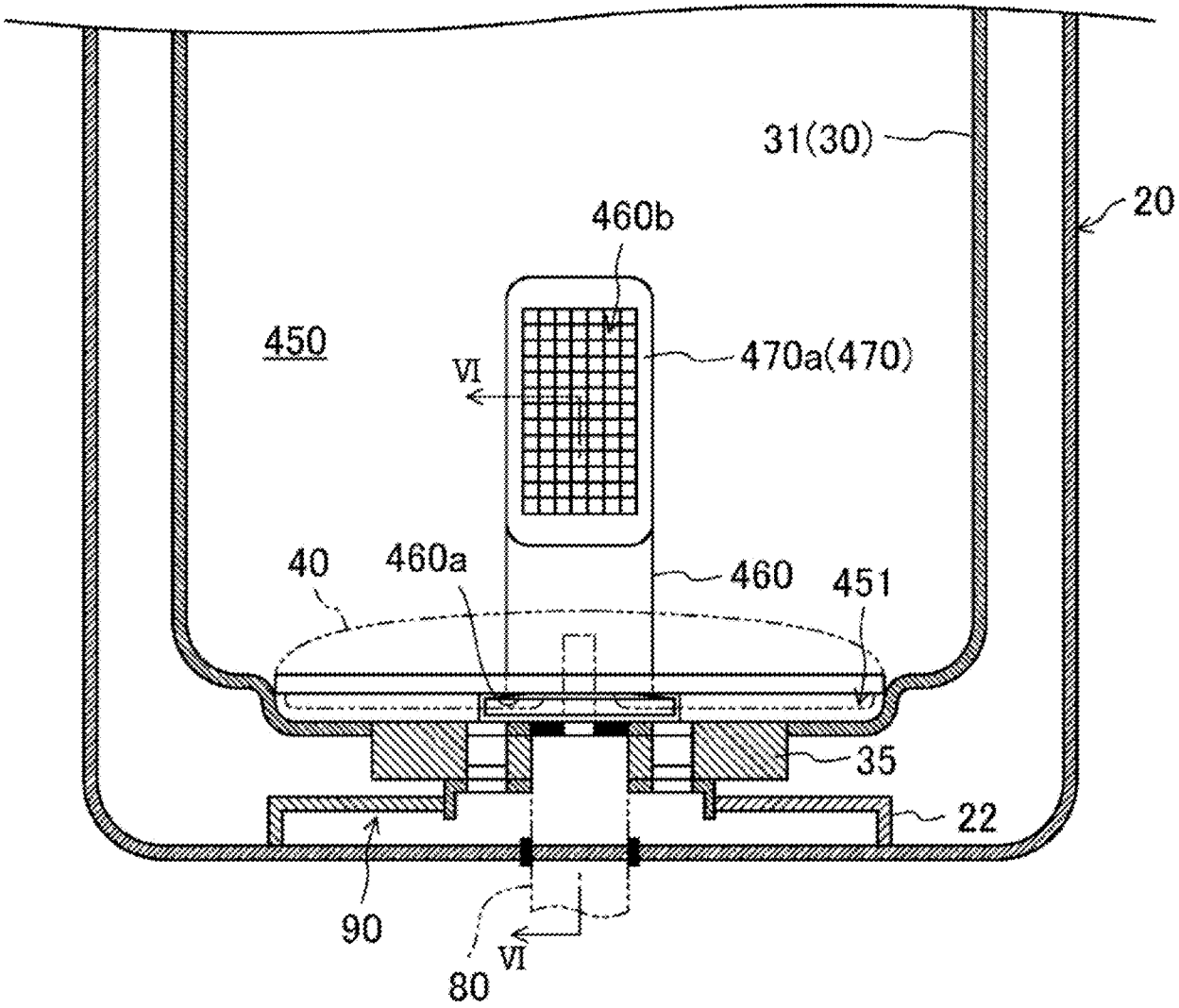
FIG. 54 is a schematic cross-sectional view of the washing machine of FIG. 51, seen in a direction of an arrow V.
Figure 55:
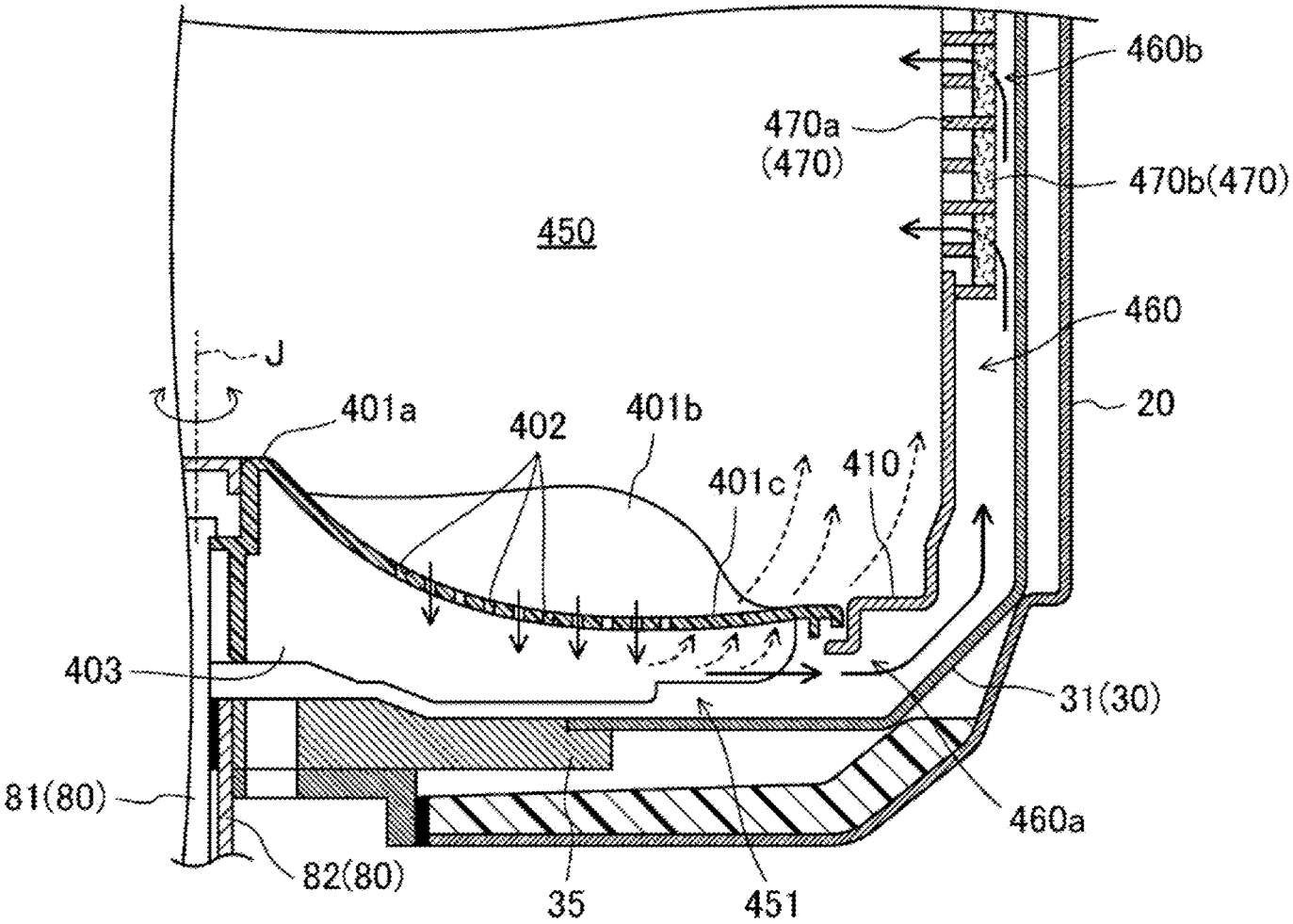
FIG. 55 is a schematic cross-sectional view of the washing machine of FIG. 54, seen in a direction of arrows VI-VI.

In FIGS. 54 and 55, the structures of the circulation path 460 and the lint filter 470 are shown.

The lower portion of the body member 31 may protrude inward from the side. Accordingly, the lower portion of the body member 31 may be adjacent to the circumference of the pulsator 40 with a small gap. That is, the inside of the body member 31 may be partitioned into the washing space 450 and the pump space 451 by the pulsator 40.

A duct-shaped thin space (the circulation path 460) of a thin thickness may extend upward in the shape of a band within a predetermined area ranged from the corner of the lower portion of the body member 31 to the lower part of the side portion of the body member 31. A lower opening (inlet 460*a*) of the circulation path 460 may open to the pump space 451, and the circulation path 460 may communicate with the pump space 451 through the inlet 460*a*. An upper opening (outlet 460*b*) of the circulation path 460 may open to the washing space 450, and the circulation path 460 may communicate with the washing space 450 through the outlet 460*b*.

The outlet 460*b* may be formed in the shape of a rectangle having a large opening area in the inner side surface of the body member 31. The lint filter 470 may be removably installed in the outlet 460*b*. The lint filter 470 may be configured with a support body having openings arranged in a lattice shape and a filter material 470*b* (a rough mesh material for collecting lint) installed in the support body 470*a*. The lint filter 470 may face the washing space 450, and the circulation path 460 may communicate with the washing space 450 through the lint filter 470, specifically, the filter material 470*b* and the openings of the support body 470*a*.

When the pulsator 40 rotates in the state in which water is stored in the pulsator 40, water in the pump space 451 may be extruded outward in the diameter direction by the rear blades 403, as indicated by arrows in FIG. 55. Since the pump space 451 is partitioned at the corners, and the inlet 460*a* is disposed at the outer area in diameter direction of the pump space 451, water extruded outward in the diameter direction may be introduced with a strong current to the circulation path 460 from the inlet 460*a*. As a result, the water introduced to the circulation path 460 may be discharged to the washing space 450 from the outlet 460*b* through the filter material 470*b*.

Since the pump space 451 communicates with the washing space 450 through the water-passage holes 402, water reduced in the pump space 451 may be added through the water-passage holes 402, as indicated by arrows in FIG. 55.

(Arrangement and Opening Ratio of Water-Passage Holes)

In the washing machine 1J, an arrangement and opening ratio of the water-passage holes 402 are devised.

Figure 56:
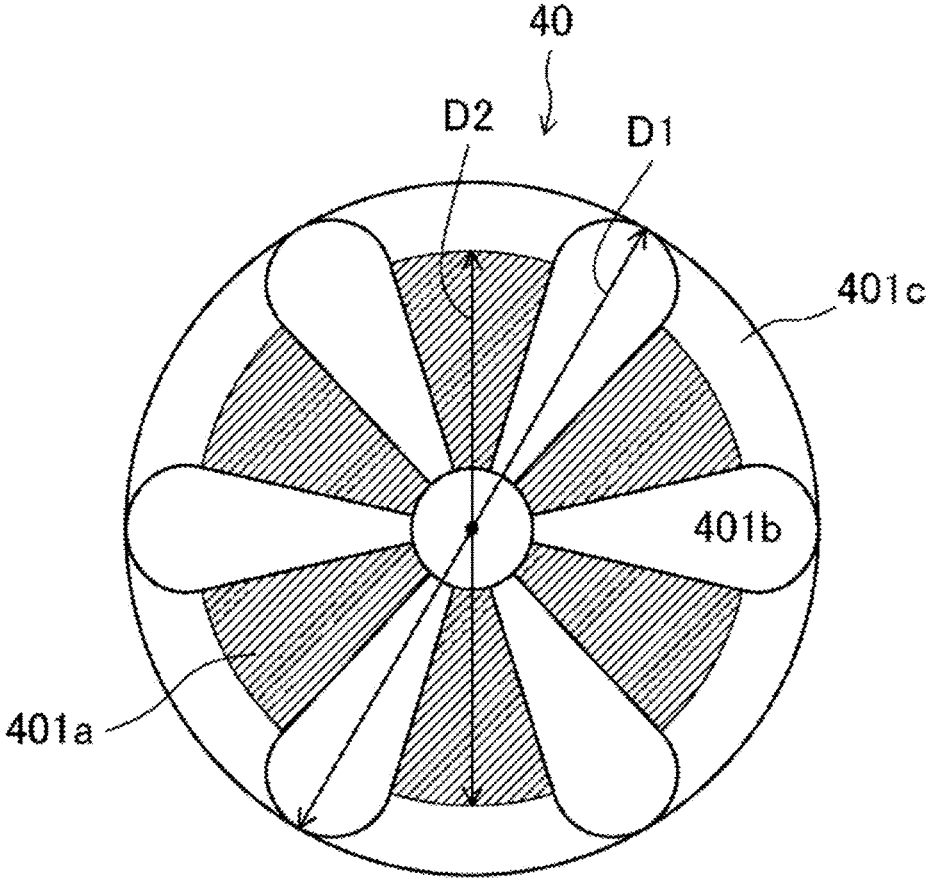
FIG. 56 is a schematic view of a pulsator seen in an axial direction from above.

That is, the group of the water-passage holes 402 may be disposed in a lattice shape around the center of each planar portion 401*c* except for the boss portion 401*a* and the stirring blades 401*b*. More specifically, as shown in FIG. 56, the water-passage holes 402 of 92% or more of the total opening area may be arranged in an circular area (an area represented by oblique lines) of the planar portion 401*c* which is concentric with the base 401 and whose external diameter D2 is 80% of an external diameter D1 of the base 401.

That is, around the circumference of the base 401, no water-passage holes 402 may be formed or a very small number of the water-passage holes 402 may be formed. The water-passage holes 402 may be disposed intensively around the center of the base 401. The water-passage holes 402 may send water in the washing space to the pump space 451 functioning as a centrifugal pump (relatively positive pressure is made in the circumferential side and relatively negative pressure is made in the center side).

When the water-passage holes 402 are formed around the circumference, water may be discharged through the water-passage holes 402 formed around the circumference, and the amount of circulating water may be reduced, resulting in a degradation of the pump function. By introducing water to the pump space 451 from the center area, it may be possible to stably introduce water to the pump space 451 and to stably discharge water.

More specifically, since a flow of water is formed by a rotation of the pulsator 40 in the pump space 451, a strong centrifugal force may be applied to the flow of water toward the circumference from the center. Therefore, when a plurality of water-passage holes 402 are formed around the circumference of the pulsator 40, water may return to the washing space 450 through the water-passage holes 402 formed around the circumference of the pulsator 40, as indicated by broken-line arrows in FIG. 55.

In the washing space 450, a flow of water may be formed toward the circumference from the center by a stirring operation of the stirring blades 401*b*, and then the flow of water may rise along the inner wall of the rotating tub 30. Therefore, water returned to the washing space 450 through the water-passage holes 402 formed around the circumference may move further away from the pump space 451 by the flow of water, as indicated by the broken-line arrows in FIG. 55.

In regard of this, since a flow of water is formed toward the pulsator 40 from above in the center of the washing space 450, the center area above the pulsator 40 may be easy to be at relatively positive pressure. Also, the negative pressure formed at the center area of the pump space 451 may be applied so as to smoothly introduce water to the pump space 451.

When no water-passage holes 402 are formed around the circumference of the pulsator 40, relatively positive pressure may be maintained around the circumference of the pump space 451 to efficiently discharge water to the circulation path 460.

Therefore, it may be preferable that most of the water-passage holes 402 are formed in the circular area whose external diameter D2 has a size of 80% of the external diameter D1 of the base 401. However, although a small number of water-passage holes exist outside the circular area, the function may be not greatly degraded. Therefore, the water-passage holes of 92% or more of the total opening area may be arranged in the circular area.

By forming the water-passage holes 402 in the planar portion 401*c* that is orthogonal to a rotation direction of the pulsator 40, the plurality of water-passage holes 402 may be formed uniformly to introduce water to the pump space 451 with small resistance. Also, the water-passage holes 402 may be easily molded. Although laundry exists, the stirring blades 401*b* can receive the laundry so that the water-passage holes 402 are prevented from being clogged. Therefore, water may be stably introduced to the pump space 451 without any change in amount.

Also, the water-passage holes 402 may be formed in the sides of the stirring blades 401*b* to open to the rotation direction of the stirring blades 401*b*. Thereby, it may be possible to actively introduce water to the pump space 451 using a rotation of the pulsator 40.

Also, it was found by the inventors of the present disclosure that when the pump space 451 is in a substantially closed state, discharge performance depends on the opening ratio of the water-passage holes 402, and there is an optimal condition. When the surface of the base 401 is seen from above, a ratio (an opening ration of the water-passage holes 402) of a total opening area (a sum of opening areas of the water-passage holes 402) of the water-passage holes 402 in the circular area to a total surface area (so-called a projection area) of the base 401 may be preferably within a range of 1.5% to 4.0%.

Figure 57:
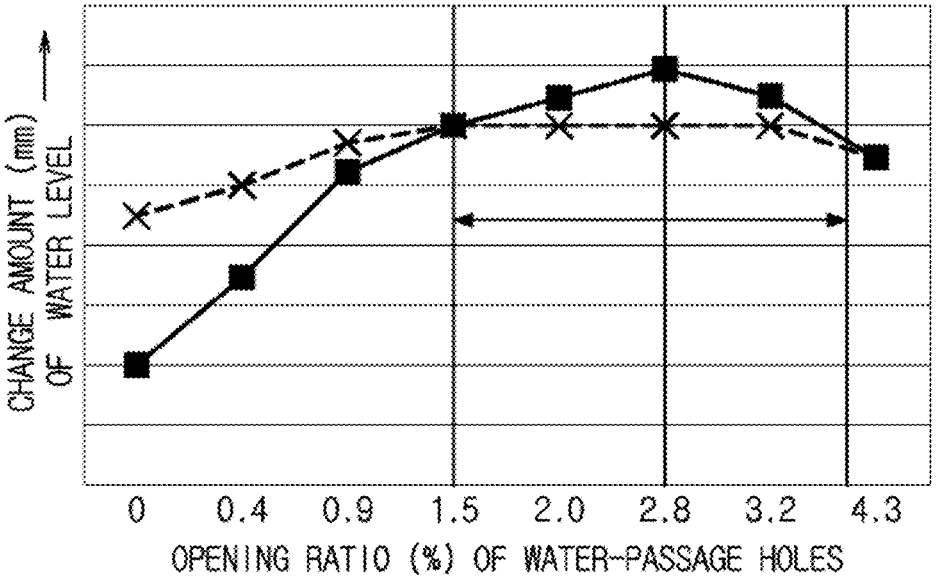
FIG. 57 is a graph showing a relation between an opening rate (%) of holes and a change amount (mm) in water level of circulating water.

In FIG. 57, a graph showing the relation between the opening ratio (%) of the water-passage holes 402 and discharge performance is shown. The vertical axis represents a change amount (mm) of a water level rising in the circulation path 460 during circulation, and corresponds to discharge performance. A broken line corresponds to a case (comparative example) in which holes exist in the bottom of the rotating tub 30 (a case in which holes or gaps through which water can freely pass exist around the pump space 451), and a solid line corresponds to a case (embodiment) in which the rotating tub 30 is a holeless rotating tub. In both the cases, the other components may be the same as those of the washing machine 1J.

In the embodiment, as the opening ratio (%) of the water-passage holes 402 increases, discharge performance increases. However, a peak occurs around 2.8%, and thereafter, discharge performance decreases.

Accordingly, by setting the opening ratio (%) of the water-passage holes 402 within the range of 1.5% to 4.0%, as described above, good discharge performance may be obtained to stably circulate water.

Also, an arrangement of the water-passage holes 402 in which the opening ratio is 2.8% or more may be a state in which a plurality of the water-passage holes 402 are disposed even around the circumference of the base 401. Accordingly, it can be seen from FIG. 57 that when the plurality of water-passage holes 402 are disposed around the circumference of the base 401, discharge performance deteriorates.

<Driving of Washing Machine 1J>

In main driving operations of the washing machine 1H, a difference between the washing machine 1H and the washing machine 1G will be described below.

When a washing process is performed, the pulsator 40 may rotate to discharge water in the pump space 451 to the circulation path 460, and to introduce water in the washing space 450 to the pump space 451 through the water-passage holes 402. Accordingly, water in the rotating tub 30 may circulate through the circulation path 460, and simultaneously, lint may be collected by the lint filter 470. Therefore, washing performance may be improved compared to a case of stirring water with the pulsator 40.

A rinsing operation may also be performed by the same control as the washing operation. That is, the pulsator 40 may rotate in the state in which water is stored in the rotating tub 30 to stir laundry, and simultaneously, lint may be collected by circulation of water. The rinsing operation may be preferably performed several times. Since circulation of water and collection of lint are performed by a rotation of the pulsator 40, rinsing performance may be improved compared to a case of stirring water only with the pulsator 40.

<Effect of Collecting Lint>

Tests of using the washing machine 1J to perform washing under the same conditions, and collecting lint at different opening ratios of the water-passage holes 402 have been conducted. The results of the tests are shown in FIG. 58.

Figure 58:
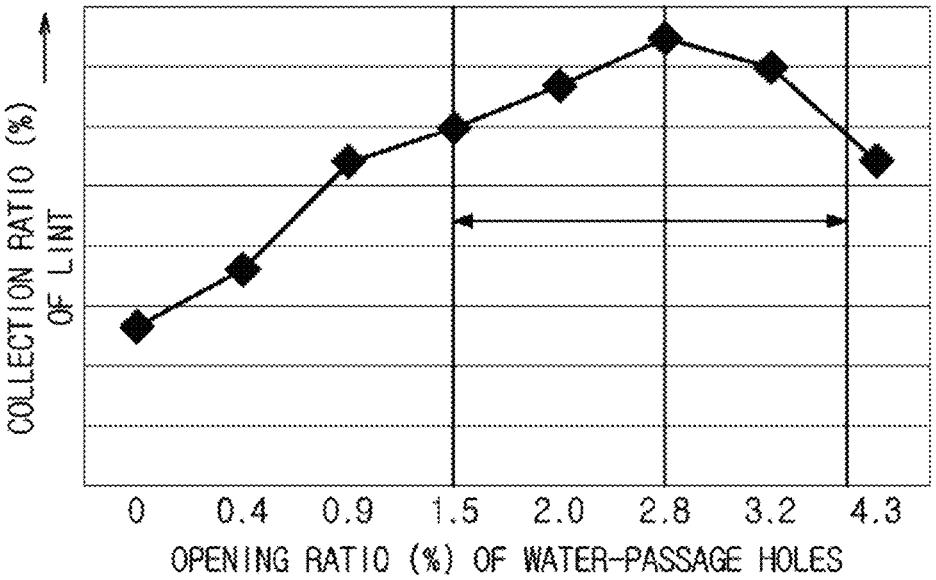
FIG. 58 is a graph showing results of tests of collecting lint.

FIG. 58 shows the relation between the opening ratio (%) of the water-passage holes 402 and a collection ratio of lint, and a change in collection ratio of lint may be substantially the same as the discharge performance shown in FIG. 57. That is, as the opening ratio (%) of the water-passage holes 402 increases, the collection ratio of lint increases. However, a peak occurs around 2.8%, and thereafter, the collection ratio of lint decreases.

Accordingly, in order to effectively collect lint, the opening ratio (%) of the water-passage holes 402 may be preferably within a range of 1.5% to 4.0%.

<Modification Example>

The washing machine 1J may use circulation of water by the rear blades 403 of the pulsator 40 to collect lint. However, the present disclosure is not limited to this. For example, an outlet formed in the shape of a slit or a porous member, instead of the lint filter 470, may be installed in the upper portion of the rotating tub 30, and circulating water may pass through the outlet to be rinsed in the form of a shower to the inside of the rotating tub 30.

Also, a detergent supply case for supplying a detergent may be installed on the circulation path 460, so that a detergent is directly mixed in circulating water. Furthermore, a chemical case for accommodating a disinfectant such as silver ions may be installed to communicate with the circulation path 460 to thereby provide circulating water with a sterilization effect.

In the inside of the pump space 451, a heater may be installed. In this case, washing water or rinsing water may be heated to further improve washing ability.

The fifth embodiment relates to a washing machine including a drain pump. However, the fifth technique may be applied to a washing machine including no drain pump, that is, a washing machine that performs natural drainage in which water flows downward. Also, the fifth technique may be applied to a washing machine having a drying function.

<Sixth Embodiment>

Figure 59:
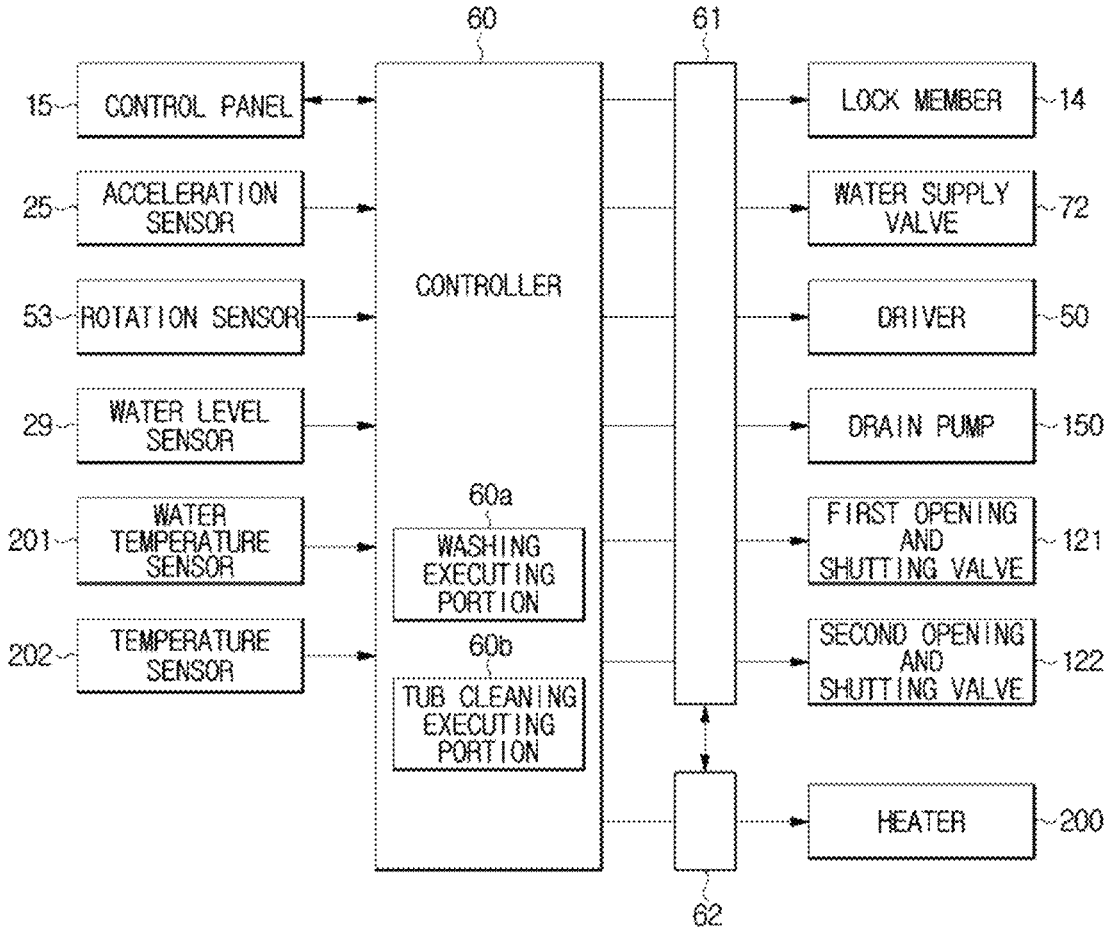
FIG. 59 is a block diagram of a controller and main input/output devices according to a sixth embodiment.

The sixth technique will be described in detail in regard of the washing machine 1B shown in FIG. 10. FIG. 59 shows a configuration of the controller 60 when the sixth technique is applied to the washing machine 1B. A basic configuration including the housing 10, the water collecting tub 20, the rotating tub 30, the pulsator 40, the driver 50, etc. may be the same as that of the washing machine 1B. Accordingly, the same components as those of the washing machine 1B will be assigned the same reference numerals, and detailed descriptions thereof will be omitted. Hereinafter, a difference in structure according to an application of the sixth technique will be described.

Figure 60:
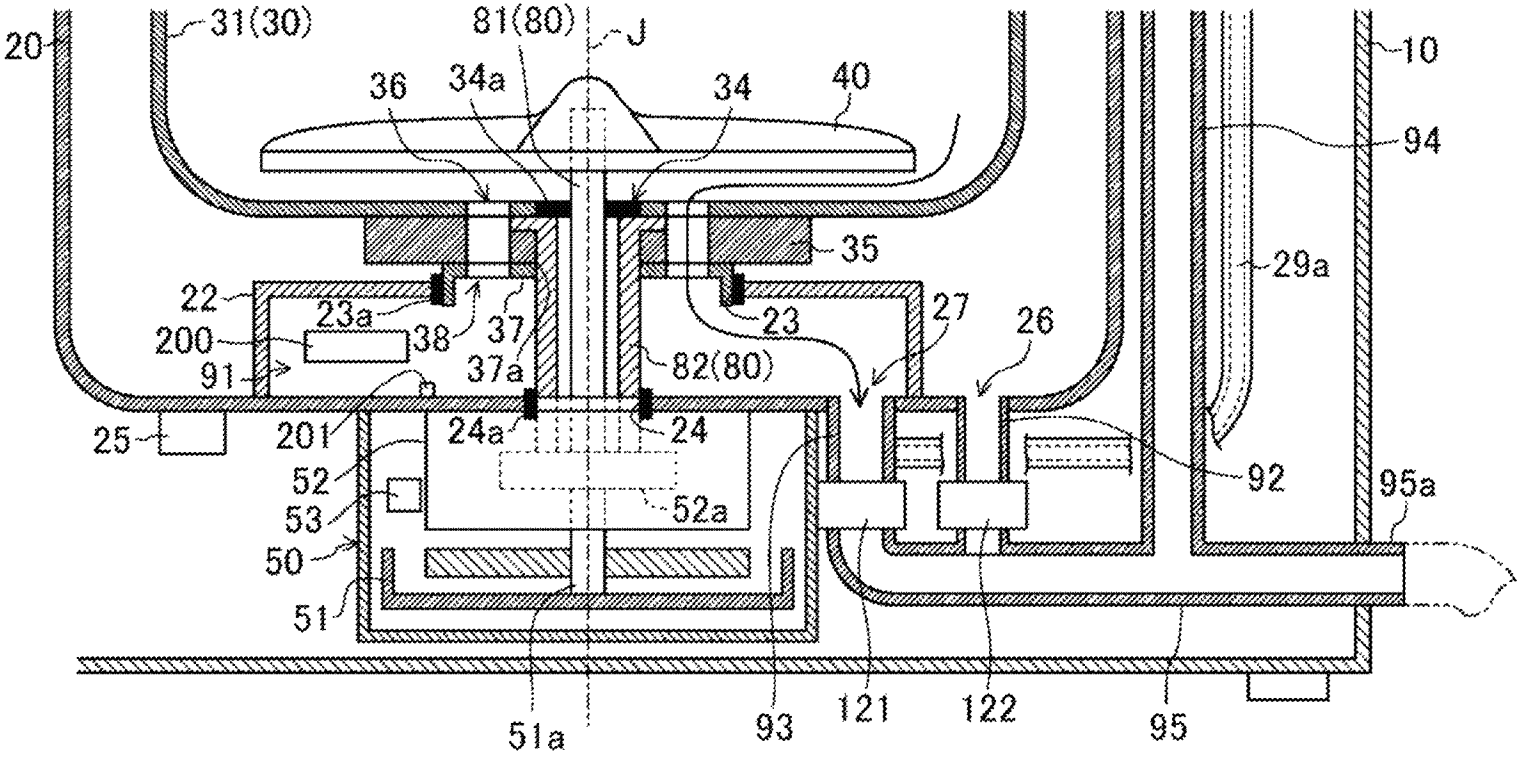
FIG. 60 schematically shows a lower structure of a washing machine, specifically, a drain path.

As shown in FIG. 60, in the inside of the sealing holder 22, a heater 200 and a water temperature sensor 223 for detecting inside temperature (water temperature) of the water guide path 91 may be installed. Also, on the other surface of the bottom of the water collecting tub 20, the acceleration sensor 25 (an example of a vibration sensor) may be installed to detect an amount of vibrations in all directions (including horizontal and vertical directions) of the water collecting tub 20 and to output the result of the detection to the controller 60.

(Driving and Drainage of Washing)

When a washing course is selected by a user, a washing execution portion 60*a* included in the controller 60 may perform a series of processes of the washing course.

When a washing operation starts, the controller 60 may close the drain valve 110, and open the water supply valve 72. Accordingly, water may be supplied together with a detergent to the rotating tub 30. The first opening and shutting valve 121 may be in a closed state, and water entered the fourth path 95 may be not drained. Thereafter, when water levels of the rotating tub 30 and the vent pipe 29*a* reach a predetermined water level, the controller 60 may stop supplying water.

The controller 60 may control the driver 50 to rotate the pulsator 40 forward and backward for a predetermined time period. When the washing process terminates, the controller 60 may open the first opening and shutting valve 121, and accordingly, water collected in the rotating tub 30 may be drained. A rinsing operation may also be performed by the same control as the washing operation.

When a dehydrating operation starts, the controller 60 may control the driver 50, while opening the first opening and shutting valve 121 and the second opening and shutting valve 122, and perform switching to rotate the rotating tub 30 and the pulsator 40 together. Thereby, the controller 60 may rotate the rotating tub 30 at high speed to cause water contained in laundry to overflow through the dehydrating holes 32. Water overflowing from the dehydrating holes 32 may fall to the bottom of the water collecting tub 20, and be drained through the first drain hole 26, the second path 93, and the fourth path 95.

(Tub Cleaning)

in the washing machine 1B, like the washing machine 1A or the washing machine 1C described above, since water is little collected in the outer space 39, the space is easy to become an unsanitary condition. As described above in the first embodiment or the second embodiment, by causing washing water to overflow from the rotating tub 30, washing water may be collected in the outer space 39. However, in this case, a large amount of water is required, which is a disadvantage in view of water saving and uneconomical.

Accordingly, in the washing machine 1B according to the current embodiment, a driving course (tub washing course) capable of effectively cleaning the outer space 39 while maintaining an advantage of water saving may be set. Therefore, the controller 60 may include a tub cleaning executing portion 60*b* for executing a tub washing course.

That is, the tub cleaning executing portion 60*b* may cause washing water filled to a predetermined water level in the rotating tub 30 to overflow by rotating the rotating tub 30 while controlling the RPM, thereby cleaning the outer space 39. More specifically, the tub cleaning executing portion 60*b* may execute a preparing step, a cleaning step, and a post-processing step.

Figure 61:
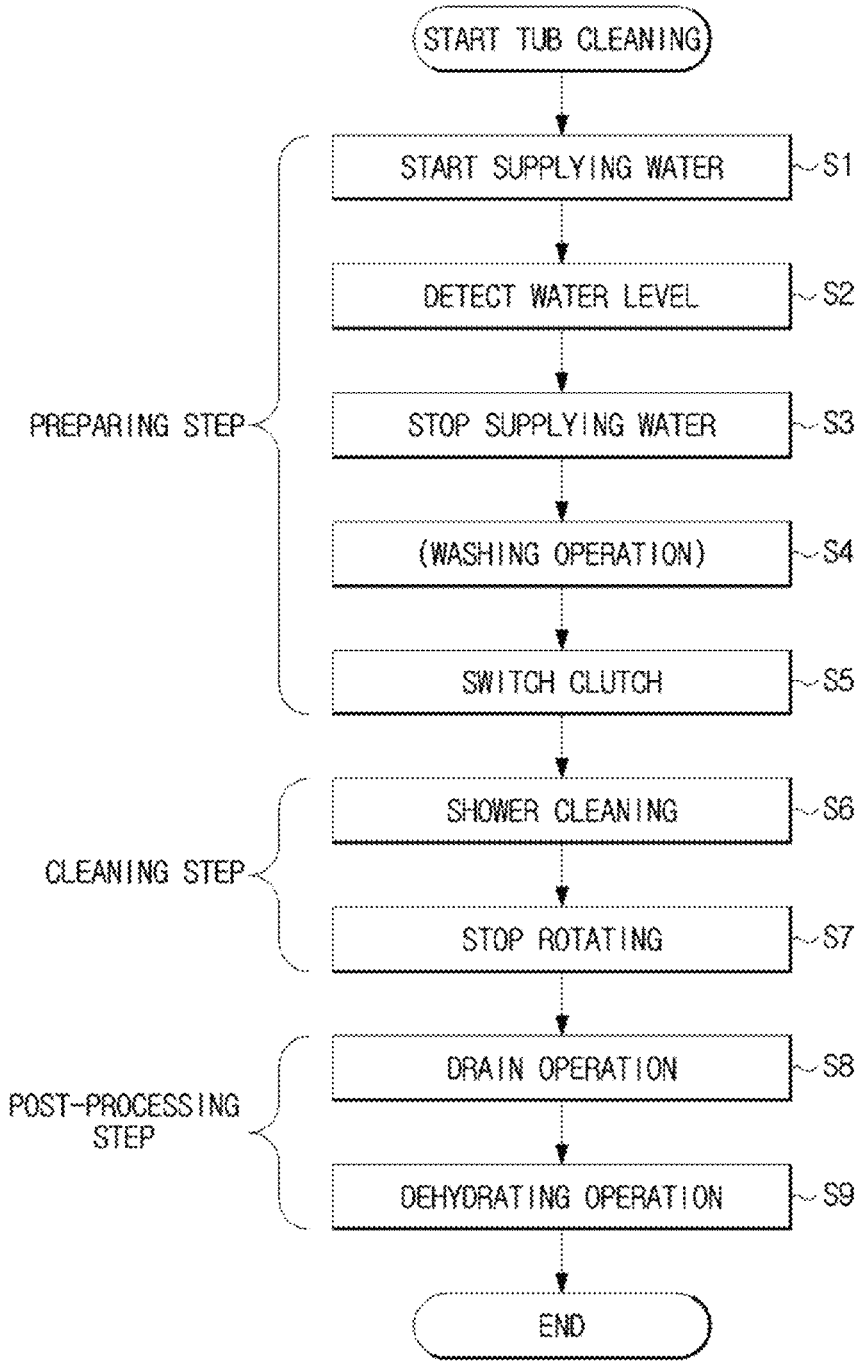
FIG. 61 is a flowchart illustrating a main process of tub cleaning.

Hereinafter, tub cleaning will be described in detail with reference to a flowchart. FIG. 61 shows a flow of a main process of tub cleaning.

When a user manipulates the control panel 15 to select a tub cleaning course, the controller 60 may lock the cover 13, and start a tub cleaning process.

(Preparing Step)

Figure 63:
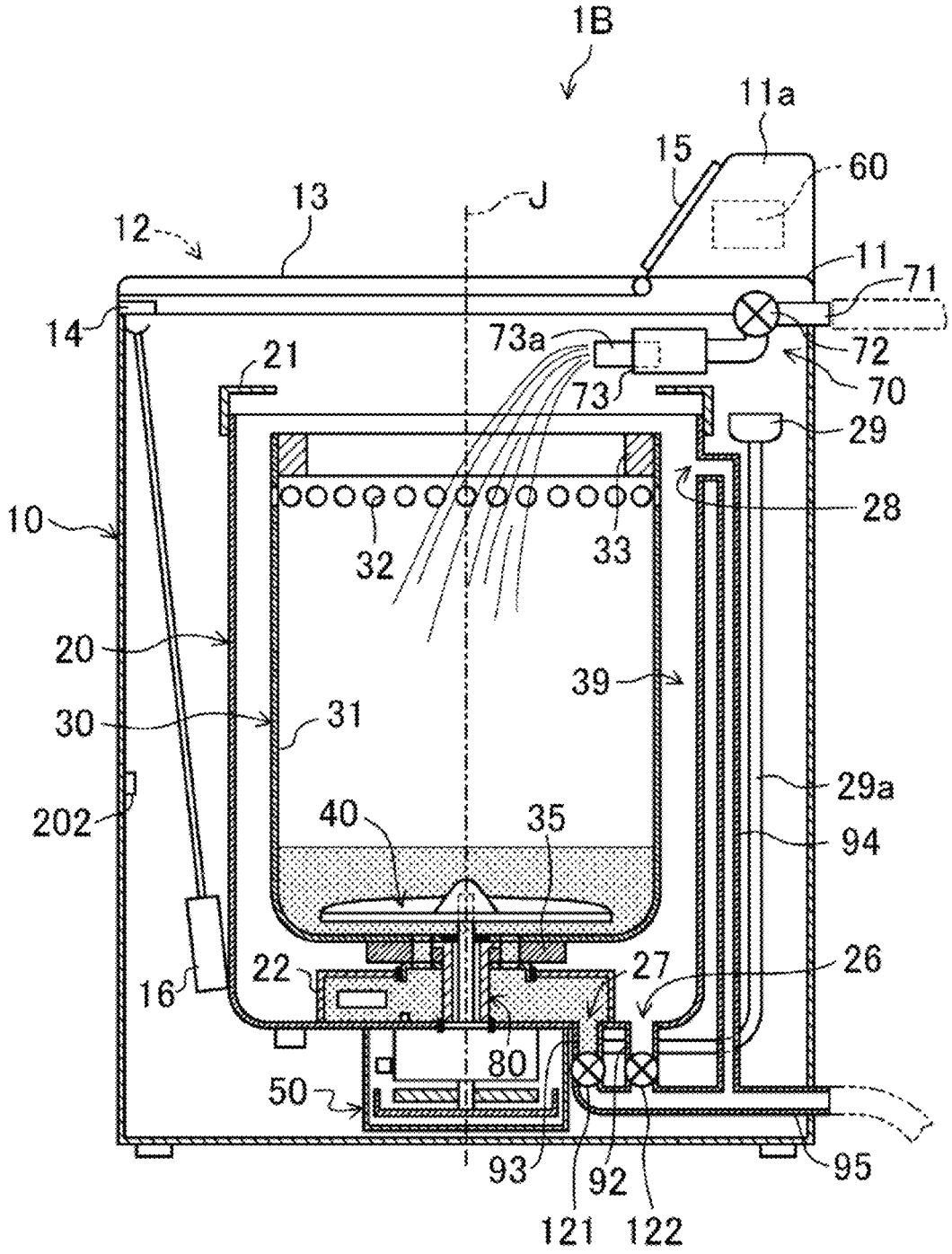
FIG. 63 is a schematic view showing a state in a step of tub cleaning.

When tub cleaning starts, like a washing operation, the controller 60 may close the first opening and shutting valve 121, and open the water supply valve 72. Accordingly, as shown in FIG. 63, water may flow to the water supply 70 to be supplied to the rotating tub 30 (step S1). When a detergent is put in the detergent supply case 73*a*, the detergent may be supplied together with water to the rotating tub 30 (hereinafter, water for washing is also referred to as "washing water" regardless of the presence or absence of a detergent).

At this time, the water level sensor 29 may detect a water level of washing water collected in the rotating tub 30 based on the water level of the vent pipe 29*a*, and continue to output a signal corresponding to the detected water level to the controller 60 (step S2). When the water level reaches a predetermined water level, the controller 60 may close the water supply valve 72, and stop supplying water (step S3). The "washing level" may be a small water level with respect to the capacity of the rotating tub 30, and may have been set in advance in the controller 60. The washing level may be a water level which is smaller than or equal to half of the capacity of the rotating tub 30, preferably, a water level which is smaller than or equal to ⅓ or ¼ of the capacity of the rotating tub 30.

When a predetermined amount of washing water is collected in the rotating tub 30, the controller 60 may control the driver 50 to rotate the pulsator 40 forward and backward intermittently. In this way, the controller 60 may clean the inside of the rotating tub 30 with the washing water (step S4). The controller 60 may switch the clutch 52*a* of the driver 50 from the second state to the first connection state to rotate the rotating tub 30 (step S5). Also, the process (step S4 and step S5) may be omitted.

(Cleaning Step)

In the cleaning step, the small amount of washing water collected in the rotating tub 30 may be effectively used to clean the outer space 39 (step S6). More specifically, by causing washing water to overflow by increasing the RPM of the rotating tub 30, the inside of the water collecting tub 20, specifically, the outer space 39 may be cleaned (shower cleaning).

Figure 62:
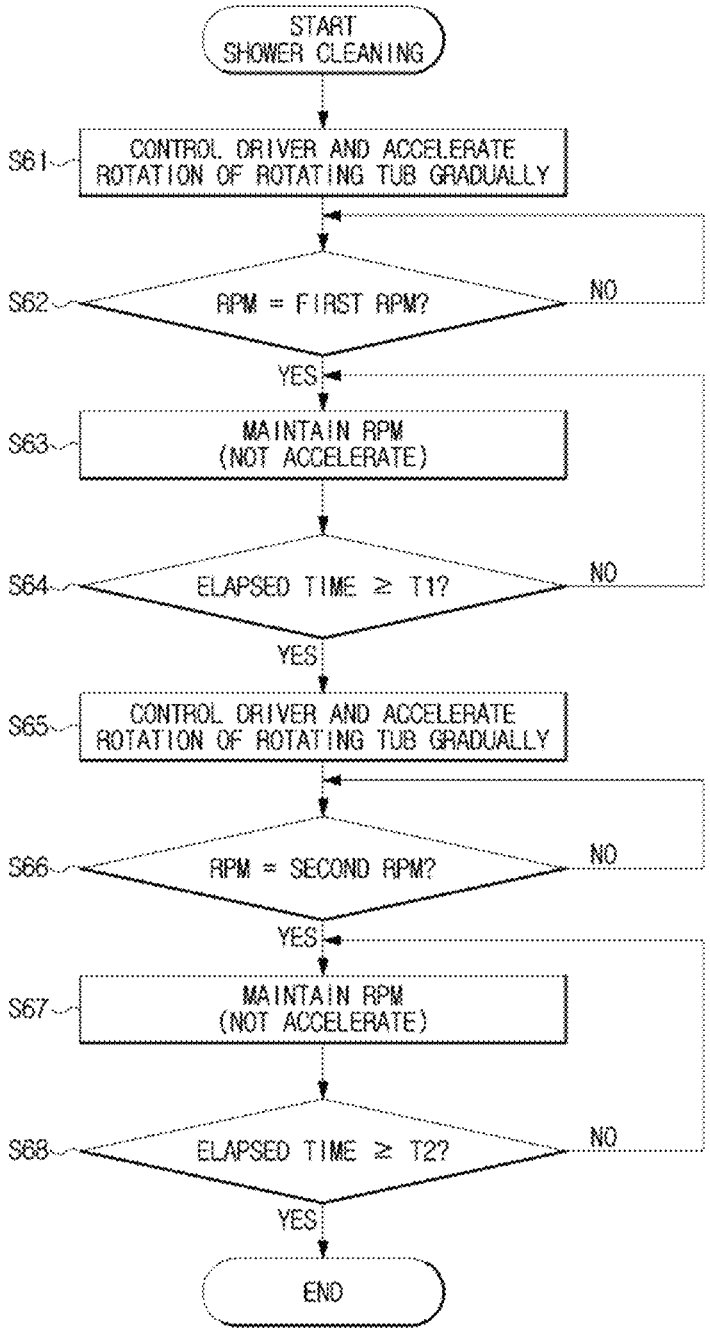
FIG. 62 is a flowchart illustrating a process of shower cleaning.

FIG. 62 is a flowchart showing a process for shower cleaning in detail. During shower cleaning, a process consisting of a first shower cleaning step, an intermediate standby step, and a second shower cleaning step may be executed.

More specifically, the controller 60 may control the driver 50 to accelerate a rotation of the rotating tub 30 gradually (step 61). At this time, the controller 60 may accelerate a rotation of the rotating tub 30 in stages or continuously. The controller 60 may accelerate a rotation of the rotating tub 30 at acceleration that is lower than acceleration of a dehydrating operation until the RPM of the rotating tub 30 reaches first RPM that is lower than the RPM of the dehydrating operation (step S62).

Figure 64:
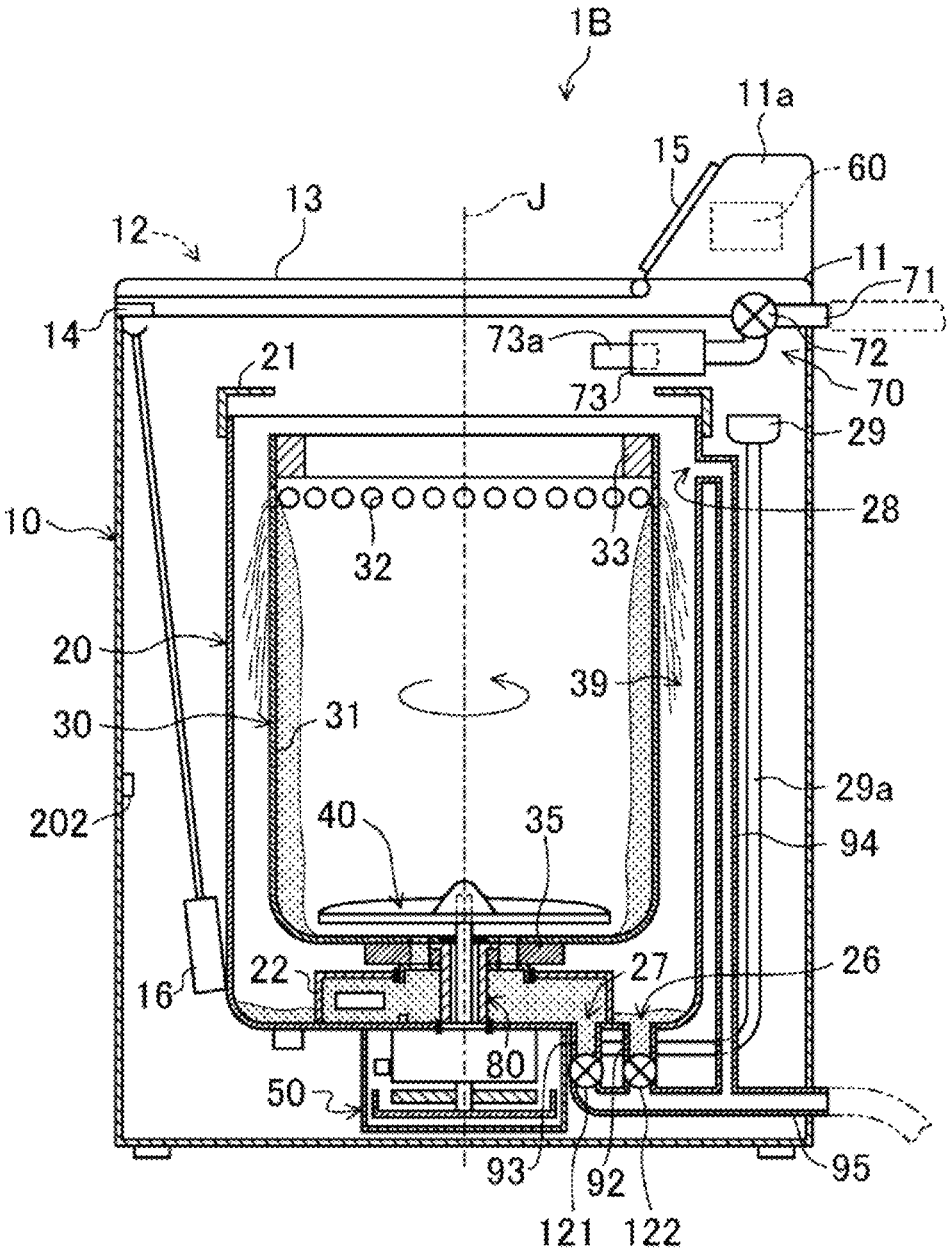
FIG. 64 is a schematic view showing a state in a step of tub cleaning.

Therefore, as shown in FIG. 64, washing water may rise along the inner surface of the body member 31 to overflow continuously through the dehydrating holes 32 (first shower cleaning step). Since the first RPM is low, most of washing water overflowing through the dehydrating holes 32 may fall downward and be scattered in the lower part of the inner wall of the water collecting tub 20. That is, the lower part of the water collecting tub 20 may be cleaned.

When the RPM of the rotating tub 30 reaches the first RPM, the controller 60 may maintain the first RPM of the rotating tub 30 for a predetermined time period (without accelerating the rotating tub 30), and keep the rotating tub 30 in a standby state (steps S63 and S64, intermediate standby step).

When the rotation of the rotating tub 30 is stabilized, the controller 60 may accelerate the rotation of the rotating tub 30 to second RPM that is higher than the first RPM from the first RPM (steps S65 and S66). The acceleration may be higher than in the first show cleaning step.

Figure 65:
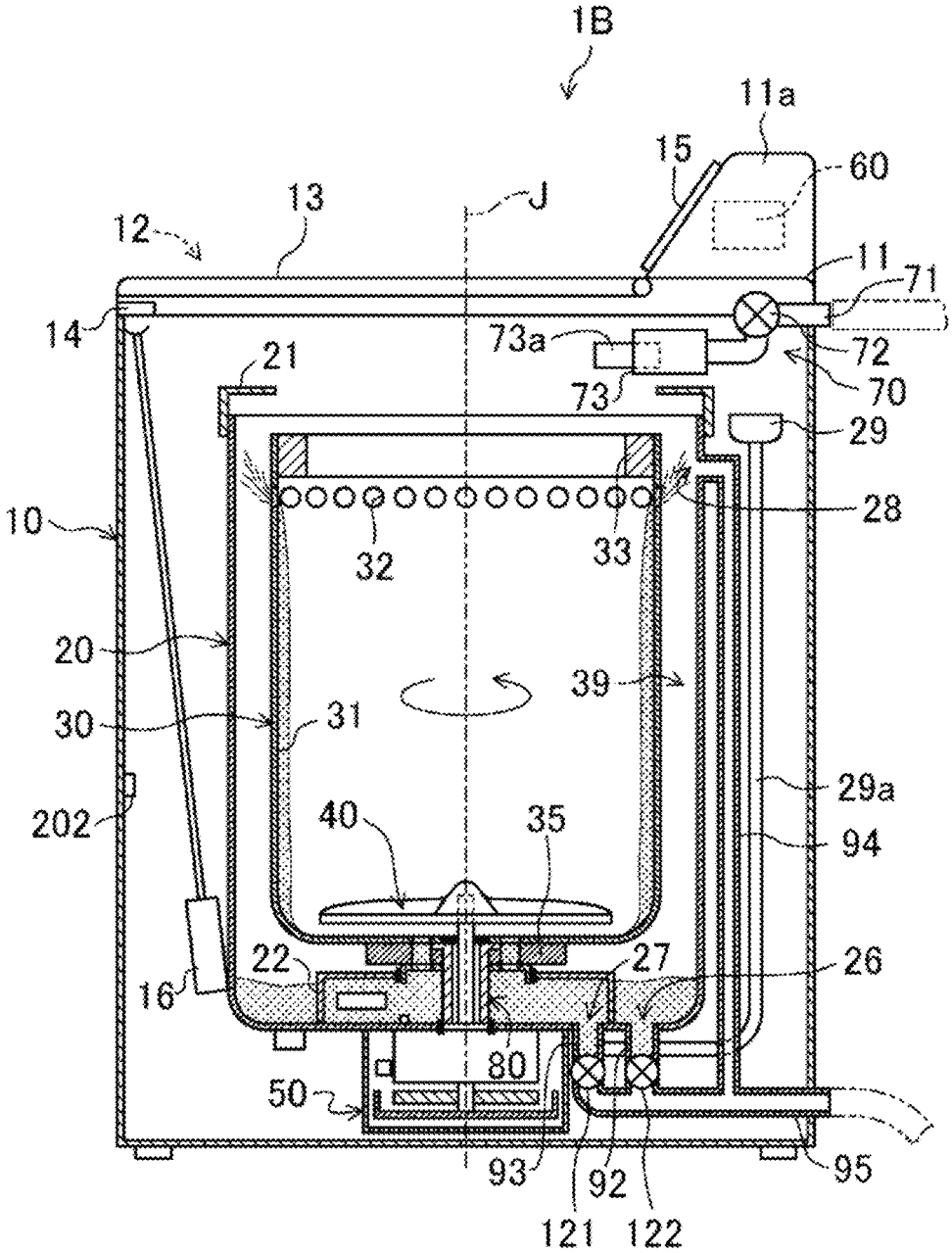
FIG. 65 is a schematic view showing a state in a step of tub cleaning.

In this way, as shown in FIG. 65, washing water may overflow continuously from the dehydrating holes 32 (second shower cleaning step). Since the second RPM is higher than the first RPM, the strength of the washing water overflowing from the dehydrating holes 32 may be strong. Therefore, most of the washing water overflowing from the dehydrating holes 32 may be directed upward, and may be scattered in the upper part of the inner wall of the water collecting tub 20. That is, the upper part of the water collecting tub 20 may be cleaned.

When the RPM of the rotating tub 30 reaches the second RPM, the controller 60 may maintain the rotation speed of the rotating tub 30 at the second RPM for a predetermined time period (steps S67 and S68). Thereafter, the controller 60 may decelerate the rotating tub 30 and then stop rotating the rotating tub 30 (step S7 of FIG. 61).

(Post-Processing Step)

When the rotating tub 30 stops, the controller 60 may open the first opening and shutting valve 121 and the second opening and shutting valve 122 to drain the washing water (step S8).

When drainage terminates, the controller 60 may rotate the rotating tub 30 at RPM that is higher than, for example, the second RPM. Therefore, washing water remaining on the rotating tub 30 may get blown off to be dehydrated (step S9).

The washing machine 1B may effectively clean the outside of the holeless rotating tub 30, that is, the outer space 39 with a small amount of water, without requiring a complicated process. Accordingly, a high quality washing machine may be provided which can maintain cleanliness, while having an advantage of water saving. Also, the water level, the first RPM, the second RPM, the acceleration, and the standby time in the tub cleaning may be appropriately set according to specifications, such as the size or weight of the rotating tub 30 or the water collecting tub 20.

<Application Example 1>

During tub cleaning, washing water overflowing from the rotating tub 30 may be collected in the lower portion of the water collecting tub 20. When washing water collected in the lower portion of the water collecting tub 20 increases, the washing water may be stirred by the rotating rotating tub 30 or the rotating flange shaft 35 so that a water current may be generated in the washing water. Since the water collecting tub 20 is supported in the inside of the housing 10 such that it is shakable, a distribution of washing water collected in the inside of the water collecting tub 20 may become unbalanced due to the influence of the water current, etc. Also, when an amount of overflow changes, a distribution of washing water may become unbalanced.

When a distribution of washing water collected in the lower portion of the water collecting tub 20 becomes unbalanced, the water collecting tub 20 may shake heavily by resonating with the rotation of the rotating tub 30. When the water collecting tub 20 shakes heavily, noise or vibrations may be generated. In this case, when the water collecting tub 20 collides with the housing 10, a distribution of washing water may become greatly unbalanced abruptly due to the impact, which leads to abnormal vibrations which may pull down or damage the washing machine 1B.

Accordingly, in each cleaning step of tub cleaning, specifically, in step S61 or step S65 of accelerating the rotation of the rotating tub 30, an acceleration control process for preventing the generation of such noise or vibrations, furthermore, abnormal vibrations may be preferably performed.

FIG. 65 is a flowchart showing the acceleration control process. The controller 60 may control the driver 50 to accelerate a rotation of the rotating tub 30 gradually (step S601), as shown in step S61 described above, and may increase the RPM of the rotating tub 30 until the RPM of the rotating tub 30 reaches target RPM (first setting RPM or second setting RPM), based on a signal received from the rotation sensor 53 (step S602).

At this time, the controller 60 may determine whether an amplitude of the water collecting tub 20 exceeds a predetermined limit value (for example, a setting value obtained by adding a predetermined safety amount to an amplitude at which abnormal vibrations are generated), based on a signal (a signal related to an amplitude which is a horizontal direction vibration component of the water collecting tub 20) received from the acceleration sensor 25 (step S603). When the amplitude of the water collecting tub 20 exceeds the predetermined limit value, the controller 60 may stop rotating the rotating tub 30, and forcedly stop tub cleaning (step S604). Accordingly, the generation of abnormal vibrations during tub cleaning may be prevented in advance. Also, abnormal vibrations that are generated for unexpected reasons such as a case in which laundry is put wrongly in the rotating tub 30 may be prevented.

Typically, there will be no case in which the amplitude of the water collecting tub 20 exceeds the predetermined limit value, and the water collecting tub 20 may shake with an amplitude that is sufficiently smaller than the predetermined limit value, until the RPM of the rotating tub 30 reaches the target RPM. At this time, the controller 60 may also determine whether the amplitude of the water collecting tub 20 exceeds a predetermined allowable value (a setting value that is smaller than the predetermined limit value and that is set according to specifications of the water collecting tub 20) (step S605).

When the amplitude of the water collecting tub 20 exceeds the predetermined allowable value, the controller 60 may stop accelerating the rotation of the rotating tub 30, and maintain the RPM of the rotating tub 30 (step S606). Accordingly, overflow from the rotating tub 30 may be suppressed, and an influence on washing water collected in the water collecting tub 20 by the rotation of the rotating tub 30 may be reduced. Accordingly, shaking of the water collecting tub 20 may be reduced so that the amplitude of the water collecting tub 20 may be reduced.

When the amplitude of the water collecting tub 20 becomes smaller than or equal to the predetermined allowable value ("NO" in step 605), the controller 60 may resume accelerating the rotation of the rotating tub 30. In this way, by increasing the RPM of the rotating tub 30 in stages, overflow may be done appropriately and smoothly so as to prevent a distribution of washing water collected in the water collecting tub 20 from getting unbalanced. As a result, during tub cleaning, the generation of noise or vibrations may be suppressed, and accordingly, the generation of abnormal vibrations may be prevented in advance.

<Application Example 2>

Dirt such as dust may be removed by sprinkling washing water in the form of a shower. However, it may be not easy to remove mold or bacteria (microbes) generated in the outer space 39. Destroying mold, etc. using a disinfectant requires a large number of rinsing operations, which is a disadvantage in view of water saving. For this reason, sterilization through heating can obtain a stable effect, which is of advantage.

For example, *Escherichia coli* is easily destroyed at 65° C. Mold is also destroyed around the same temperature. For example, most of bacteria or mold is destroyed when being soaked in hot water of 65° C. for several seconds (so-called moist heat sterilization). Accordingly, it may be preferable to remove mold, etc. by performing heat sterilization with a small amount of washing water, More specifically, in the preparing step described above, a process of heating washing water to predetermined sterilization temperature such as 65° C. may be performed (water heating process). The predetermined sterilization temperature may have been set in advance by the controller 60. Since the amount of washing water used for shower cleaning is small, it may be possible to heat the washing water to the predetermined sterilization temperature in a short time using household electric power. Therefore, this results in low consumption power and is economical.

During shower cleaning, hot water may be, like a shower, scattered in the outer space 39 and thus applied with a uniform distribution in the outer space 39. Therefore, the entire area of the outer space 39 may become a moist heat state so that stable sterilization is possible.

Particularly, in the water heating process, a process of adjusting sterilization temperature to higher temperature based on outside temperature around the water collecting tub 20 may be preferably performed. More specifically, the tub cleaning executing portion 60*b* may adjust sterilization temperature to higher temperature based on signals received from a temperature sensor 202 and a water temperature sensor 223, and heat washing water to the adjusted temperature.

During shower cleaning, since washing water is scattered to contact outside air around the water collecting tub 20, the temperature of washing water may be lowered. Also, since the wall of the water collecting tub 20 is at the same temperature as the outside air before shower cleaning, washing water contacting the wall of the water collecting tub 20 may lose heat so that the temperature of the washing water may be further lowered. When the amount of washing water is large, the outer space 39 may become a moist heat state of sterilization temperature in the last half of shower cleaning since the washing water has a large amount of heat. However, since the amount of washing water is small, insufficient sterilization may occur.

Therefore, the controller 60 may calculate an amount of heat (heat dissipation during heating) that is lost by the temperature of outside air or the wall of the water collecting tub 20, from outside air temperature around the water collecting tub 20. Also, the controller 60 may compensate sterilization temperature to higher sterilization temperature in order to quickly make the outer space 39 become a moist-heat state of sterilization temperature, based on the amount of heat and the temperature of washing water. As a result, heating sterilization may be performed regardless of a change in temperature of outside air or in water temperature depending on the season, resulting in stable sterilization performance.

<Modification Example>

The sixth embodiment relates to the washing machine 1B that performs natural drainage in which water falls downward, however, the sixth embodiment may be applied to the washing machine 1C including the drain pump as shown in FIG. 11.

Also, temperature for tub cleaning may be set when the user manipulates the control panel 15 to select temperature of tub cleaning. For example, a degree of cleaning or sterilization may be displayed in correlation with temperature such that a setting of 60° C. is displayed as cleaning or sterilization (weak) or a setting of 70° C. is displayed as cleaning or sterilization (strong) to be selected by a user. Therefore, convenience and economic effects are excellent.

Also, when the temperature of water collected in the rotating tub 30 is high, the controller 60 may operate the locking member 14 to lock the cover 13 (a state in which the user cannot open the cover 13). When the temperature of water falls, the cover 13 may be unlocked (a state in which the user can open the cover 13 although the cover 13 is in a closed state). Therefore, safety may be improved.

Also, water collected in the water collecting tub 20 may be drained preferably after the water is cooled below predetermined temperature. Thereby, it may be possible to prevent the drain hose, etc. from being heated unnecessarily (the drain hose, etc. need not to have heat-resisting property).

Also, in the sixth embodiment, when the amplitude of the water collecting tub 20 exceeds a limit value, tub cleaning may forcedly terminate. However, when a predetermined time has elapsed after the rotating tub 30 stops rotating, tub cleaning may resume. Also, when the amplitude of the water collecting tub 20 exceeds the limit value, an error may be preferably notified to the user through a buzzing sound or a flickering light.

According to the disclosed techniques, it may be possible to implement a top load washing machine having excellent functions in addition to water saving.

For example, according to the first or second technique, functional drainage may be achieved. According to the third technique, it may be possible to heat and circulate washing water efficiently and safely. According to the fourth technique, it may be possible to circulate water stably, while maintaining an appropriate amount of water. According to the fifth technique, it may be possible to effectively discharge water by the rear blades of the pulsator. Accordingly, it may be possible to efficiently collect lint. According to the sixth technique, it may be possible to effectively clean the outer space of the holeless rotating tub while maintaining the advantage of water saving.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a housing;

a water collecting tub disposed in an inside of the housing;

a rotating tub disposed in an inside of the water collecting tub, and comprises:

an outlet opening downward, and a water guide surface inclined downward toward the outlet from an outer circumference of the rotating tub;

a drain path configured to drain water stored in the water collecting tub and the rotating tub to an outside of the housing, wherein the water collecting tub comprises:

a water guide path in communication with the outlet, and disposed between a bottom of the rotating tub and a bottom of the water collecting tub, a first drain hole disposed outside the water guide path, and formed in the bottom of the water collecting tub, and a second drain hole disposed in an inside of the water guide path, and formed in the bottom of the water collecting tub, wherein the drain path comprises a first path connected to the first drain hole, and a second path that is different from the first path and connected to the second drain hole;

a stop valve installed on the first path, and comprising a float configured to close the first path preventing water entering the water collecting tub when floating and open the first path for draining from the water collecting tub when not floating, wherein the stop valve further comprises:

a single flow path formed in an inside of the stop valve, a first restricting member disposed above the float and configured to restrict a movement of the float, and a second restricting member disposed below the float, the second restricting member has a convex structure protruding toward an inside of the flow path and is partially cut in a circumferential direction of the flow path;

a drain pump installed within the housing on the drain path after a junction of the first path and the second path; and a flange shaft disposed on the bottom of the rotating tub to cover a portion of the bottom of the rotating tub and configured to reinforce a strength of the bottom of the rotating tub.

2. The washing machine according to claim 1, wherein:

the water guide path comprises a space partitioned from an outside of the water guide path in the inside of the water collecting tub, and the first path is configured to communicate with the inside of the water collecting tub by the first drain hole, and the second path is configured to communicate with the rotating tub by the space of the water guide path.

3. The washing machine according to claim 1, wherein:

the water collecting tub further comprises a third drain hole opening to an upper side of the water collecting tub, and the drain path further comprises a third path connected to the third drain hole.

4. The washing machine according to claim 3, wherein the drain path further comprises:

a fourth path to which the first path, the second path, and the third path are connected to drain water to the outside of the housing, and a drain valve installed downstream from the junction of the first path and the second path on the fourth path.

5. The washing machine according to claim 4, wherein:

at least any one of the float, the first restricting member, and the second restricting member elastically deforms on contact.

6. The washing machine according to claim 5, wherein:

the first restricting member is formed in a shape of a flange protruding toward the inside of the flow path and extending in the circumferential direction of the flow path.

7. The washing machine according to claim 3, wherein the drain path further comprises:

a fourth path to which the first path, the second path, and the third path are connected, and which is configured to drain the stored water to the outside of the housing, and a first opening and shutting valves installed on the first path, and a second opening and shutting valve installed on the second path.

8. The washing machine according to claim 1, wherein:

the drain path further comprises a third path extends from the junction of the first path and the second path, and the drain pump is installed on the third path.

9. The washing machine according to claim 8, wherein:

the drain path further comprises a first opening and shutting valve installed on the first path, and a second opening and shutting installed on the second path, and the first opening and shutting valve and the second opening and shutting valve open and close the first path and the second path selectively by interworking with driving of the drain pump.

10. The washing machine according to claim 2, wherein the water guide path further comprises a partition plate disposed on the bottom of the water collecting tub, and the water guide path is partitioned from the inside of the water collecting tub by the partition plate.

11. The washing machine according to claim 1, wherein the drain path further comprises a circulation path communicating with the water guide path, and configured to circulate water stored in the water guide path to the rotating tub.

12. The washing machine according to claim 11, further comprising a heater disposed in the inside of the water guide path, and configured to heat the water stored in the water guide path.

13. The washing machine according to claim 11, further comprising a balancer formed in a shape of a ring and installed along an inner surface of an upper opening of the rotating tub, wherein:

the balancer comprises an overflow path disposed below the balancer and formed in an upper portion of the rotating tub to communicate with an outside of the rotating tub, and a stop rib formed in a shape of a cylinder and protruding upward on the balancer, the circulation path comprises an outlet disposed above the water collecting tub, and configured to discharge water to an inside of the rotating tub, and the outlet of the circulation path protrudes inward in a diameter direction of the rotating tub.

14. The washing machine according to claim 13, wherein:

the water collecting tub has a tub cover installed thereon, the tub cover having a flange portion protruding inward in a diameter direction and covering an opening of the rotating tub, and the outlet of the circulation path is integrated into the flange portion.

15. The washing machine according to claim 14, wherein the balancer comprises:

a cover rib protruding upward in the diameter direction of the rotating tub from the stop rib and reducing a gap between the balancer and the flange portion, and a flow path configured to:

communicate a space between the stop rib and the cover rib with the inside of the rotating tub, and discharge water collected between the stop rib and the cover rib to the inside of the rotating tub.

16. The washing machine according to claim 3, further comprising:

a pulsator installed in a lower portion of the rotating tub, and configured to rotate on a rotation shaft of the rotating tub; and a circulation path extending along a side of the rotating tub, communicating with an upper washing space and a lower pump space partitioned by the pulsator, and configured to circulate water through the pulsator, wherein the pulsator comprises:

a base formed in a shape of a disc, and a plurality of water-passage holes penetrating the base and communicating the upper washing space with the lower pump space.

* * * * *